US011247220B2

(12) United States Patent
Aoyama et al.

(10) Patent No.: US 11,247,220 B2
(45) Date of Patent: Feb. 15, 2022

(54) FOAM DISCHARGER

(71) Applicant: KAO CORPORATION, Tokyo (JP)

(72) Inventors: Ryohei Aoyama, Sumida-ku (JP); Naoko Sakayori, Sumida-ku (JP); Noboru Yashima, Sumida-ku (JP); Shinji Oguri, Wakayama (JP)

(73) Assignee: KAO CORPORATION, Tokyo (JP)

( * ) Notice: Subject to any disclaimer, the term of this patent is extended or adjusted under 35 U.S.C. 154(b) by 0 days.

(21) Appl. No.: 16/767,819

(22) PCT Filed: Dec. 14, 2018

(86) PCT No.: PCT/JP2018/046063
§ 371 (c)(1),
(2) Date: May 28, 2020

(87) PCT Pub. No.: WO2019/117285
PCT Pub. Date: Jun. 20, 2019

(65) Prior Publication Data

US 2021/0001358 A1 Jan. 7, 2021

(30) Foreign Application Priority Data

Dec. 15, 2017 (JP) ..... JP2017-240240
Nov. 14, 2018 (JP) ..... JP2018-213760
(Continued)

(51) Int. Cl.
*B05B 7/00* (2006.01)
*A47K 5/12* (2006.01)
*B05B 7/04* (2006.01)

(52) U.S. Cl.
CPC ..... *B05B 7/005* (2013.01); *A47K 5/1205* (2013.01); *B05B 7/0425* (2013.01)

(58) Field of Classification Search
CPC ..... B05B 7/005; B05B 7/0425; A47K 5/1205
(Continued)

(56) References Cited

U.S. PATENT DOCUMENTS 6,082,586 A * 7/2000 Banks ..... B05B 11/3087 222/95
2005/0115988 A1* 6/2005 Law ..... B05B 11/3087 222/145.5
(Continued)

FOREIGN PATENT DOCUMENTS

CN 1347834 A 5/2002
CN 102612473 A 7/2012
(Continued)

OTHER PUBLICATIONS

International Search Report dated Jan. 15, 2019 in PCT/JP2018/046063 filed on Dec. 14, 2018, 2 pages.
(Continued)

*Primary Examiner* — Vishal Pancholi
(74) *Attorney, Agent, or Firm* — Oblon, McClelland, Maier & Neustadt, L.L.P.

(57) ABSTRACT

A foam discharger includes a foamer mechanism (20), the foamer mechanism (20) includes: a liquid flow path (50) through which liquid supplied from a liquid supply unit to a mixing part (21) passes; and a gas flow path (70) through which a gas supplied from a gas supply unit to the mixing part (21) passes, the liquid flow path (50) includes an adjacent liquid flow path (51) having a liquid inlet (52) open to the mixing part (21), the gas flow path (70) includes a plurality of adjacent gas flow paths (71) each having a gas inlet (72) open to the mixing part (21), and the liquid inlet (52) is arranged at a position corresponding to a merging part (22) of gases supplied from the plurality of adjacent gas flow paths (71) to the mixing part (21) via the gas inlet (72).

15 Claims, 48 Drawing Sheets

(30) Foreign Application Priority Data

Nov. 14, 2018 (JP) ..... JP2018-213761
Dec. 7, 2018 (JP) ..... JP2018-229837

(58) Field of Classification Search
USPC ..... 222/145.5
See application file for complete search history.

(56) References Cited

U.S. PATENT DOCUMENTS

| | | | | |
|---|---|---|---|---|
| 2006/0219738 | A1 | 10/2006 | Ilzuka et al. | |
| 2011/0272432 | A1* | 11/2011 | Baughman | B05B 11/3087 222/136 |
| 2013/0019413 | A1* | 1/2013 | Velazquez | A45D 19/02 8/406 |
| 2013/0068794 | A1* | 3/2013 | Kodama | B05B 11/047 222/190 |

FOREIGN PATENT DOCUMENTS

| | | | |
|---|---|---|---|
| CN | 104229334 | A | 12/2014 |
| CN | 104443722 | A | 3/2015 |
| GB | 2566203 | A | 3/2019 |
| JP | 2002-86029 | A | 3/2002 |
| JP | 2005-13945 | A | 1/2005 |
| JP | 2005-262202 | A | 9/2005 |
| JP | 2006-290365 | A | 10/2006 |
| JP | 2011-251691 | A | 12/2011 |
| JP | 2012-1216 | A | 1/2012 |
| JP | 2012-110799 | A | 6/2012 |
| JP | 2012-250722 | A | 12/2012 |
| JP | 5603753 | B2 | 10/2014 |
| JP | 5695502 | B2 | 4/2015 |
| WO | WO 2018/003375 | A1 | 1/2018 |

OTHER PUBLICATIONS

Combined Chinese Office Action and Search Report dated May 6, 2021 in Chinese Patent Application No. 201880080916.9 (with unedited computer generated English translation), 16 pages.

* cited by examiner

FOAM DISCHARGER

TECHNICAL FIELD

The present invention relates to a foam discharger, a liquid-filled product, and a foam discharge cap.

BACKGROUND ART

As a foam discharger that foams and discharges contents, for example, there is a foam dispenser described in Patent Document 1.

The foam dispenser of Patent Document 1 has a liquid pump and a gas pump disposed around the liquid pump, and has a configuration in which liquid pumped from the liquid pump and a gas pumped from the gas pump flow and merge into a mixing part (a merge space in the same document) via a ball valve disposed above the liquid pump. While the liquid pumped from the liquid pump goes upward almost directly from below the mixing part to flow into the mixing part, the gas pumped from the gas pump flows into the mixing part from around the mixing part.

CITATION LIST

Patent Documents

Patent Document 1: JP 2005-262202 A
Patent Document 2: JP 2006-290365 A

SUMMARY OF THE INVENTION

The present invention relates to a foam discharger including:

a foamer mechanism that generates foam from liquid;

a liquid supply unit that supplies liquid to the foamer mechanism;

a gas supply unit that supplies a gas to the foamer mechanism;

a discharge port that discharges the foam generated by the foamer mechanism;

a foam flow path through which the foam from the foamer mechanism toward the discharge port passes, in which the foamer mechanism includes:

a mixing part where the liquid supplied from the liquid supply unit and the gas supplied from the gas supply unit meet;

a liquid flow path through which the liquid supplied from the liquid supply unit to the mixing part passes; and a gas flow path through which the gas supplied from the gas supply unit to the mixing part passes, the foam flow path includes an adjacent foam flow path being adjacent on a downstream side of the mixing part, the liquid flow path includes an adjacent liquid flow path being adjacent on an upstream side of the mixing part and having a liquid inlet that is open to the mixing part, the gas flow path includes a plurality of adjacent gas flow paths being adjacent on an upstream side of the mixing part and each having a gas inlet that is open to the mixing part, and the liquid inlet is arranged at a position corresponding to a merging part of the gases supplied from the plurality of adjacent gas flow paths to the mixing part via the gas inlet.

BRIEF DESCRIPTION OF THE DRAWINGS

FIGS. 7A and 7B are views showing a first member included in a foamer mechanism of the foam discharger according to the second embodiment, in which FIG. 7A is a plan view and FIG. 7B is a perspective view.

FIG. 16A and FIG. 16B are views showing a first member included in a foamer mechanism of a foam discharger according to the third embodiment, in which FIG. 16A is a plan view and FIG. 16B is a perspective view.

FIG. 17A and FIG. 17B are views showing a second member included in the foamer mechanism of the foam discharger according to the third embodiment, in which FIG. 17A is a plan view and FIG. 17B is a bottom view.

DESCRIPTION OF EMBODIMENTS

Figure 1B:
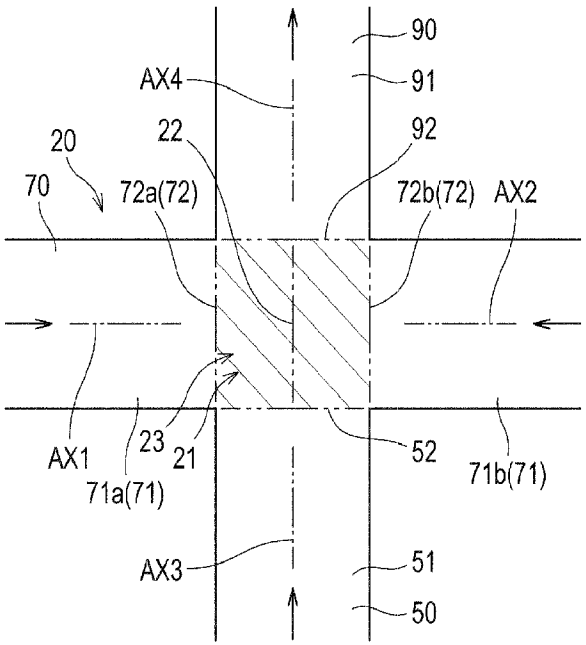
FIG. 1B is an enlarged view of a portion B shown in FIG. 1A.

According to the study of the present inventors, in a foamer mechanism of the foam dispenser having the structure of Patent Document 1, it is not always easy to sufficiently mix the liquid and the gas to generate sufficiently uniform foam depending on properties of the contents, and there is room for improvement in the structure.

The present invention relates to a foam discharger having a structure capable of generating sufficiently uniform foam by mixing a gas and liquid more satisfactorily, a liquid-filled product, and a foam discharge cap.

Hereinafter, preferred embodiments of the present invention will be described with reference to the drawings. Note that, in all the drawings, similar components are denoted by the same reference numerals, and the description will not be repeated.

First Embodiment

First, a foam discharger 100 according to a first embodiment will be described with reference to FIGS. 1A to 2.

Figure 1A:
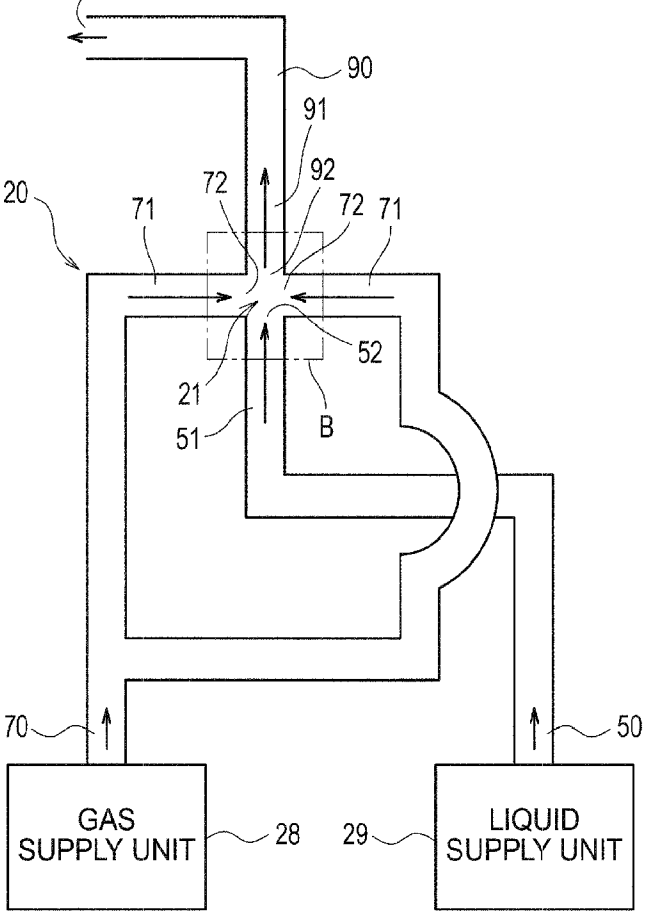
FIG. 1A is a schematic view of a foam discharger according to a first embodiment.

As shown in FIG. 1A, the foam discharger 100 according to the present embodiment include: a foamer mechanism 20 that generates foam from liquid; a liquid supply unit 29 that supplies liquid to the foamer mechanism 20; a gas supply unit 28 that supplies a gas to the foamer mechanism 20; a discharge port 41 that discharges foam generated by the foamer mechanism 20; and a foam flow path 90 through which foam from the foamer mechanism 20 toward the discharge port 41 passes. The foamer mechanism 20 includes: a mixing part 21 where the liquid supplied from the liquid supply unit 29 and the gas supplied from the gas supply unit 28 meet; a liquid flow path 50 through which the liquid supplied from the liquid supply unit 29 to the mixing part 21 passes; and a gas flow path 70 through which the gas supplied from the gas supply unit 28 to the mixing part 21 passes. The foam flow path 90 includes an adjacent foam flow path 91 that is adjacent on a downstream side of the mixing part 21. The liquid flow path 50 includes an adjacent liquid flow path 51 being adjacent on an upstream side of the mixing part 21 and having a liquid inlet 52 that is open to the mixing part 21. The gas flow path 70 includes a plurality of adjacent gas flow paths 71 being adjacent on an upstream side of the mixing part 21 and each having a gas inlet 72 that opens to the mixing part 21. As shown in FIG. 1B, the liquid inlet 52 is arranged at a position corresponding to a merging part 22 of the gases supplied to the mixing part 21 from the plurality of adjacent gas flow paths 71 via the gas inlet 72.

Note that the adjacent foam flow path 91 has a foam outlet 92 that is open to the mixing part 21.

In the case of the present embodiment, the number of the mixing parts 21 is one, two adjacent gas flow paths 71, which are an adjacent gas flow path 71*a* and an adjacent gas flow path 71*b*, supply gas to the mixing part 21, and one adjacent liquid flow path 51 supplies the liquid. Further, one adjacent foam flow path 91 is disposed for the mixing part 21.

A pair of adjacent gas flow paths 71 are arranged in correspondence to each mixing part 21. In other words, a plurality (for example, a pair) of dedicated adjacent gas flow paths 71 are arranged in correspondence to each mixing part 21. Further, the number of adjacent liquid flow paths 51 arranged in correspondence to each mixing part 21 is one, and the mixing part 21 is arranged in correspondence to each adjacent liquid flow path 51. Further, the number of adjacent foam flow paths 91 arranged in correspondence to each mixing part 21 is one.

However, the present invention is not limited to this example, and the foamer mechanism 20 may have a plurality of adjacent liquid flow paths 51, and the mixing part 21 may be individually arranged in correspondence to each of the adjacent liquid flow paths 51.

That is, the foamer mechanism 20 has one or more adjacent liquid flow paths 51, and the mixing part 21 is arranged in correspondence to each adjacent liquid flow path 51.

Further, in the present invention, equal to or more than three adjacent gas flow paths 71 may be arranged in correspondence to each mixing part 21, equal to or more than two adjacent liquid flow paths 51 may be arranged in correspondence to each mixing part 21, and equal to or more than two adjacent foam flow paths 91 may be arranged in correspondence to each mixing part 21.

As shown in FIG. 1B, each gas inlet 72 is a downstream end of each adjacent gas flow path 71, and is a connection end of each adjacent gas flow path 71 with the mixing part 21. The gas inlet 72*a* is a downstream end of the adjacent gas flow path 71*a*, and the gas inlet 72*b* is a downstream end of the adjacent gas flow path 71*b*.

The liquid inlet 52 is a downstream end of the adjacent liquid flow path 51, and is a connection end of the adjacent liquid flow path 51 with the mixing part 21.

The foam outlet 92 is an upstream end of the adjacent foam flow path 91, and is a connection end of the adjacent foam flow path 91 with the mixing part 21.

Here, equal to or more than one surface among a plurality of surfaces defining the mixing part 21 may include a virtual surface and a wall surface, or may be a virtual surface not including a wall surface.

In the case of the present embodiment, the mixing part 21 has, for example, a rectangular parallelepiped shape. Each of the gas inlet 72*a*, the gas inlet 72*b*, the liquid inlet 52, and the foam outlet 92 (each are virtual surfaces not including wall surfaces) constitutes one of four surfaces out of six surfaces defining the mixing part 21, and the remaining two surfaces are wall surfaces each defining a near side and a back side of the mixing part 21 on the page of FIG. 1B. That is, the mixing part 21 is defined by the plurality of gas inlets 72, the liquid inlet 52, the foam outlet 92, and the wall surfaces.

As described above, in the present invention, the foamer mechanism 20 may have a plurality of mixing parts 21. That is, as an example, the foamer mechanism 20 includes a plurality of mixing parts 21, and each of the plurality of mixing parts 21 is defined by the plurality of gas inlets 72, the liquid inlet 52, the foam outlet 92, and the wall surfaces.

The merging part 22 is a portion where gases supplied to the mixing part 21 from the plurality of adjacent gas flow paths 71 via the gas inlet 72 merge, flows of the gas supplied from these adjacent gas flow paths 71 to the mixing part 21 are balanced, and the gases are pushed each other.

Here, in this specification, a gas-liquid contact region 23 refers to a region, in the mixing part 21, in which an overlapping region of regions that are individually extended from the plurality of adjacent gas flow paths 71 arranged in correspondence to the mixing part 21 in an axial direction at downstream ends of the respective adjacent gas flow paths 71, is overlapped with a region extended from the adjacent liquid flow path 51 arranged in correspondence to the mixing part 21 in an axial direction at a downstream end of the adjacent liquid flow path 51. In FIG. 1B, the gas-liquid contact region 23 is hatched.

The merging part 22 is a portion in the gas-liquid contact region 23, and is a portion located in the middle between the plurality of gas inlets 72 that are open to one mixing part 21.

In the case of the present embodiment, a pair of adjacent gas flow paths 71 are arranged in correspondence to one mixing part 21, and gas supply directions from the pair of adjacent gas flow paths 71 to the corresponding mixing part 21 are opposed to each other. The gas inlets 72*a* and 72*b* of the adjacent gas flow paths 71*a* and 71*b* are opposed to each other in parallel. Further, an axis AX3 of the adjacent liquid flow path 51 is orthogonal to axes AX1 and AX2. In this case, as shown in FIG. 1B, the merging part 22 is a virtual surface located in the middle between the two gas inlets 72*a* and 72*b*.

However, in the present invention, the foamer mechanism 20 may have a plurality of mixing parts 21. In this case, a pair of adjacent gas flow paths 71 may be arranged in correspondence to each mixing part 21, and gas supply directions from the pair of adjacent gas flow paths 71 to the corresponding mixing part 21 may be opposed to each other.

Thus, the foamer mechanism 20 has one or more mixing parts 21, a pair of adjacent gas flow paths 71 are arranged in correspondence to each mixing part 21, and gas supply directions from the pair of adjacent gas flow paths 71 to the corresponding mixing part 21 are opposed to each other.

More specifically, in the case of the present embodiment, the adjacent gas flow paths 71*a* and 71*b* each extend linearly, a cross-sectional shape of each of the adjacent gas flow paths 71*a* and 71*b* is rectangular, the gas inlet 72*a* is a rectangular opening orthogonal to the axis of the adjacent gas flow path 71*a*, and the gas inlet 72*b* is a rectangular opening orthogonal to the axis of the adjacent gas flow path 71*b*. Further, the gas inlet 72*a* and the gas inlet 72*b* are formed to have the same shape and the same area as each other. That is, shapes of the gas inlets 72 being open to the mixing part 21 are equal to each other, and areas of the gas inlets 72 being open to the mixing part 21 are equal to each other. Further, the axis AX1 of the adjacent gas flow path 71*a* and the axis AX2 of the adjacent gas flow path 71*b* are arranged on a same straight line. The adjacent liquid flow path 51 has a cross section of a rectangular shape. The entire mixing part 21 is the gas-liquid contact region 23, and the mixing part 21 and the gas-liquid contact region 23 are equal to each other. Further, the adjacent liquid flow path 51 extends linearly, and the axis AX3 of the adjacent liquid flow path 51 is orthogonal to the axis AX1 and AX2. The adjacent foam flow path 91 extends linearly, and an axis AX4 of the adjacent foam flow path 91 is arranged on the same straight line as the axis AX3.

In the case of the present embodiment, the merging part 22 is located in the middle between the two gas inlets 72*a* and 72*b*, and is an imaginary surface (virtual surface) having the same shape and dimension as those of the gas inlets 72*a* and 72*b*.

Note that, when equal to or more than three adjacent gas flow paths 71 are arranged for one mixing part 21, and axes of these equal to or more than three adjacent gas flow paths 71 are arranged on a same plane, the merging part 22 is an imaginary line (virtual line) that includes an intersection of the axes of these three adjacent gas flow paths 71 and is orthogonal to the plane.

Further, when equal to or more than three adjacent gas flow paths 71 are arranged for one mixing part 21 and the axes of these adjacent gas flow paths 71 are not on a same plane, the merging part 22 is an imaginary point (virtual point).

The fact that the liquid inlet 52 is arranged at a position corresponding to the merging part 22 is that the liquid inlet 52 and the merging part 22 are overlapped (at least a part of the liquid inlet 52 and at least a part of the merging part 22 are overlapped), when the liquid inlet 52 is viewed in a direction of the axis AX3 at a downstream end of the adjacent liquid flow path 51.

The liquid inlet 52 is preferably located near the merging part 22. For example, a distance between the liquid inlet 52 and the merging part 22 is preferably equal to or less than a diameter of the liquid inlet 52. Further, it is more preferable that the liquid inlet 52 is arranged at a position directly in contact with the merging part 22. As shown in FIG. 1B, in the case of the present embodiment, the liquid inlet 52 is in direct contact with the merging part 22.

In addition, it is preferable that the gas inlets 72 are respectively arranged at positions on both sides of a region on an extension of the adjacent liquid flow path 51 (hereinafter, an extension region) in the mixing part 21.

Here, the extension region is a region, in the mixing part 21, that is overlapped with the adjacent liquid flow path 51 when viewed in the direction of the axis AX3 at the downstream end of the adjacent liquid flow path 51. Here, it is preferable that no obstacle is present between the extension region and the adjacent liquid flow path 51. However, an obstacle that hinders a flow of fluid may be present between the extension region and the adjacent liquid flow path 51.

The extension region may be a partial region of the mixing part 21 or the entire mixing part 21. In the case of the present embodiment, the extension region is the entire mixing part 21.

Note that the extension region is a region including the gas-liquid contact region 23 described above. In the case of the present embodiment, the extension region, the gas-liquid contact region 23, and the mixing part 21 are equal to each other.

The fact that the gas inlets 72 are respectively arranged at positions on both sides of the extension region is that the gas inlets 72 are respectively arranged in regions on both sides of an extension line of the axis AX3 at the downstream end of the adjacent liquid flow path 51.

Then, the gas inlets 72 are arranged such that gases flowing into the mixing part 21 via each gas inlet 72 reach the extension region from both sides of the extension region.

Further, it is preferable that each of the gas inlets 72 arranged at positions on both sides of the region on the extension (extension region) of the adjacent liquid flow path 51 is directed to the region.

The fact that the gas inlet 72 is directed to the extension region means that any portion of the gas inlet 72 is overlapped with the extension region (at least a part of the gas inlet 72 is overlapped with at least a part of the extension region), when viewed in the axial direction at a downstream end of the adjacent gas flow path 71. It is preferable that there is no obstacle between the extension region and the gas inlet 72, but an obstacle that hinders a flow of fluid may be present between the extension region and the gas inlet 72.

As described above, in the present embodiment, a pair of adjacent gas flow paths 71 are arranged for one mixing part 21. In this case, it is preferable that the gas inlets 72 that are open to one mixing part 21 are opposed each other with the mixing part 21 interposed in between. The fact that the gas inlets 72 open to one mixing part 21 are opposed to each other with the mixing part 21 interposed in between means that the gas inlet 72*a* of the adjacent gas flow path 71*a* is overlapped with the mixing part 21 and the gas inlet 72*b* of the other adjacent gas flow path 71*b* (at least a part of the gas inlet 72*a* is overlapped with at least a part of the mixing part 21 and at least a part of the gas inlet 72*b*) when viewed in a direction of the axis AX1 at a downstream end of one adjacent gas flow paths 71*a* of the pair of adjacent gas flow paths 71, and the gas inlet 72*b* of the adjacent gas flow path 71*b* is overlapped with the mixing part 21 and the gas inlet 72*a* of one of the adjacent gas flow paths 71*a* (at least a part of the gas inlet 72*b* is overlapped with at least a part of the mixing part 21 and at least a part of the gas inlet 72*a*) when viewed in a direction of the axis AX2 at a downstream end of the other adjacent gas flow path 71*b*.

Hereinafter, a configuration of the foam discharger 100 according to the present embodiment will be described in more detail.

In the case of the present embodiment, a maximum value of an inner cavity cross-sectional area of the mixing part 21 orthogonal to an axial direction (the direction of the axis AX3) of the adjacent liquid flow path 51 is the same as a flow path area of the adjacent liquid flow path 51.

Here, the flow path area of the adjacent liquid flow path 51 is an average value of the inner cavity cross-sectional area of the adjacent liquid flow path 51 orthogonal to the axial direction of the adjacent liquid flow path 51, and is a value obtained by dividing a volume of the adjacent liquid flow path 51 by a length of the adjacent liquid flow path 51.

It is also preferable that the maximum value of the inner cavity cross-sectional area of the mixing part 21 orthogonal to the axial direction of the adjacent liquid flow path 51 is smaller than the flow path area of the adjacent liquid flow path 51.

That is, the maximum value of the inner cavity cross-sectional area of the mixing part 21 orthogonal to the axial direction of the adjacent liquid flow path 51 is equal to the flow path area of the adjacent liquid flow path 51 or smaller than the flow path area.

When the adjacent liquid flow path 51 is not linear, it is preferable that the maximum value of the inner cavity cross-sectional area of the mixing part 21 orthogonal to the axial direction at the downstream end of the adjacent liquid flow path 51 is equal to the flow path area of the adjacent liquid flow path 51 or smaller than the flow path area.

In the case of the present embodiment, the flow path area of the adjacent foam flow path 91 is equal to a maximum value of an inner cavity cross-sectional area orthogonal to an axial direction (a direction of the axis AX4) of the adjacent foam flow path 91 in the mixing part (the inner cavity cross-sectional area of the mixing part 21 orthogonal to the axial direction of the adjacent foam flow path 91).

Here, the flow path area of the adjacent foam flow path 91 is an average value of the inner cavity cross-sectional area of the adjacent foam flow path 91 orthogonal to the axial direction of the adjacent foam flow path 91, and is a value obtained by dividing a volume of the adjacent foam flow path 91 by a length of the adjacent foam flow path 91.

It is also preferable that the flow path area of the adjacent foam flow path 91 is smaller than the maximum value of the inner cavity cross-sectional area of the mixing part 21 orthogonal to the axial direction of the adjacent foam flow path 91.

That is, the flow path area of the adjacent foam flow path 91 is equal to the maximum value of the inner cavity cross-sectional area of the mixing part 21 orthogonal to the axial direction of the adjacent foam flow path 91, or smaller than the inner cavity cross-sectional area.

When the adjacent foam flow path 91 is not linear, it is preferable that the maximum value of the inner cavity cross-sectional area of the mixing part 21 orthogonal to the axis at the upstream end of the adjacent foam flow path 91, is equal to the flow path area of the adjacent foam flow path 91 or smaller than the flow path area.

More preferably, the flow path area of the adjacent foam flow path 91 is equal to a value obtained by dividing a volume of the mixing part 21 by a dimension of the mixing part 21 in the axial direction of the adjacent foam flow path 91 (an average value of the inner cavity cross-sectional area of the mixing part 21 orthogonal to the axial direction of the adjacent foam flow path 91), or smaller than the value.

An opening area of the foam outlet 92 is preferably smaller than the flow path area of the adjacent liquid flow path 51, or equal to the flow path area of the adjacent liquid flow path 51.

The opening area of the foam outlet 92 is preferably smaller than the inner cavity cross-sectional area of the mixing part 21 orthogonal to the axial direction of the adjacent foam flow path 91, or equal to the inner cavity cross-sectional area.

Further, it is preferable that the inner cavity cross-sectional area of the mixing part 21 orthogonal to the axial direction of the adjacent foam flow path 91 is larger than an opening area of the gas inlet 72 corresponding to the mixing part 21. When a plurality of gas inlets 72 are arranged in correspondence to one mixing part 21, it is preferable that the inner cavity cross-sectional area of the mixing part 21 orthogonal to the axial direction of the adjacent foam flow path 91 is larger than a total value of the opening areas of the gas inlets 72.

In the case of the present embodiment, a length of the adjacent foam flow path 91 is longer than a dimension of the gas inlet 72 in the axial direction of the adjacent foam flow path 91. In addition, the length of the adjacent foam flow path 91 is longer than the dimension of the mixing part 21 in the axial direction of the adjacent foam flow path 91.

Further, in the case of the present embodiment, the adjacent foam flow path 91 and the adjacent liquid flow path 51 are arranged on opposite sides of each other with the mixing part 21 as a reference. Then, the foam outlet 92 and the liquid inlet 52 are opposed to each other with the mixing part 21 interposed in between. The fact that the foam outlet 92 and the liquid inlet 52 are opposed to each other with the mixing part 21 interposed in between means that the foam outlet 92 is overlapped with the mixing part 21 and the liquid inlet 52 (at least a part of the foam outlet 92 is overlapped with at least a part of the mixing part 21 and at least a part of the liquid inlet 52) when viewed in an axial direction at the upstream end of the adjacent foam flow path 91, and the liquid inlet 52 is overlapped with the mixing part 21 and the foam outlet 92 (at least a part of the liquid inlet 52 is overlapped with at least a part of the mixing part 21 and at least a part of the foam outlet 92) when viewed in the axial direction at the downstream end of the adjacent liquid flow path 51.

Figure 2:
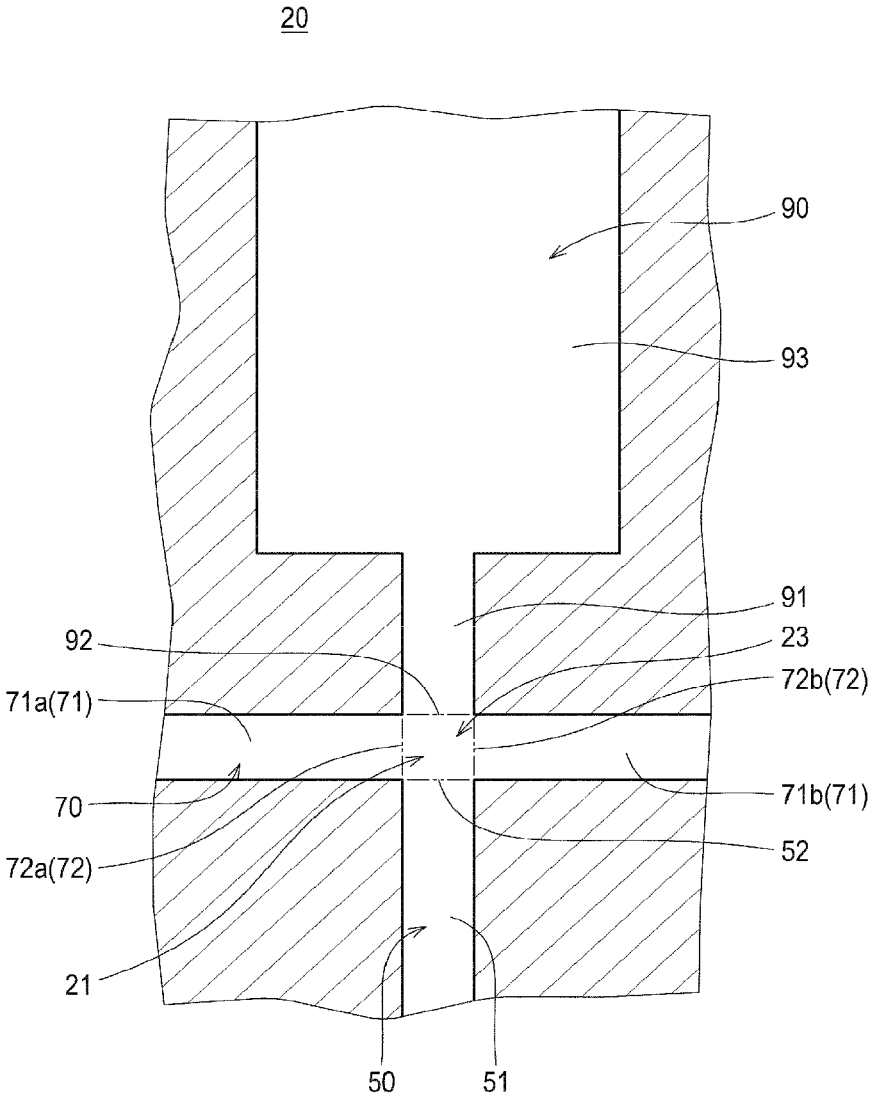
FIG. 2 is a cross-sectional view showing an example of a more detailed structure of a foamer mechanism of the foam discharger according to the first embodiment.

More specifically, in the case of the present embodiment, as shown in FIG. 2, the foam flow path 90 includes an enlarged foam flow path 93 being adjacent on a downstream side of the adjacent foam flow path 91 and having a flow path area larger than that of the adjacent foam flow path 91. Therefore, it is possible to suppress blocking of the adjacent foam flow path 91 by the generated foam, and to more suitably continuously generate foam.

Figure 3B:
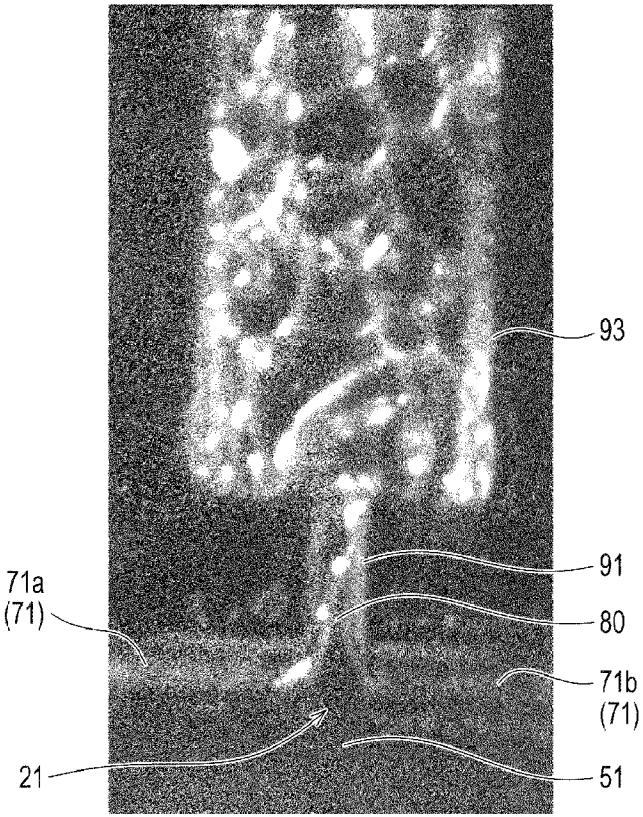
FIGS. 3A and 3B are views showing photographs obtained by capturing a state where foam is discharged with use of the foamer mechanism having the structure shown in FIG. 2.
Figure 3A:
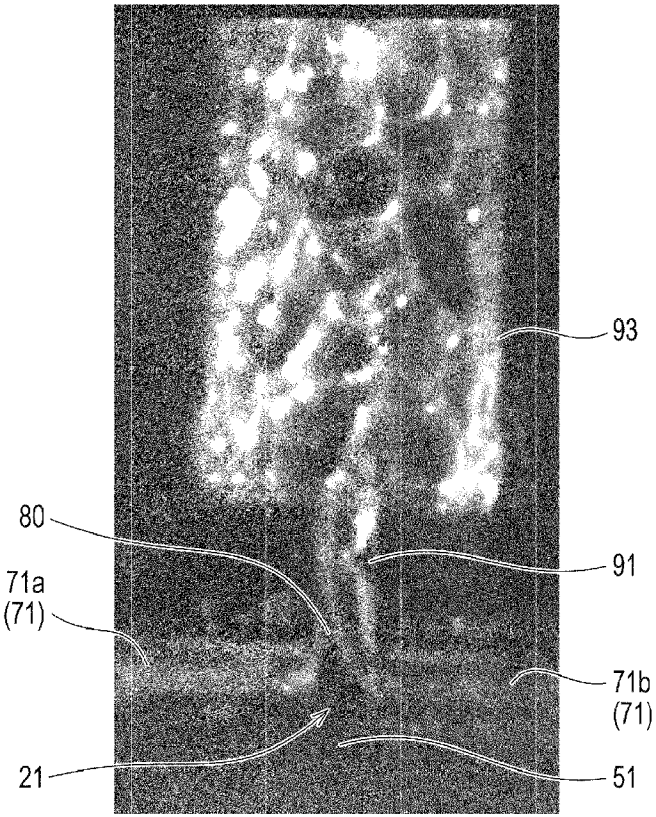

Here, FIGS. 3A and 3B are views showing photographs obtained by capturing a state where foam is discharged with use of the foamer mechanism having the structure shown in FIG. 2.

As shown in FIGS. 3A and 3B, an action has been observed in which a liquid column 80 is formed by the liquid supplied to the mixing part 21 from the adjacent liquid flow path 51, this liquid column 80 swings at high speed sequentially (alternately) in a direction away from the adjacent gas flow path 71*b* and a direction away from the adjacent gas flow path 71*a*, and fine foam has been intermittently generated from the liquid column 80. Such an action has generated a lot of fine foam.

The reason for the occurrence of such an action is unclear, but this may be because timing at which a pressure of a gas supplied from one adjacent gas flow path 71*a* to the mixing part 21 falls below a pressure of a gas supplied from the other adjacent gas flow path 71*b* to the mixing part 21 (a pressure of the gas supplied from the other adjacent gas flow path 71*b* to the mixing part 21 exceeds a pressure of the gas supplied from the one adjacent gas flow path 71*a* to the mixing part 21), and timing at which a pressure of the gas supplied from the one adjacent gas flow path 71*a* to the mixing part 21 exceeds a pressure of the gas supplied from the other adjacent gas flow path 71*b* to the mixing part 21 (a pressure of the gas supplied from the other adjacent gas flow path 71*b* to the mixing part 21 falls below a pressure of the gas supplied from the one adjacent gas flow path 71*a* to the mixing part 21), occur sequentially (alternately) at short time intervals.

The liquid column 80 has been formed in a range from the mixing part 21 to the adjacent foam flow path 91, and has been sometimes formed in a range from the mixing part 21 to the enlarged foam flow path 93. That is, the foam may also be generated in the adjacent foam flow path 91 and the enlarged foam flow path 93, in addition to the mixing part 21.

In this way, at least the adjacent foam flow path 91 constitutes a swing region in which the liquid column 80 formed by the liquid sequentially swings in directions away from the individual gas inlets 72, which are open to the mixing part 21, of the plurality of adjacent gas flow paths 71.

More specifically, in the case of the present embodiment, a pair of adjacent gas flow paths 71 are arranged for one mixing part 21, and the liquid column 80 swings alternately in the swing region.

By using the foamer mechanism having the structure shown in FIG. 2 to discharge foam, a gas and liquid can be more satisfactorily mixed in the mixing part 21. Therefore, it is easy to generate sufficiently uniform and fine foam.

Although the foam discharger 100 does not include a mesh that is included in a typical foamer mechanism, it is still possible to generate sufficiently uniform and fine foam. Therefore, clogging of the mesh can be prevented.

Further, liquid that is not easily foamed, such as high-viscosity liquid, can be easily foamed.

While details will be described in examples described later, by using the foamer mechanism having the structure shown in FIG. 2 to discharge foam, fineness of the foam can be made uniform regardless of amounts of a gas and liquid supplied to the mixing part 21 per unit time.

According to the present embodiment, since the liquid inlet 52 is arranged at a position corresponding to the merging part 22 of gases supplied to the mixing part 21 from the plurality of adjacent gas flow paths 71 via the gas inlet 72, the liquid can be effectively foamed by an airflow, by causing the liquid column to swing as described above. Therefore, it is possible to mix a gas and liquid satisfactorily to generate sufficiently uniform foam.

In addition, since each mixing part 21 is arranged in correspondence to each adjacent liquid flow path 51, an escape of a gas and liquid from the mixing part 21 is restricted, so that the gas and the liquid in the mixing part 21 can be mixed more reliably.

By arranging a plurality of dedicated adjacent gas flow paths 71 in correspondence to each mixing part 21, the escape of the gas and the liquid from the mixing part 21 is further restricted, so that the gas and the liquid in the mixing part 21 can be mixed more reliably.

Since a flow path area of the adjacent foam flow path 91 is the same as the maximum value of the inner cavity cross-sectional area of the mixing part 21 orthogonal to the axial direction of the adjacent foam flow path 91, the swing of the liquid column as described above can be performed in a limited space, and a flow path of an airflow passing around the liquid column is also restricted. Therefore, fine foam can be intermittently generated more satisfactorily.

Further, a length of the adjacent foam flow path 91 is longer than a dimension of the gas inlet 72 in the axial direction of the adjacent foam flow path 91. That is, in a subsequent stage of the mixing part 21, a region of a sufficient length with a restricted flow path area is to be provided. Therefore, fine foam can be intermittently generated while the swing of the liquid column as described above is more reliably performed.

In addition, since gas supply directions from the pair of adjacent gas flow paths 71*a* and 71*b* to the corresponding mixing part 21 are opposed to each other, the airflows can be more satisfactorily pushed each other at the merging part 22. Therefore, fine foam can be intermittently generated while the swing of the liquid column as described above is more reliably performed.

Second Embodiment

Next, a second embodiment will be described with reference to FIGS. 4 to 13.

A foam discharger 100 according to the present embodiment is different from the foam discharger 100 according to the first embodiment in the points described below, and is configured similarly to the foam discharger 100 according to the first embodiment in other respects.

Figure 4:
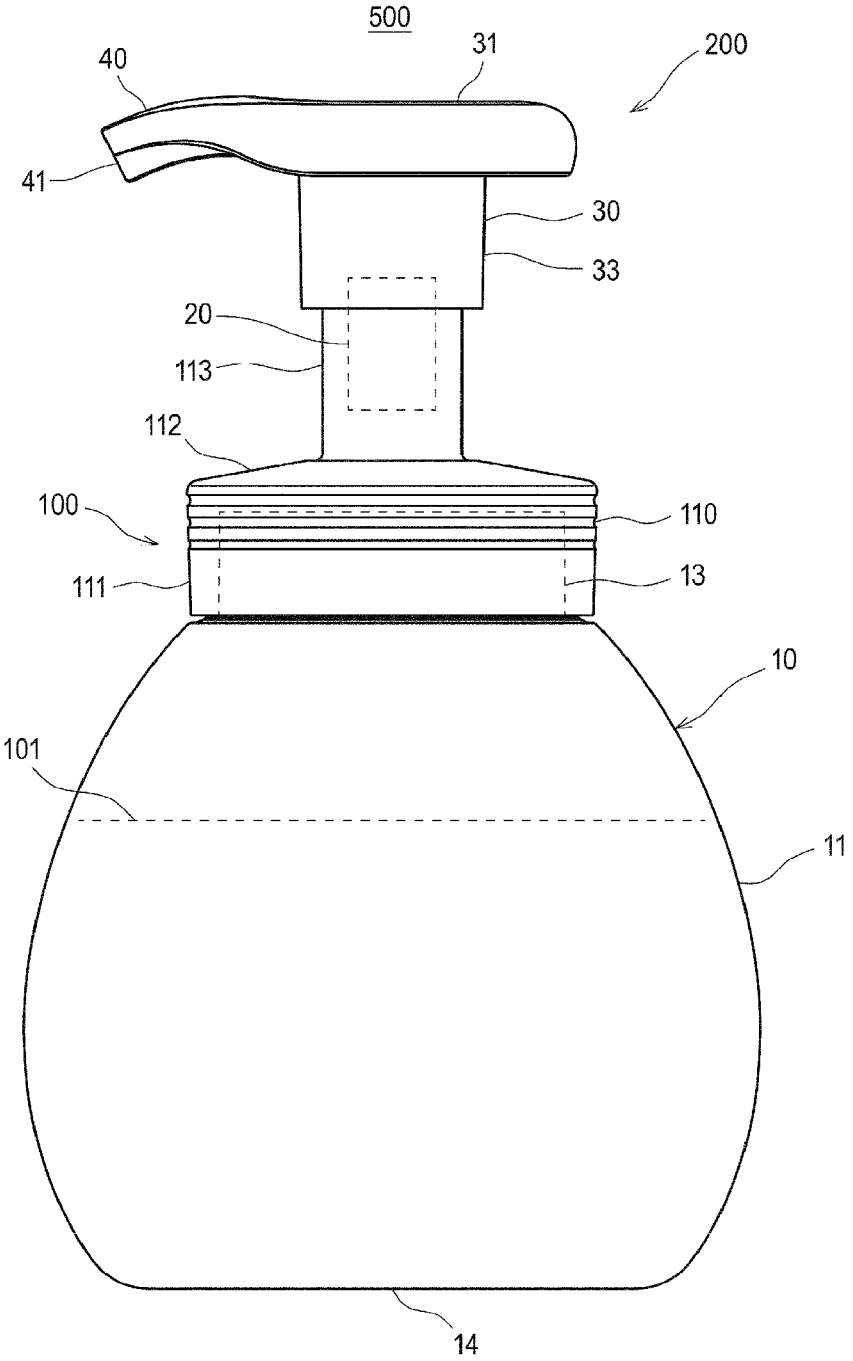
FIG. 4 is a side view of a foam discharger according to a second embodiment.

In the following, it is assumed that a downward direction in FIG. 4 is downward and an opposite direction is upward, in order to simplify a description of a positional relationship of components of the foam discharger 100. However, these directions do not restrict directions during production and use of the foam discharger 100.

As shown in FIG. 4, the foam discharger 100 includes a storage container 10 that stores liquid 101, and a foam discharge cap 200 that is detachably attached to the storage container 10.

A shape of the storage container 10 is not particularly limited. However, for example, as shown in FIG. 4, the storage container 10 has a shape including a cylindrical body part 11, a cylindrical mouth and neck part 13 connected above the body part 11, and a bottom part 14 closing a lower end of the body part 11. An upper end of the mouth and neck part 13 is formed with an opening.

The storage container 10 is filled with the liquid 101.

A liquid-filled product 500 according to the present embodiment includes the foam discharger 100 and the liquid 101 filled in the storage container 10.

In the present embodiment, as the liquid 101, a hand soap can be given as a typical example. However, without limiting to this, various types used in a foam form may be exemplified, such as facial cleanser, cleansing agent, dishwashing detergent, hairdressing agent, body soap, shaving cream, skin cosmetics such as a foundation and serum, a hair dye, and a disinfectant.

A viscosity of the liquid 101 before foaming is not particularly limited, but may be, for example, equal to or more than 1 mPa·s and equal to or less than 10 mPa·s at 20° C.

The foam discharger 100 according to the present embodiment can satisfactorily foam, for example, a shampoo of equal to or more than 10 mPa·s and equal to or less than 100 mPa·s at 20° C. The foam discharger 100 has a structure suitable for foaming further higher viscosity liquid 101, to be able to suitably form, for example, the liquid 101 having a viscosity of equal to or more than 100 mPa·s at 20° C.

Note that a B-type viscometer may be used for the viscosity measurement, and a rotor and a rotation speed suitable for the viscosity range to be measured can be selected.

The foam discharger 100 changes the liquid 101 into foam by bringing the liquid 101 stored in the storage container 10 at normal pressure into contact with air at the mixing part 21 (FIG. 12 and the like) of the foamer mechanism 20.

In the case of the present embodiment, the foam discharger 100 is, for example, a pump container that discharges foam by a hand-pushing operation, and forms the liquid 101 and discharges the foam when an operation receiving part 31 of a head member (head part) 30 is pushed down. In the case of the present embodiment, a liquid supply unit that supplies the liquid 101 to the foamer mechanism 20 is, for example, a liquid cylinder of a liquid pump, and a gas supply unit that supplies a gas to the foamer mechanism 20 is, for example, a gas cylinder of a gas pump.

However, the present invention is not limited to this example, and the foam discharger may be a so-called squeeze bottle configured to discharge foam by squeezing a storage container, or may be an electric foam dispenser equipped with a motor or the like.

Figure 5:
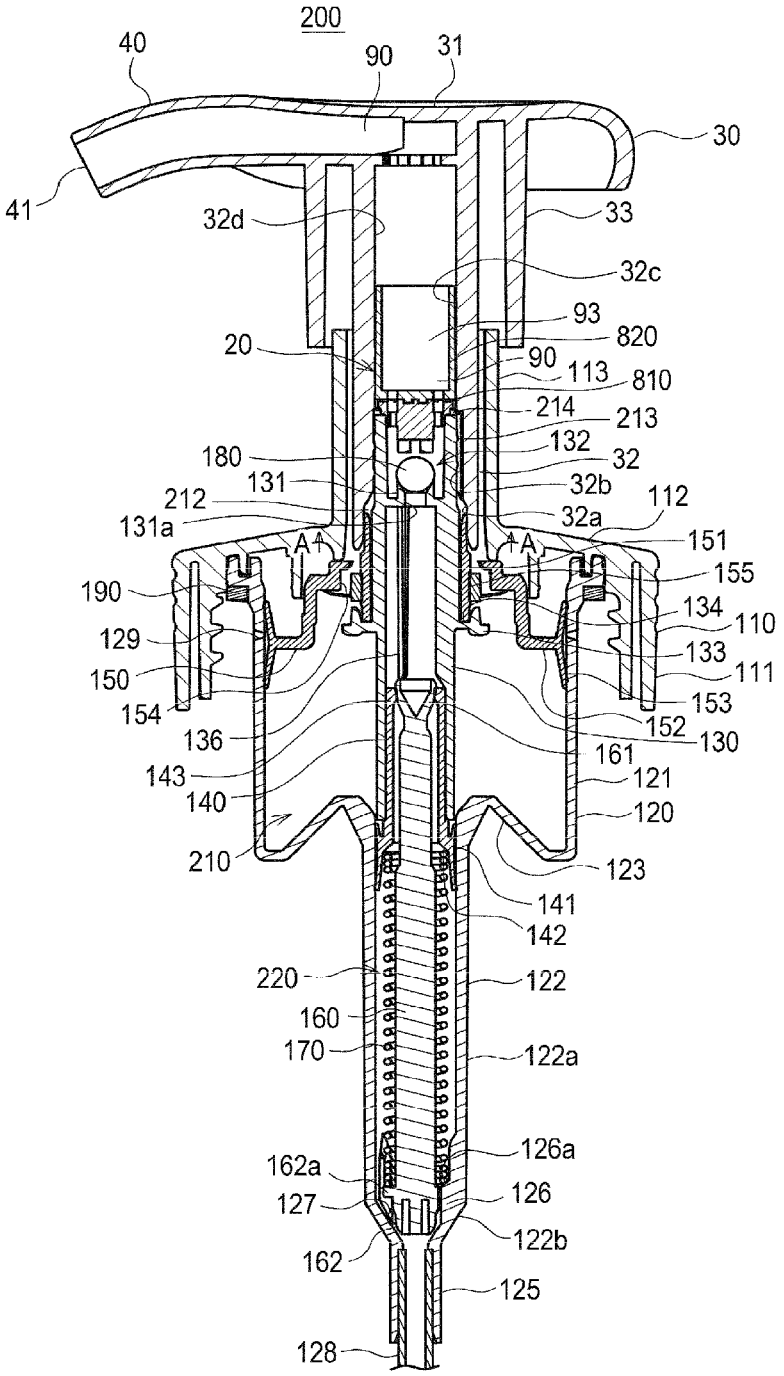
FIG. 5 is a side cross-sectional view of a foam discharge cap according to the second embodiment.

As shown in FIG. 5, the foam discharge cap 200 includes: a cap member 110 having a cylindrical mounting part 111 detachably mounted to the mouth and neck part 13 (FIG. 4) by a fastening method such as screwing; a cylinder member 120 fixed to the cap member 110 to constitute a cylinder of the liquid pump and the gas pump; and the head member 30 having the operation receiving part 31 that receives a pushing operation.

By mounting the mounting part 111 on the mouth and neck part 13, the entire foam discharge cap 200 is mounted to the mouth and neck part 13. The mounting part 111 may be formed in a double-cylinder structure as shown in FIG. 5 with an inner cylindrical part being adapted to be screwed to the mouth and neck part 13, or may be formed as a single cylinder. By mounting the foam discharge cap 200 to the mouth and neck part 13, the opening of the mouth and neck part 13 is closed by the foam discharge cap 200.

The cap member 110 includes: an annular closing part 112 closing an upper end part of the mounting part 111; and an upright cylinder part 113 that is formed in a cylindrical shape having a smaller diameter than that of the mounting part 111 and stands upward from a center part of the annular closing part 112.

The cylinder member 120 includes: a cylindrical gas cylinder component 121 fixed to a lower surface side of the annular closing part 112 of the cap member 110; a cylindrical liquid cylinder component 122 having a smaller diameter than that of the gas cylinder component 121; and an annular connection part 123. The annular connection part 123 mutually connects a lower end part of the gas cylinder component 121 and an upper end part of the liquid cylinder component 122, and the liquid cylinder component 122 is suspended from the annular connection part 123.

The gas cylinder component 121, the liquid cylinder component 122, the mounting part 111, and the upright cylinder part 113 are arranged coaxially with each other.

An upper end part of the gas cylinder component 121 is fixed to the annular closing part 112 by, for example, fitting to the lower surface side of the annular closing part 112.

A cylinder (gas cylinder) of the gas pump includes the gas cylinder component 121 and the annular connection part 123.

A piston of the gas pump includes a gas piston 150 described later.

Hereinafter, a portion between the gas piston 150 and the annular connection part 123 in an internal space of the gas cylinder component 121 is referred to as a gas pump chamber 210.

A volume of the gas pump chamber 210 expands and contracts with vertical movement of the gas piston 150.

Whereas, the cylinder (liquid cylinder) of the liquid pump is provided with the liquid cylinder component 122.

A piston of the liquid pump includes a liquid piston 140 described later.

A liquid pump chamber 220 is a space between a liquid discharge valve and a liquid suction valve, which will be described later. A volume of the liquid pump chamber 220 expands and contracts with vertical movement of the liquid piston 140 and a piston guide 130 described later.

The liquid cylinder (liquid supply unit) is configured to pressurize the liquid 101 inside to supply the liquid 101 to the foamer mechanism 20.

The gas cylinder (gas supply unit) is arranged around the liquid cylinder, and is configured to pressurize a gas inside to supply the gas to the foamer mechanism 20.

More specifically, the foam discharger 100 includes the head member 30 that is held by the mounting part 111 so as to be vertically movable with respect to the mounting part 111, and is pushed down relatively to the mounting part 111, and the foamer mechanism 20, a discharge port 41, and the foam flow path 90 are held by the head member 30.

Then, when the head member 30 is pushed down relatively to the mounting part 111, the liquid 101 inside the liquid supply unit (inside the liquid pump chamber 220) and the gas inside the gas supply unit (inside the gas pump chamber 210) are to be individually pressurized and supplied to the foamer mechanism 20.

The liquid cylinder component 122 includes a straight part 122*a* having a straight shape extending vertically, and a reduced diameter part 122*b* connected to a lower part of the straight part 122*a* and reduced in diameter downward.

On an inner periphery of a lower end part of the straight part 122*a*, there is formed a spring receiving part 126*a* that receives a lower end of a coil spring 170. The spring receiving part 126*a* includes an upper end surface of a plurality of ribs 126 formed at a predetermined angular interval such as an equal angular interval on an inner periphery of a lower end part of the liquid cylinder component 122.

A lower part of an inner peripheral surface of the reduced diameter part 122*b* constitutes a valve seat 127 with which a valve body 162 constituted by a lower end part of a poppet 160 described later can come into liquid-tight contact.

Further, the cylinder member 120 includes a cylindrical tube holding part 125 connected below the liquid cylinder component 122. By inserting an upper end part of a dip tube 128 into the tube holding part 125, the dip tube 128 is held by a lower end part of the cylinder member 120. The dip tube 128 enables the liquid 101 in the storage container 10 to be sucked into the liquid pump chamber 220.

An upper end part of the cylinder member 120 is externally fitted with a packing 190. When the packing 190 is circumferentially in airtight contact with the upper end of the mouth and neck part 13 in a state where the cap member 110 is mounted to the storage container 10 by screwing, an internal space of the storage container 10 is to be hermetically sealed.

Further, the gas cylinder component 121 is formed with a through hole 129 penetrating the inside and outside of the gas cylinder component 121. In a state where the head member 30 is located at a top dead center, the through hole 129 is closed by an outer peripheral ring part 153 of the gas piston 150 described later.

The head member 30 has the operation receiving part 31 that receives a pushing operation, and has a double cylindrical part, that is, an inner cylinder part 32 and an outer cylinder part 33, suspended downward from the operation receiving part 31. Upper ends of the inner cylinder part 32 and the outer cylinder part 33 are closed by the operation receiving part 31.

The inner cylinder part 32 extends downward longer than the outer cylinder part 33. The inner cylinder part 32 is inserted into the upright cylinder part 113 of the cap member 110.

The inner cylinder part 32 is indirectly held by the mounting part 111 (indirectly via the cylinder member 120, the coil spring 170, and the like).

The head member 30 can be subjected to a pushing operation in a range from the top dead center to a bottom dead center against energization of the coil spring 170, and returns to the top dead center in accordance with the energization of the coil spring 170 when the pushing operation is released.

The head member 30 vertically moves relatively to the cap member 110. At the time of this vertical movement, the inner cylinder part 32 is guided by the upright cylinder part 113. An inner diameter of the outer cylinder part 33 is set to be larger than an outer diameter of the upright cylinder part 113. When the head member 30 is pushed down, the upright cylinder part 113 is housed in a gap between the outer cylinder part 33 and the inner cylinder part 32.

Further, the head member 30 has a nozzle part 40 integrally. The nozzle part 40 projects horizontally from the operation receiving part 31. An internal space of the nozzle part 40 communicates with an internal space of the inner cylinder part 32 at an upper end part of the inner cylinder part 32. The discharge port 41 is formed at a tip of the nozzle part 40.

In a normal state where the head member 30 is not pushed down (normal state), an action of the coil spring 170 maintains a vertical position of the head member 30, with respect to the cap member 110 and the cylinder member 120, at an upper limit position (top dead center) (FIG. 5). This upper limit position is, for example, a position where an upper end of a piston part 152 of the gas piston 150 described later abuts on the annular closing part 112 of the cylinder member 120.

Whereas, when a user performs an operation of pushing down the head member 30 against energization of the coil spring 170, the head member 30 descends relatively to the cap member 110 and the cylinder member 120. A lower limit position (bottom dead center) of the head member 30 is, for example, a position at which a lower end of a flange part 133 of the piston guide 130 described later abuts on the annular connection part 123 of the cylinder member 120.

Here, the foamer mechanism 20 is housed in the inner cylinder part 32 of the head member 30, and is held by the inner cylinder part 32. The head member 30 is held by the mounting part 111 indirectly via the cylinder member 120, the coil spring 170, the liquid piston 140, and the piston guide 130. Further, the head member 30 includes the discharge port 41.

As described above, the foam discharger 100 includes the storage container 10 that stores the liquid 101, and the mounting part 111 that is mounted to the storage container 10, and the mounting part 111 that holds the foamer mechanism 20, the discharge port 41, and the foam flow path 90.

The foam discharge cap 200 further includes the piston guide 130, the liquid piston 140, the gas piston 150, a suction valve member 155, the poppet 160, the coil spring 170, and a ball valve 180.

Among them, the piston guide 130 is fixed to the head member 30, and the liquid piston 140 is fixed to the head member 30 via the piston guide 130. Therefore, the head member 30, the piston guide 130, and the liquid piston 140 vertically move integrally.

Further, the gas piston 150 is externally fitted to the piston guide 130 in a loosely inserted state, and is vertically movable relative to the piston guide 130. The suction valve member 155 is fixed to the gas piston 150.

The poppet 160 is inserted into the liquid piston 140, and can vertically move relatively to the liquid piston 140.

The coil spring 170 is externally fitted with the poppet 160 in a loosely inserted state.

The ball valve 180 is held to be vertically movable, between a valve seat part 131 described later and a lower end of a projection 811*a* (FIG. 6) of a first member 810 described later.

The piston guide 130 is formed in a vertically long cylindrical shape (circular tubular shape), and an upper end part of the piston guide 130 is inserted into a lower end part of the inner cylinder part 32 of the head member 30, and fixed to the inner cylinder part 32. The piston guide 130 is suspended downward from a lower end of the inner cylinder part 32 of the head member 30.

Inside the upper end part of the piston guide 130, the cylindrical valve seat part 131 is formed, and the ball valve 180 is disposed on the valve seat part 131. The ball valve 180 and the valve seat part 131 constitute the liquid discharge valve. An internal space of a portion above the valve seat part 131 in the piston guide 130 constitutes a housing space 132 that houses the ball valve 180, and a first portion 811 and a second portion 812 of the first member 810. The housing space 132 communicates with an internal space (that is, the liquid pump chamber 220) of the piston guide 130 below the valve seat part 131, through a through hole 131*a* formed at a center of the valve seat part 131.

The flange part 133 is formed at a center part in a vertical direction of the piston guide 130, and an annular valve forming groove 134 is formed on an upper surface of the flange part 133.

An upper part of the piston guide 130 is externally fitted with a cylindrical part 151 of the gas piston 150 in a loosely inserted state. The upper part of the piston guide 130 mentioned here is a portion above the flange part 133 of the piston guide 130, and below a portion that is inserted and fixed to the inner cylinder part 32, in the piston guide 130.

The valve forming groove 134 on the upper surface of the flange part 133 and a lower end part of the cylindrical part 151 of the gas piston 150 constitute a gas discharge valve.

Further, a plurality of flow path forming grooves 135 (FIG. 10) each extending vertically are formed on an outer peripheral surface of a portion of where the cylindrical part 151 is externally fitted in the piston guide 130. A gap between the flow path forming groove 135 and an inner peripheral surface of the cylindrical part 151 of the gas piston 150 constitutes a flow path 211 (FIG. 10) through which a gas flowing out of the gas pump chamber 210 via the gas discharge valve passes.

An outer diameter dimension of a portion of the piston guide 130 below the flange part 133 is set to be slightly smaller than an inner diameter dimension of the straight part 122*a* of the liquid cylinder component 122, and this portion is guided by the straight part 122*a* when the piston guide 130 moves vertically.

On an inner peripheral surface of a portion of the piston guide 130 below the valve seat part 131 (however, a portion above a portion where the liquid piston 140 is inserted and fixed (for example, press-fitted and fixed)), a plurality of ribs 136 each extending vertically are formed. These ribs 136 can come into contact with the poppet 160 in a pressure-contact state.

The liquid piston 140 is formed in a cylindrical shape (circular tubular shape). At a lower end part of the liquid piston 140, an outer peripheral piston part 141 of a shape protruding radially outward is formed.

A portion of the liquid piston 140 above the outer peripheral piston part 141 is inserted and fixed (for example, press-fitted and fixed) to a lower end part of the piston guide 130.

Further, the outer peripheral piston part 141 of the liquid piston 140 is inserted into the straight part 122*a* of the liquid cylinder component 122. An outer diameter dimension of the outer peripheral piston part 141 is set to be equal to an inner diameter dimension of the straight part 122*a*. The outer peripheral piston part 141 is circumferentially in liquid-tight contact with an inner peripheral surface of the straight part 122*a*, and slides with respect to the inner peripheral surface of the straight part 122*a* when the outer peripheral piston part 141 moves vertically.

An inner peripheral surface of the outer peripheral piston part 141 includes an obliquely stepped spring receiving part 142 that receives an upper end of the coil spring 170.

An upper end part of the liquid piston 140 is a constriction part 143 having an inner diameter smaller than other portions.

The gas piston 150 includes: the cylindrical part 151 that is formed in a cylindrical shape and is externally fitted to the upper part of the piston guide 130 (a portion above the flange part 133) in a loosely inserted state; and the piston part 152 projecting radially outward from the cylindrical part 151.

The cylindrical part 151 is vertically slidable relatively to the upper part of the piston guide 130.

An upper end part of the cylindrical part 151 is inserted into the lower end part of the inner cylinder part 32. A lower end part of the cylindrical part 151 is formed in a shape that can be fitted into the valve forming groove 134 on the upper surface of the flange part 133 of the piston guide 130.

The outer peripheral ring part 153 is formed at a peripheral part of the piston part 152. The outer peripheral ring part 153 is circumferentially in air-tight contact with the inner peripheral surface of the gas cylinder component 121, and slides with respect to the inner peripheral surface of the gas cylinder component 121 when the gas piston 150 moves vertically.

A lower limit position of the relative movement (vertical movement) of the cylindrical part 151 with respect to the piston guide 130 is a position where the lower end part of the cylindrical part 151 abuts against the valve forming groove 134 to cause the gas discharge valve to be closed.

Whereas, an inner peripheral surface at the lower end part of the inner cylinder part 32 includes an upward movement regulating part 32*a* that regulates ascending of the cylindrical part 151 relative to the piston guide 130 and the inner cylinder part 32. That is, an upper limit position of the relative movement (vertical movement) of the cylindrical part 151 with respect to the piston guide 130 is a position where movement of the upper end part of the cylindrical part 151 is regulated by the upward movement regulating part 32*a*, after the gas discharge valve is opened when the lower end part of the cylindrical part 151 is separated from the valve forming groove 134.

In a portion of the piston part 152 near the cylindrical part 151, a plurality of suction openings 154 penetrating vertically through the piston part 152 are formed.

To a lower part of the cylindrical part 151 of the gas piston 150, the annular suction valve member 155 is externally fitted. The suction valve member 155 has a valve body that is an annular film protruding radially outward.

The valve body of the suction valve member 155 and a lower surface of the piston part 152 constitute a gas suction valve.

When the head member 30 is pushed down, that is, when the gas pump chamber 210 contracts, the valve body of the suction valve member 155 comes into close contact with the lower surface of the piston part 152, causing the suction opening 154 to be closed from below.

Whereas, when the head member 30 ascends, that is, when the gas pump chamber 210 expands, the valve body of the suction valve member 155 is separated from the lower surface of the piston part 152, causing outside air to be taken into the gas pump chamber 210 through the suction opening 154.

The poppet 160 is a vertically elongated rod-shaped member, and is inserted through from the inside of the piston guide 130 to the inside of the liquid cylinder component 122 while penetrating the liquid piston 140.

An upper end part 161 of the poppet 160 is formed to have a larger diameter than that of an intermediate part in a vertical direction of the poppet 160, and is to come into contact with the plurality of ribs 136 of the piston guide 130 in a pressure contact state. The upper end part 161 of the poppet 160 is formed to have a larger diameter than that of an inner diameter of the constriction part 143 of the liquid piston 140, and downward movement is regulated by the constriction part 143.

A lower end part of the poppet 160 constitutes the valve body 162. The valve body 162 is formed to have a larger diameter than that of an intermediate part in the vertical direction of the poppet 160. A lower surface of the valve body 162 includes a conical portion that can be in liquid-tight contact with the valve seat 127 of the cylinder member 120. The valve body 162 and the valve seat 127 constitute the liquid suction valve. At an upper end part of the valve body 162, there is formed a spring receiving part 162*a* that receives downward energization from the coil spring 170.

The coil spring 170 is externally fitted to the intermediate part of the poppet 160 in a loosely inserted state. The coil spring 170 is a compression coil spring, and is held between the spring receiving part 126*a* of the cylinder member 120 and the spring receiving part 142 of the liquid piston 140 in a compressed state. Therefore, the coil spring 170 obtains a reaction force from the cylinder member 120, to upwardly energize the liquid piston 140, the piston guide 130, and the head member 30.

Further, the lower end of the coil spring 170 downwardly energizes not only the spring receiving part 126*a* but also the spring receiving part 162*a* of the poppet 160.

Here, shapes and dimensions of the poppet 160 and the cylinder member 120 are set such that the poppet 160 can move slightly below a position where a height position of the spring receiving part 162*a* is aligned with a height position of the spring receiving part 126*a* of the cylinder member 120. Then, when the head member 30 is pushed down to cause the piston guide 130 to descend, the lower surface of the valve body 162 of the poppet 160 comes into liquid-tight contact with the valve seat 127 of the cylinder member 120 by the poppet 160 following the piston guide 130 with friction between the plurality of ribs 136 of the piston guide 130 and the upper end part 161 of the poppet 160. At this time, the spring receiving part 162*a* separates from the lower end of the coil spring 170 and descends. Thereafter, when the head member 30, the piston guide 130, and the liquid piston 140 further descend integrally after the lower surface of the valve body 162 comes into close contact with the valve seat 127, the descending of the valve body 162 is regulated by the valve seat 127. Therefore, the piston guide 130 descends relatively to the poppet 160 while the plurality of ribs 136 of the piston guide 130 frictionally slide with respect to the upper end part 161 of the poppet 160.

Whereas, when the pushing operation on the head member 30 is released, and the liquid piston 140, the piston guide 130, and the head member 30 integrally ascend in accordance with energization of the coil spring 170, first, the poppet 160 ascends following the piston guide 130 until the spring receiving part 162*a* abuts on the lower end of the coil spring 170. This causes separation of the valve body 162 and the valve seat 127. Thereafter, the liquid piston 140, the piston guide 130, and the head member 30 integrally ascend continuously in accordance with energization of the coil spring 170. At this time, since ascending of the poppet 160 is regulated by the coil spring 170, the piston guide 130 ascends relatively to the poppet 160 as the upper end part 161 of the poppet 160 frictionally slides with respect to the plurality of ribs 136 of the piston guide 130.

In this way, the valve body 162 of the poppet 160 is allowed to slightly move vertically in a gap between the lower end of the coil spring 170 and the valve seat 127, and the liquid suction valve at the lower end part of the liquid pump chamber 220 opens and closes as the valve body 162 moves vertically.

Here, supply paths of a gas and the liquid 101 from the gas pump chamber 210 and the liquid pump chamber 220 to the foamer mechanism 20 will be individually described.

When the head member 30 is pushed down, the liquid pump chamber 220 contracts. At this time, when the liquid 101 in the liquid pump chamber 220 is pressurized, the liquid discharge valve including the ball valve 180 and the valve seat part 131 opens, the liquid 101 in the liquid pump chamber 220 flows into the housing space 132 via the liquid discharge valve, and supplied into a hole 815 of the first member 810 arranged in an upper part of the housing space 132, that is, an adjacent liquid flow path 51 (FIGS. 6 and 9) (described later) of a liquid flow path 50 of the foamer mechanism 20.

Figure 6:
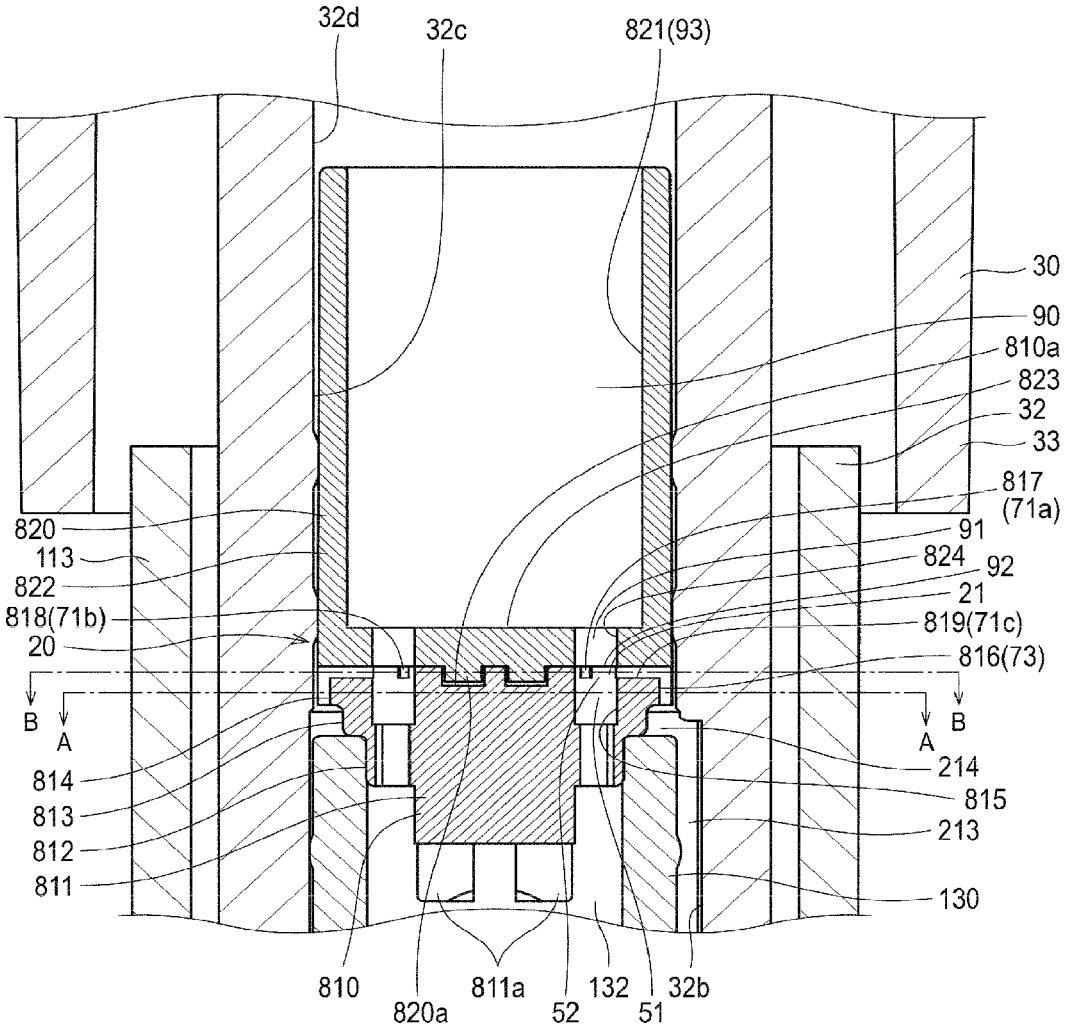
FIG. 6 is a partially enlarged view of FIG. 5.
Figure 9:
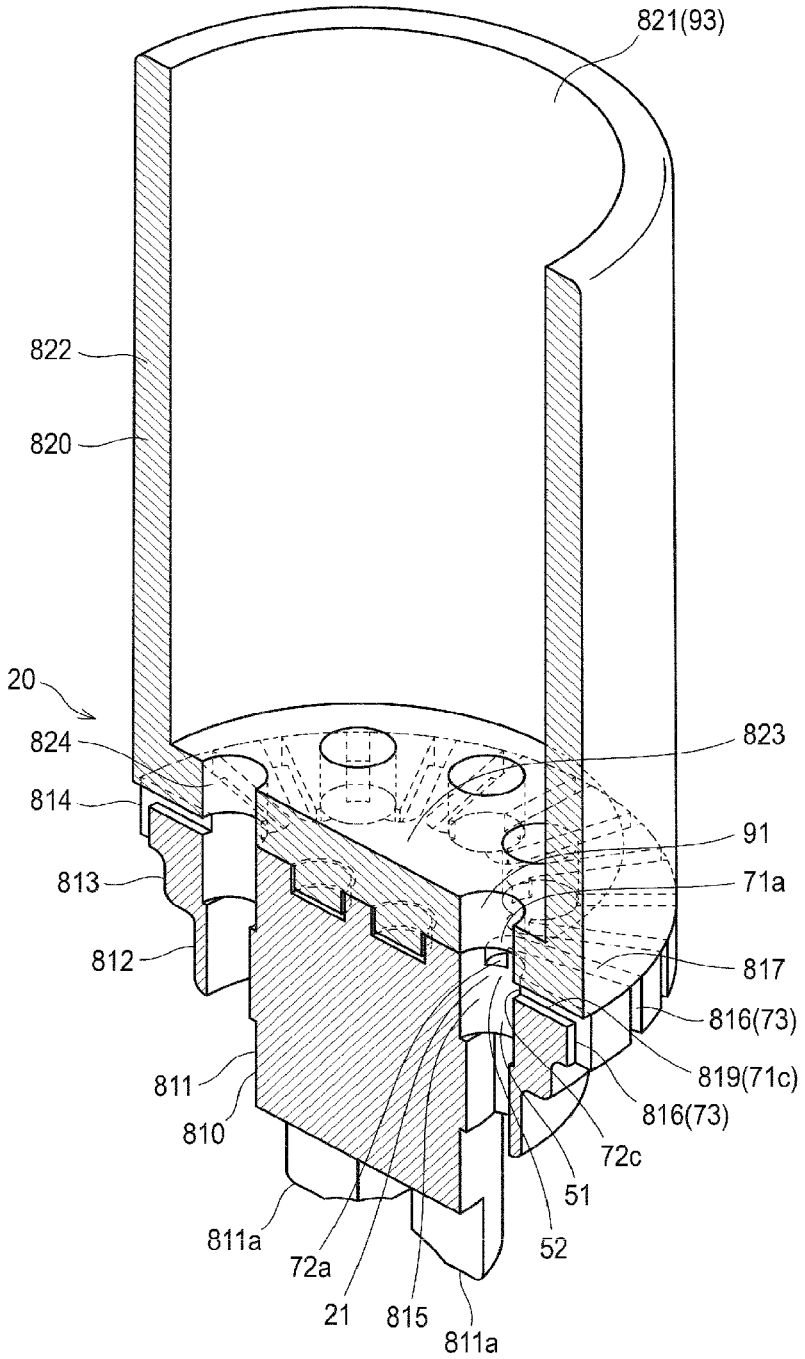
FIG. 9 is a perspective cross-sectional view taken along line A-A in FIG. 8.
Figure 10:
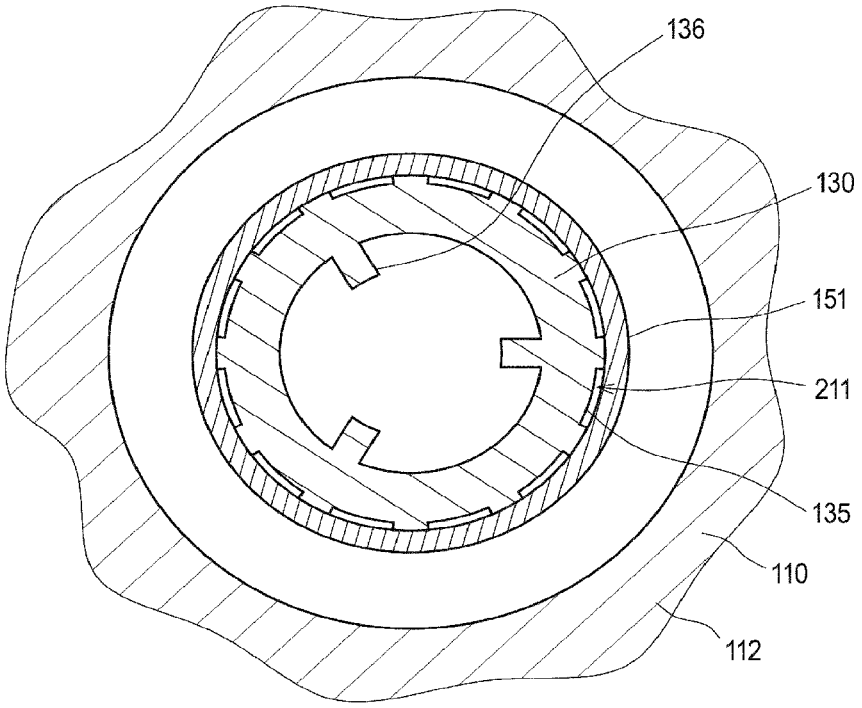
FIG. 10 is a cross-sectional view taken along line A-A in FIGS. 5 and 14.

While details will be described later, the liquid 101 is supplied from the adjacent liquid flow path 51 to the mixing part 21 (FIGS. 6 and 9).

Further, the gas pump chamber 210 also contracts when the head member 30 is pushed down. At this time, the gas in the gas pump chamber 210 is pressurized, and the gas piston 150 ascends slightly with respect to the piston guide 130. This causes the gas discharge valve including the lower end part of the cylindrical part 151 and the valve forming groove 134 to open, and the gas in the gas pump chamber 210 to be sent upward through the gas discharge valve and the flow path 211 (FIG. 10) between the cylindrical part 151 and the piston guide 130.

Above the cylindrical part 151 of the gas piston 150, there is disposed a cylindrical gas flow path 212 (FIG. 5) constituted by a gap between an inner peripheral surface of the lower end part of the inner cylinder part 32 and an outer peripheral surface of the piston guide 130. An upper end of the flow path 211 communicates with a lower end of the cylindrical gas flow path 212.

Further, above the cylindrical gas flow path 212, a plurality of axial flow paths 213 (FIG. 5) each extending vertically are formed intermittently around the upper end part of the piston guide 130. In the case of the present embodiment, three axial flow paths 213 are arranged at equal angular intervals. More specifically, for example, three grooves 32*b* (FIGS. 5 and 6) extending vertically are formed on the inner peripheral surface of the lower end part of the inner cylinder part 32, and a gap between the three grooves 32*b* and an outer peripheral surface of the upper end part of the piston guide 130 constitute the axial flow path 213. The cylindrical gas flow path 212 communicates with each axial flow path 213.

Above the axial flow path 213, there is provided a circular flow path 214 (FIG. 6) arranged circumferentially around a third portion 813 (described later) of the first member 810. An upper end part of the axial flow path 213 communicates with the circular flow path 214.

Above the circular flow path 214, there are arranged a plurality of axial gas flow paths 73 (FIG. 6) extending vertically along an outer peripheral surface of a fourth portion 814 (described later) of the first member 810. The circular flow path 214 communicates with lower end parts of the axial gas flow paths 73.

Figure 12:
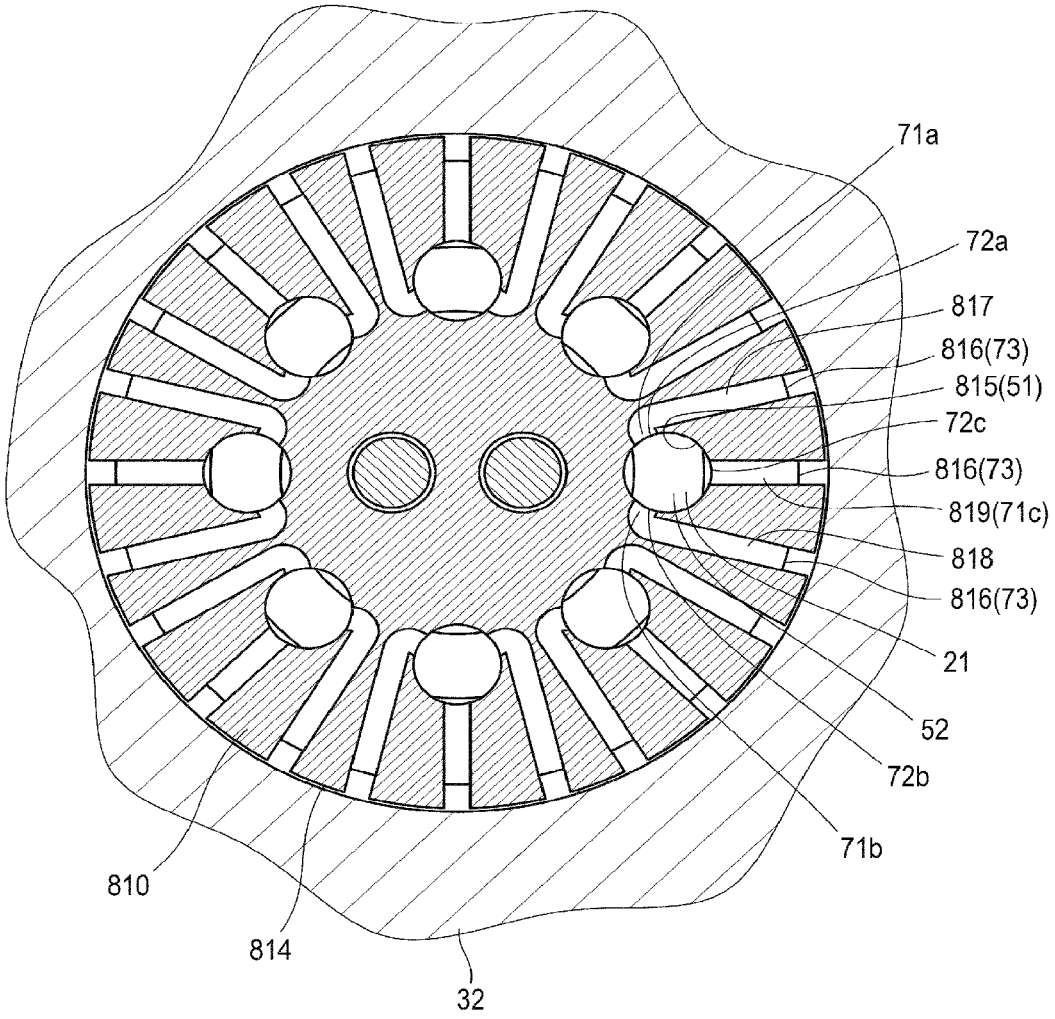
FIG. 12 is a cross-sectional view taken along line B-B in FIG. 6.

While the details will be described later, a gas is supplied from the axial gas flow path 73 to adjacent gas flow paths 71*a*, 71*b*, and 71*c* (FIGS. 6, 9, and 12).

Thus, the gas sent upward through the flow path 211 passes through the cylindrical gas flow path 212, the axial flow path 213, the circular flow path 214, and the axial gas flow path 73 in this order, is supplied to the adjacent gas flow path 71, and is supplied to the mixing part 21 from the adjacent gas flow path 71.

Further, an adjacent foam flow path 91 (FIG. 6) is arranged above the mixing part 21, and an enlarged foam flow path 93 (FIG. 6) is arranged above the adjacent foam flow path 91.

A component configuration for realizing the foamer mechanism 20 is not particularly limited, but as an example, the first member 810 (FIGS. 7A and 7B) and a second member 820 (FIGS. 6 and 9) described below are combined to constitute the foamer mechanism 20.

The first member 810 includes the first portion 811, the second portion 812, the third portion 813, and the fourth portion 814 each formed in a columnar shape. The second portion 812 is connected above the first portion 811, the third portion 813 is connected above of the second portion 812, and the fourth portion 814 is connected above the third portion 813. The second portion 812 is formed with a larger diameter than that of the first portion 811, the third portion 813 is formed with a larger diameter than that of the second portion 812, and the fourth portion 814 is formed with a larger diameter than that of the third portion 813. The first portion 811, the second portion 812, the third portion 813, and the fourth portion 814 are arranged coaxially with each other, and have the axes extending vertically. The first member 810 further includes a plurality of (for example, four) projections 811*a* projecting downward from the first portion 811.

Figure 7A:
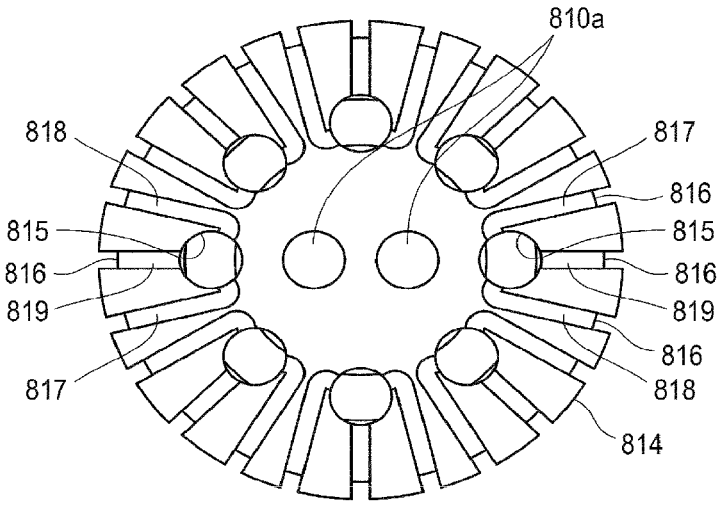
Figure 7B:
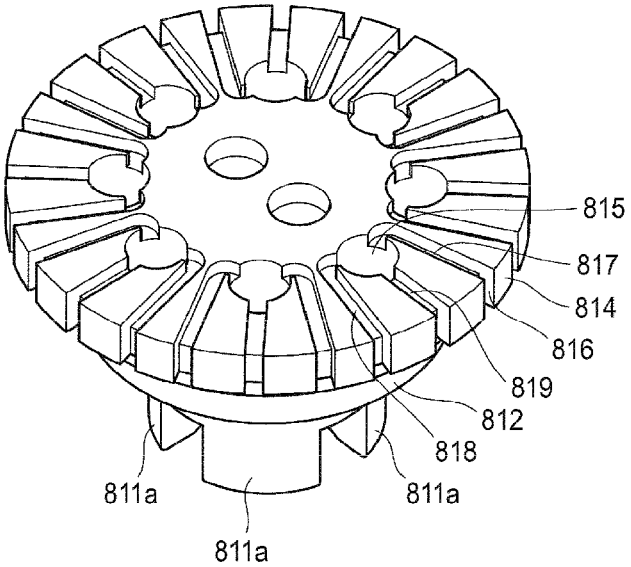

In the second portion 812, the third portion 813, and the fourth portion 814, a portion located on a radially outer side of the first portion 811 is formed with a plurality of holes 815 penetrating vertically through the second portion 812, the third portion 813, and the fourth portion 814. These holes 815 are intermittently arranged in a circumferential direction of the first member 810. More specifically, for example, eight holes 815 are arranged at equal angular intervals (FIG. 7A). An inner cavity cross-sectional area of these holes 815 is, for example, relatively large in a lower part and relatively small in an upper part. An internal space in the upper part of these holes 815 is formed, for example, in a columnar shape. The holes 815 each are formed, for example, in a same size.

On an outer peripheral surface of the fourth portion 814, there are formed a plurality of (for example, 24) axial gas grooves 816 intermittently arranged in a circumferential direction of the fourth portion 814. Each axial gas groove 816 extends vertically, and is formed from a lower end to an upper end of the fourth portion 814 (FIG. 7A).

The individual axial gas grooves 816 are formed, for example, entirely at a constant depth and width. The axial gas grooves 816 each are formed, for example, at the same depth and width as each other.

In the case of the present embodiment, a cross-sectional shape of the axial gas groove 816 orthogonal to an axial direction of each axial gas groove 816 is square. However, in the present invention, the cross-sectional shape of each axial gas groove 816 is not limited to this example.

On an upper surface of the fourth portion 814, there are formed a plurality of (for example, eight) first upper surface grooves 817 intermittently arranged in the circumferential direction of the fourth portion 814, a plurality of (for example, eight) second upper surface grooves 818 intermittently arranged in the circumferential direction of the fourth portion 814, and a plurality of (for example, eight) third upper surface grooves 819 intermittently arranged in the circumferential direction of the fourth portion 814.

In plan view, the first upper surface groove 817, the third upper surface groove 819, and the second upper surface groove 818 are repeatedly arranged clockwise in this order.

Each first upper surface groove 817 corresponds to each hole 815 corresponds in one-to-one relationship. Each second upper surface groove 818 corresponds to each hole 815 in one-to-one relationship. Each third upper surface groove 819 corresponds to each hole 815 in one-to-one relationship.

Each first upper surface groove 817 is formed in an L shape on the upper surface of the fourth portion 814. On the upper surface of the fourth portion 814, each first upper surface groove 817 extends from a radially outer end part toward a radially inner side to the vicinity of the corresponding hole 815, and is bent to reach the corresponding hole 815.

Each second upper surface groove 818 is formed in an inverted L-shape on the upper surface of the fourth portion 814. On the upper surface of the fourth portion 814, each second upper surface groove 818 extends from a radially outer end part toward a radially inner side to the vicinity of the corresponding hole 815, and is bent to reach the corresponding hole 815. A direction in which the first upper surface groove 817 is bent and a direction in which the second upper surface groove 818 is bent are opposite to each other.

Each third upper surface groove 819 linearly extends from a radially outer end part toward a radially inner side on the upper surface of the fourth portion 814. An inner peripheral end part of each third upper surface groove 819 reaches the corresponding hole 815.

Each axial gas groove 816 corresponds in one-to-one relationship with any one of the plurality of first upper surface grooves 817, the plurality of third upper surface grooves 819, or the plurality of second upper surface grooves 818. An upper end part of the axial gas groove 816 corresponding in one-to-one relationship with the plurality of first upper surface grooves 817 is connected to an outer peripheral end part of the corresponding first upper surface groove 817. An upper end part of the axial gas groove 816 corresponding in one-to-one relationship with the plurality of second upper surface grooves 818 is connected to an outer peripheral end part of the corresponding second upper surface groove 818. An upper end part of the axial gas groove 816 corresponding in one-to-one relationship with the plurality of third upper surface grooves 819 is connected to an outer peripheral end part of the corresponding third upper surface groove 819.

Individual first upper surface grooves 817 are formed, for example, entirely at a constant depth and width. The first upper surface grooves 817 each are formed, for example, at the same depth and width as each other.

The individual second upper surface grooves 818 are formed, for example, entirely at a constant depth and width. The second upper surface grooves 818 each are formed, for example, at the same depth and width as each other.

Individual third upper surface grooves 819 are formed, for example, entirely at a constant depth and width. The third upper surface grooves 819 each are formed, for example, at the same depth and width as each other.

Further, the axial gas groove 816, the first upper surface groove 817, the second upper surface groove 818, and the third upper surface groove 819 are formed, for example, at the same depth and width as each other.

In the case of the present embodiment, a cross-sectional shape of the first upper surface groove 817 orthogonal to an axial direction of each first upper surface groove 817, a cross-sectional shape of the second upper surface groove 818 orthogonal to an axial direction of each second upper surface groove 818, and a cross-sectional shape of each third upper surface groove 819 orthogonal to an axial direction of each third upper surface groove 819 is a square. However, in the present invention, the cross-sectional shapes of each first upper surface groove 817, each second upper surface groove 818, and each third upper surface groove 819 are not limited to this example.

On the upper surface of the fourth portion 814, for example, a pair of recesses 810*a* are formed.

Figure 8:
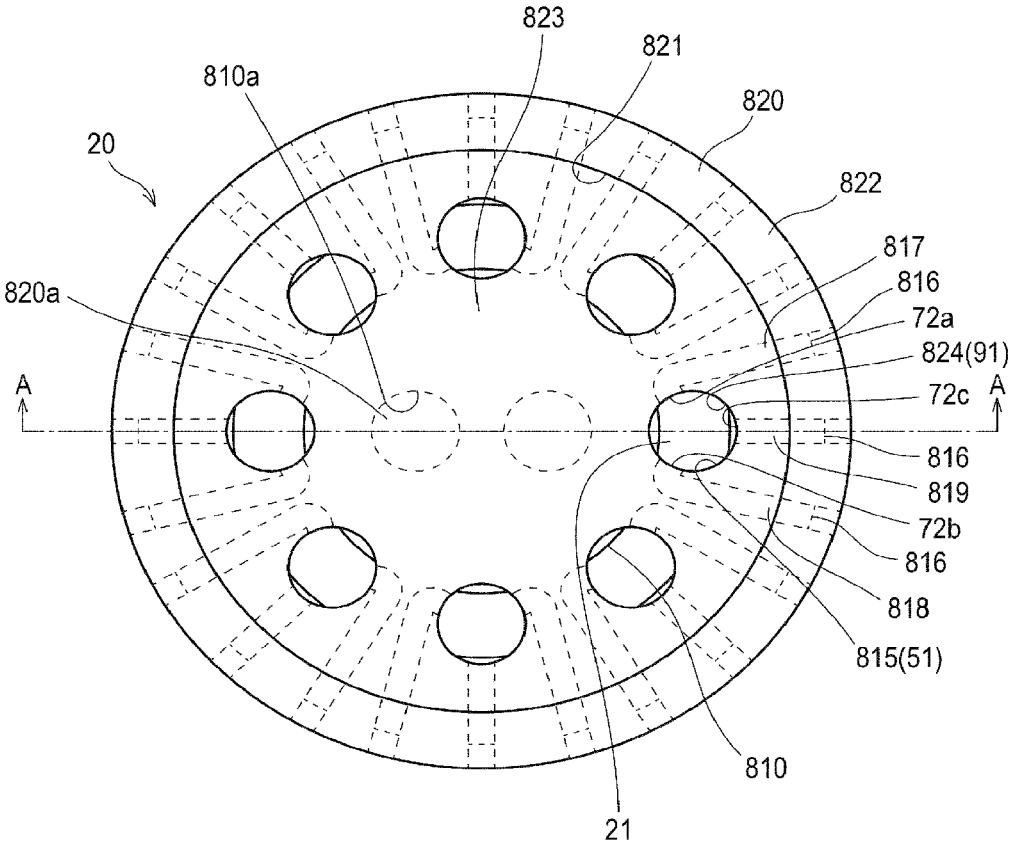
FIG. 8 is a plan view showing a state in which the first member and a second member included in the foamer mechanism of the foam discharger according to the second embodiment are assembled.

As shown in FIGS. 6, 8, and 9, the second member 820 includes, for example, a cylinder part 822 having a cylindrical shape, and a flat plate part 823 closing a lower end of the cylinder part 822.

An axial direction of the cylinder part 822 extends vertically. The plate part 823 is arranged horizontally. Outer diameters of the cylinder part 822 and the plate part 823 are substantially equal to an outer diameter of the fourth portion 814 of the first member 810.

The plate part 823 is formed with a plurality of holes 824 penetrating vertically through the plate part 823. These holes 824 are intermittently arranged in a circumferential direction of the plate part 823. More specifically, for example, eight holes 824 are arranged at equal angular intervals. An internal space of the hole 824 is formed, for example, in a columnar shape. The holes 824 each are formed, for example, with a same inner diameter.

The second member 820 has, for example, a pair of protrusions 820*a* protruding downward from the plate part 823. Each protrusion 820*a* is provided at a position corresponding to each recess 810*a* of the first member 810.

As shown in FIGS. 6 and 9, by fitting each protrusion 820*a* of the second member 820 into each recess 810*a* of the first member 810, the first member 810 and the second member 820 are assembled with each other. A lower surface of the plate part 823 of the second member 820 and the upper surface of the fourth portion 814 of the first member 810 are in surface contact and in airtight contact with each other.

Here, the hole 815 of the first member 810 and the hole 824 of the second member 820 correspond in one-to-one relationship. Further, the corresponding hole 824 is disposed immediately above each hole 815.

For example, the upper part of the hole 815 and the hole 824 have the same inner diameter and are coaxial with each other.

As shown in FIG. 6, inside the inner cylinder part 32, there is formed a holding part 32*c* that houses and holds the third portion 813 and the fourth portion 814 of the first member 810 and the second member 820. An internal space of the holding part 32*c* is a columnar space. In a state where the first member 810 and the second member 820 are mutually assembled, the third portion 813 and the fourth portion 814 of the first member 810 and the second member 820 are fitted and fixed to the holding part 32*c*.

The second portion 812 of the first member 810 is fitted and fixed to the upper end part of the piston guide 130. An outer peripheral surface of the second portion 812 is circumferentially in airtight contact with an inner peripheral surface of the upper end part of the piston guide 130.

The first portion 811 of the first member 810 is inserted into the upper end part of the piston guide 130. The projection 811*a* of the first portion 811 of the first member 810 is arranged inside the housing space 132.

Between the outer peripheral surface of the third portion 813 of the first member 810 and an inner peripheral surface of the holding part 32*c*, the circular flow path 214 is formed.

Figure 11:
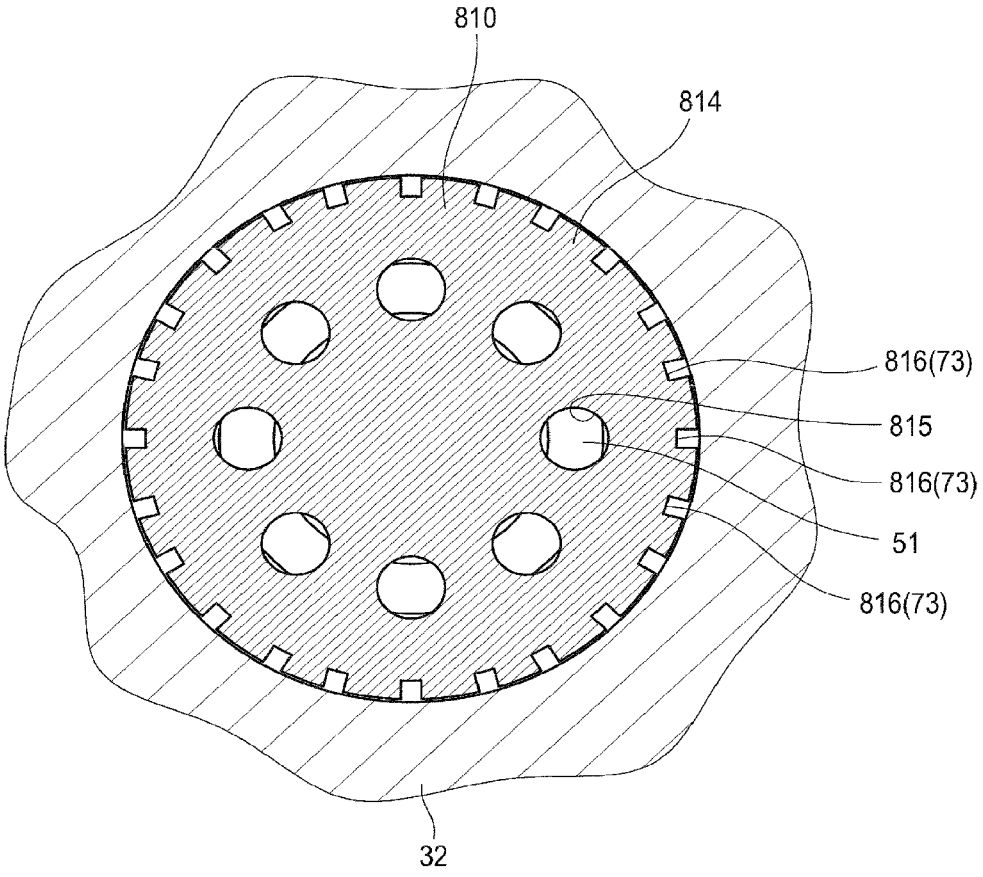
FIG. 11 is a cross-sectional view taken along line A-A in FIG. 6.

As shown in FIG. 11, between each axial gas groove 816 on the outer peripheral surface of the fourth portion 814 of the first member 810 and the inner peripheral surface of the holding part 32*c*, the axial gas flow path 73 extending vertically is formed (FIG. 11).

An upper end part of an internal space of each hole 815 of the first member 810 constitutes the mixing part 21. That is, in the case of the present embodiment, the foamer mechanism 20 has a total of eight mixing parts 21. These mixing parts 21 are arranged on a same circumference.

The mixing part 21 is, for example, a portion above bottom surfaces of the first upper surface groove 817, the second upper surface groove 818, and the third upper surface groove 819, in the internal space of the hole 815.

In the internal space of each hole 815 of the first member 810, a portion below the mixing part 21 constitutes the adjacent liquid flow path 51.

The axial direction of the adjacent liquid flow path 51 is a vertical direction. Liquid is supplied upward from the adjacent liquid flow path 51 to the mixing part 21.

As shown in FIG. 12, between each first upper surface groove 817 on the upper surface of the fourth portion 814 of the first member 810 and the lower surface of the plate part 823 of the second member 820, the adjacent gas flow path 71*a* is formed.

Between each second upper surface groove 818 on the upper surface of the fourth portion 814 of the first member 810 and the lower surface of the plate part 823 of the second member 820, an adjacent gas flow path 71*b* is formed.

Between each third upper surface groove 819 on the upper surface of the fourth portion 814 of the first member 810 and the lower surface of the plate part 823 of the second member 820, an adjacent gas flow path 71*c* is formed.

The adjacent gas flow path 71*a*, the adjacent gas flow path 71*b*, and the adjacent gas flow path 71*c* each extend horizontally, for example.

As shown in FIGS. 6 and 9, an internal space of each hole 824 of the second member 820 constitutes the adjacent foam flow path 91.

An internal space of a recess 821 of the cylinder part 822 of the second member 820 constitutes the enlarged foam flow path 93.

In the case of the present embodiment, the foamer mechanism 20 has a plurality of (for example, three) adjacent gas flow paths 71, that is, the adjacent gas flow paths 71*a*, 71*b*, and 71*c*, in correspondence to one mixing part 21. That is, the foamer mechanism 20 has, for example, a total of 24 pieces of the adjacent gas flow path 71.

In the case of the present embodiment, the foamer mechanism 20 has one adjacent liquid flow path 51 in correspondence to each mixing part 21.

In the case of the present embodiment, a flow path area of each adjacent gas flow path 71 is smaller than a flow path area of the adjacent liquid flow path 51.

A downstream end of the adjacent gas flow path 71*a*, that is, a connection end of the adjacent gas flow path 71*a* to the mixing part 21 is the gas inlet 72*a*. Similarly, a downstream end of the adjacent gas flow path 71*b* is a gas inlet 72*b*, and a downstream end of the adjacent gas flow path 71*c* is a gas inlet 72*c*.

Figure 13:
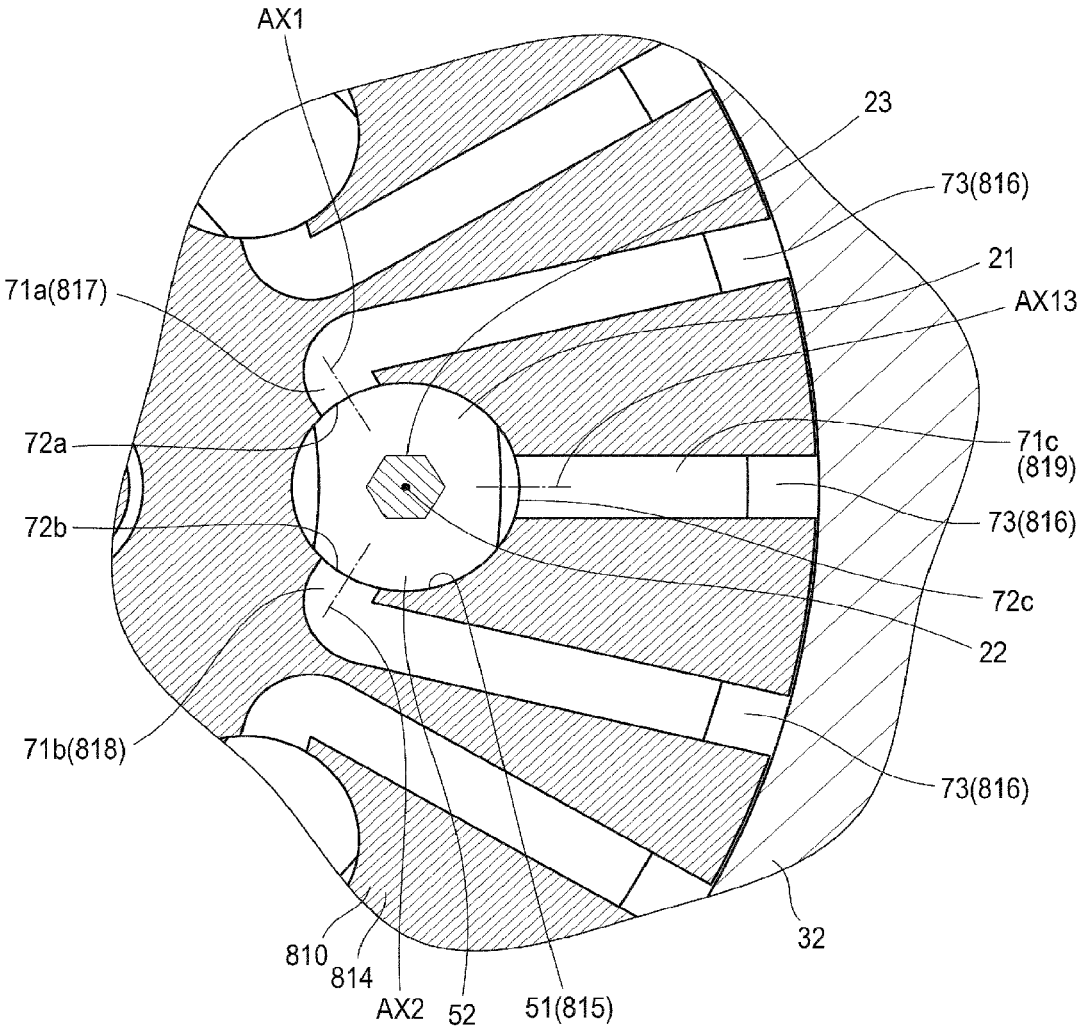
FIG. 13 is a partially enlarged view of FIG. 12.

In the case of the present embodiment, as shown in FIG. 13, a direction of an axis AX1 at the downstream end of the adjacent gas flow path 71*a*, a direction of an axis AX2 at the downstream end of the adjacent gas flow path 71*b*, and a direction of an axis AX13 at the downstream end of the adjacent gas flow path 71*c* are different from each other by 120 degrees, for example. The three gas inlets 72*a*, 72*b*, and 72*c* are arranged at equal angular intervals around the mixing part 21.

As described above, in the case of the present embodiment, the foamer mechanism 20 includes the plurality of mixing parts 21, three adjacent gas flow paths 71 (adjacent gas flow paths 71*a*, 71*b*, and 71*c*) are arranged in correspondence to each mixing part 21, gas supply directions from the three adjacent gas flow paths 71 to the corresponding mixing part 21 are located on a same plane (for example, a horizontal plane), and a liquid supply direction from the adjacent liquid flow path 51 to the mixing part 21 is a direction intersecting (for example, orthogonal to) the plane.

By adopting such a configuration, as compared with a case where a gas is supplied to one mixing part 21 from two adjacent gas flow paths 71, a period at which the liquid column swings at high speed is shortened, resulting in finer foam.

Note that the present invention is not limited to the example in which the foamer mechanism 20 includes a plurality of mixing parts 21. When the number of the mixing parts 21 provided to the foamer mechanism 20 is one, three adjacent gas flow paths 71 may be arranged in correspondence to the mixing part 21, gas supply directions from these three adjacent gas flow paths 71 to the mixing part 21 may be located on a same plane, and a liquid supply direction from the adjacent liquid flow path 51 to the mixing part 21 may be a direction intersecting the plane. Also in this case, similarly, the period at which the liquid column swings at high speed is shortened, resulting in finer foam.

The gas supply directions from three adjacent gas flow paths 71 to one mixing part 21 are preferably at intervals of 120 degrees as in the present embodiment, from the viewpoint of the uniformity of the period at which the liquid swings at high speed.

However, the present invention is not limited to this example, and the gas supply directions to the one mixing part 21 from the three adjacent gas flow paths 71 may be at unequal intervals. As an example, the gas may be individually supplied to the mixing part 21 from two directions facing each other and from one direction orthogonal to the two directions. That is, for example, three adjacent gas flow paths 71 may be arranged in a T shape around one mixing part 21.

As shown in FIG. 13, in the case of the present embodiment, a gas-liquid contact region 23 is an overlapping region of: a region extended from the adjacent gas flow path 71*a* in the direction of the axis AX1 at the downstream end of the adjacent gas flow path 71*a*; a region extended from the adjacent gas flow path 71*b* in the direction of the axis AX2 at the downstream end of the adjacent gas flow path 71*b*; a region extended from the adjacent gas flow path 71*c* in the direction of the axis AX13 at the downstream end of the adjacent gas flow path 71*c*; and a region extended from the adjacent liquid flow path 51 in the axial direction of the adjacent liquid flow path 51. In FIG. 13, the gas-liquid contact region 23 is hatched.

A merging part 22 is located in the middle between the gas inlet 72*a*, the gas inlet 72*b*, and the gas inlet 72*c*.

In the case of the present embodiment, the gas inlet 72*a*, the gas inlet 72*b*, and the gas inlet 72*c* are directed in directions different from each other by 120 degrees. Therefore, the merging part 22 is not a surface but a line extending vertically.

As shown in FIG. 6 and FIG. 9, the adjacent foam flow path 91 is arranged above each mixing part 21, and the adjacent foam flow path 91 extends vertically. That is, the foamer mechanism 20 has a plurality of (for example, eight) adjacent foam flow paths 91. A cross-sectional shape of the adjacent foam flow path 91 is, for example, circular. In the case of the present embodiment, an internal space of the adjacent foam flow path 91 is formed in a columnar shape, and a cross-sectional area of the adjacent foam flow path 91 is constant. However, the adjacent foam flow path 91 may be gradually expanded or reduced (in a tapered shape) toward the enlarged foam flow path 93, or may be expanded or reduced step by step.

In the case of the present embodiment, the axial direction of the adjacent liquid flow path 51 and the axial direction of the adjacent foam flow path 91 are coaxially arranged.

Here, a description will be made on a preferred dimensional relationship when the cross-sectional shape of the adjacent liquid flow path 51 and the cross-sectional shape of the mixing part 21 are circular, and the cross-sectional shape of the adjacent foam flow path 91 is also circular, as in the present embodiment. In this case, it is preferable that a diameter of the adjacent foam flow path 91 is the same as a diameter of the mixing part 21 or smaller than the diameter of the mixing part 21. The diameter of the adjacent foam flow path 91 is preferably the same as a diameter of the adjacent liquid flow path 51 or smaller than the diameter of the adjacent liquid flow path 51.

In addition, when the cross-sectional shape of the adjacent foam flow path 91 is circular, but the cross-sectional shape of the adjacent liquid flow path 51 and the cross-sectional shape of the mixing part 21 are square, the diameter of the adjacent foam flow path 91 is preferably the same as a length of one side in the cross-sectional shape of the mixing part 21 or smaller than the length of one side, and preferably the same as a length of one side of the cross-sectional shape of the adjacent liquid flow path 51 or shorter than the length of one side.

In the case of the present embodiment, dimensions of the gas inlets 72*a*, 72*b*, and 72*c* and a dimension of the mixing part 21 are equal to each other in an axial direction (vertical direction) of the adjacent liquid flow path 51 and the adjacent foam flow path 91. Further, in the axial direction of the adjacent liquid flow path 51 and the adjacent foam flow path 91, positions of the gas inlets 72*a*, 72*b*, and 72*c* and a position of the mixing part 21 coincide each other.

However, in a direction around the axis of the adjacent liquid flow path 51 and the adjacent foam flow path 91, a wall surface defining the mixing part 21 is present around (on both sides of) the gas inlets 72*a*, 72*b*, and 72*c*.

Therefore, it is possible to supply a gas to the liquid from each of the gas inlets 72*a*, 72*b*, and 72*c*, while supplying a sufficient amount of liquid to the mixing part 21. Since shortage of the liquid provided for the mixing of a gas and liquid can be suppressed, a gas and liquid can be mixed stably and continuously, and the foam can be continuously generated.

In the case of the present embodiment, an area of each gas inlet 72 is smaller than an area of the liquid inlet 52. More specifically, the area of the liquid inlet 52 is larger than three times the area of the gas inlet 72. That is, the area of the liquid inlet 52 is larger than a total value of the areas of the three gas inlets 72*a*, 72*b*, and 72*c*.

That is, the area of each gas inlet 72 arranged in correspondence to one mixing part 21 is smaller than the area of the liquid inlet 52 arranged in correspondence to one mixing part 21.

Further, a total area of the gas inlets 72 arranged in correspondence to one mixing part 21 is smaller than the area of the liquid inlet 52 arranged in correspondence to one mixing part 21.

However, the present invention is not limited to this example, and the total area of the gas inlets 72 arranged in correspondence to one mixing part 21 may be equal to the area of the liquid inlet 52 arranged in correspondence to one mixing part 21, or may be larger than the area.

In the case of the present embodiment, the flow path area of the adjacent foam flow path 91 is equal to a maximum value of the inner cavity cross-sectional area of the mixing part 21 orthogonal to the axial direction of the adjacent foam flow path 91 (the inner cavity cross-sectional area of the mixing part 21 orthogonal to the axial direction of the adjacent foam flow path 91).

Therefore, also in the case of the present embodiment, the swing of the liquid column can be performed in a limited space.

Also in the case of the present embodiment, a length of the adjacent foam flow path 91 is longer than a dimension of the gas inlet 72 in the axial direction of the adjacent foam flow path 91. Therefore, fine foam can be intermittently generated while the swing of the liquid column as described above is more reliably performed.

More specifically, the length of the adjacent foam flow path 91 is longer than the dimension of the mixing part 21 in the axial direction of the adjacent foam flow path 91.

As described above, the foamer mechanism 20 includes a plurality of mixing parts 21, and the foam flow path 90 includes each adjacent foam flow path 91 in correspondence to each of the mixing parts 21. By adopting such a configuration, even when there are a plurality of mixing parts 21, an alternate swing operation of the liquid column at high speed can be suitably realized since there is restriction on a range in which the liquid column generated in each mixing part 21 alternately swings in the adjacent foam flow path 91.

Further, the enlarged foam flow path 93 is arranged above the adjacent foam flow path 91. The adjacent foam flow path 91 each merges into one enlarged foam flow path 93. That is, the foam flow path 90 includes the enlarged foam flow path 93 being adjacent on the downstream side of the adjacent foam flow path 91 and having a larger flow path area than that of the adjacent foam flow path 91, and the adjacent foam flow path 91 corresponding to each of the plurality of mixing parts 21 merges into one enlarged foam flow path 93.

Therefore, the foam generated by mixing the gas and the liquid in the plurality of mixing parts 21 can be merged to the enlarged foam flow path 93, and can be collectively discharged from the discharge port 41.

A space above a second member 820 in the internal space of the inner cylinder part 32 constitutes a flow path 32*d* through which foam flowing from the enlarged foam flow path 93 passes.

An upper end of the flow path 32*d* communicates with the discharge port 41 via the internal space of the nozzle part 40.

In the case of the present embodiment, a gas flow path 70 includes the axial gas flow path 73 and the adjacent gas flow path 71.

In the case of the present embodiment, the adjacent liquid flow paths 51 constitutes the liquid flow path 50.

The foam discharger 100 is configured as described above.

Note that the foam discharge cap 200 includes a part of the configuration of the foam discharger 100 excluding the storage container 10.

That is, the foam discharge cap 200 includes: the mounting part 111 mounted to the storage container 10 that stores the liquid 101; the foamer mechanism 20 that is held by the mounting part 111 and generates foam from the liquid 101; the liquid supply unit that is held by the mounting part 111 and supplies the liquid to the foamer mechanism 20; the gas supply unit that is held by the mounting part 111 and supplies the gas to the foamer mechanism 20; the discharge port 41 that is held by the mounting part 111 and discharges the foam generated by the foamer mechanism 20; and the foam flow path 90 that is held by the mounting part 111 and through which the foam from the foamer mechanism 20 toward the discharge port 41 pass. The configuration of the foamer mechanism 20 is as described above.

Next, an operation will be described.

First, in a normal state where the head member 30 is not pushed down, the head member 30 is present at the top dead center position as shown in FIG. 5.

In this state, the spring receiving part 162*a* of the valve body 162 of the poppet 160 is in contact with the lower end of the coil spring 170, and the valve body 162 is slightly separated from the valve seat 127. That is, the liquid suction valve is open. Further, the ball valve 180 is in contact with the valve seat part 131, and the liquid discharge valve is closed.

The lower end part of the cylindrical part 151 of the gas piston 150 is fitted into the valve forming groove 134 on the upper surface of the flange part 133 of the piston guide 130, and the gas discharge valve is closed. The valve body of the suction valve member 155 is in contact with the lower surface of the piston part 152 of the gas piston 150, and the gas suction valve is closed. Further, the through hole 129 of the gas cylinder component 121 is closed by the outer peripheral ring part 153 of the gas piston 150.

When the head member 30 is pushed down, the piston guide 130 and the liquid piston 140 descend integrally with the head member 30. With this descending, the coil spring 170 is compressed, and a volume of the liquid pump chamber 220 is reduced.

At the beginning of a process in which the piston guide 130 and the liquid piston 140 descend, the poppet 160 slightly descends following the piston guide 130 due to friction with the rib 136 of the piston guide 130. This causes the valve body 162 to come into liquid-tight contact with the valve seat 127, and causes the liquid suction valve to be closed.

After the liquid suction valve is closed, further descending of the liquid piston 140 pressurizes the liquid 101 in the liquid pump chamber 220, and causes the liquid 101 to be pumped upward. That is, the pressure of the liquid 101 lifts the ball valve 180 from the valve seat part 131 and opens the liquid discharge valve, and the liquid 101 is distributed and flows into each adjacent liquid flow path 51 of the liquid flow path 50 from the liquid pump chamber 220, via the liquid discharge valve and the housing space 132.

Here, the adjacent liquid flow paths 51 are arranged at equal angular intervals, and flow path areas of adjacent liquid flow paths 51 are equal to each other. Therefore, the liquid 101 flows into the adjacent liquid flow paths 51 evenly.

Further, the liquid 101 passes through each adjacent liquid flow path 51, and flows into the mixing part 21 connected above each adjacent liquid flow path 51, via the liquid inlet 52 at the upper end of each adjacent liquid flow path 51.

In addition, when the head member 30 is pushed down, a gas in the gas pump chamber 210 is compressed and sent to the foamer mechanism 20 by pressure.

That is, at the beginning of a process in which the liquid piston 140 and the piston guide 130 descend, the gas piston 150 relatively ascends with respect to the piston guide 130 (however, with respect to the cylinder member 120, the gas piston 150 is substantially stationary or slightly descends). This separates the lower end part of the cylindrical part 151 of the gas piston 150 upward from the valve forming groove 134 of the flange part 133, causing the gas discharge valve to be open.

Thereafter, when an upper end part of the cylindrical part 151 comes into contact with the upward movement regulating part 32*a* of the inner cylinder part 32, the ascending of the gas piston 150 relatively to the head member 30 and the piston guide 130 is regulated, and thereafter, the gas piston 150 descends integrally with the head member 30 and the piston guide 130. This pressurizes the gas in the gas pump chamber 210.

Therefore, the gas in the gas pump chamber 210 is evenly distributed and supplied to the 24 pieces of axial gas flow path 73 (FIGS. 6, 9, and 11) of the gas flow path 70, via the gas discharge valve, the flow path 211 (FIG. 10), the cylindrical gas flow path 212 (FIG. 5), the axial flow path 213 (FIGS. 5 and 6), and the circular flow path 214 (FIGS. 5 and 6) in this order.

Further, the gas is supplied from each of the 24 pieces of axial gas flow path 73 to the corresponding adjacent gas flow path 71. That is, the gas is evenly supplied to the eight adjacent gas flow paths 71*a*, the eight adjacent gas flow paths 71*b*, and the eight adjacent gas flow paths 71*c*.

Then, the gas flows into each of the mixing parts 21 from the corresponding adjacent gas flow paths 71*a*, 71*b*, and 71*c* via the gas inlets 72*a*, 72*b*, and 72*c*.

That is, for each mixing part 21, the gas is supplied from the adjacent gas flow paths 71*a*, 71*b*, and 71*c* via the gas inlets 72*a*, 72*b*, and 72*c*, the liquid is supplied from the adjacent liquid flow path 51 via the liquid inlet 52, and the gas and the liquid are mixed in the mixing part 21.

Here, also in the case of the present embodiment, the liquid inlet 52 is arranged at a position corresponding to the merging part 22 of the gases supplied from the adjacent gas flow paths 71*a*, 71*b*, and 71*c* to the mixing part 21 via the gas inlets 72*a*, 72*b*, and 72*c*. Therefore, the liquid can be effectively foamed by an airflow. That is, for example, as described in the first embodiment, the liquid column is formed by the liquid supplied to the mixing part 21 from the adjacent liquid flow path 51. Then, the operation of sequentially supplying the gasses to the mixing part 21 from the three adjacent gas flow paths 71*a*, 71*b*, and 71*c* corresponding to one mixing part 21 is repeated. Therefore, the liquid column circumferentially swings at high speed sequentially in a direction away from the adjacent gas flow path 71*a*, a direction away from the adjacent gas flow path 71*b*, and a direction away from the adjacent gas flow path 71*c*, and the liquid column intermittently generates fine foam.

Therefore, it is possible to mix a gas and liquid satisfactorily to generate sufficiently uniform foam.

Here, in the case of the present embodiment, individual axial gas flow paths 73 are provided in correspondence to the individual adjacent gas flow paths 71. Therefore, as compared with a case where a gas is distributed from one axial gas flow path 73 to a plurality of (two) adjacent gas flow paths 71 as in a third embodiment described later, magnitude of a force required to push down the head member 30 can be reduced since the gas can pass through the axial gas flow path 73 at a low pressure. In addition, it becomes easier to more evenly distribute and supply the gas to each adjacent gas flow path 71, which can suppress generation of large foam called crab bubbles and stabilize the quality of the generated foam.

Also in the case of the present embodiment, it is still possible to generate sufficiently uniform and fine foam even though the foam discharger 100 does not include a mesh that is included in a typical foamer mechanism. Therefore, clogging of the mesh can be prevented.

Further, liquid that is not easily foamed, such as high-viscosity liquid, can be easily foamed.

In addition, individual mixing parts 21 are arranged in correspondence to the respective adjacent liquid flow paths 51. Therefore, the escape of a gas and liquid from the mixing part 21 is restricted, so that the gas and the liquid in the mixing part 21 can be mixed more reliably.

By arranging a plurality of dedicated adjacent gas flow paths 71 in correspondence to each mixing part 21, the escape of the gas and the liquid from the mixing part 21 is further restricted, so that the gas and the liquid in the mixing part 21 can be mixed more reliably.

Note that the foam may also be generated in the adjacent foam flow path 91 and the enlarged foam flow path 93, in addition to the mixing part 21.

That is, the foam generated in the mixing part 21 and the adjacent foam flow path 91 merge to the enlarged foam flow path 93, and the foam may become finer here as well.

The foam is discharged from the discharge port 41 to the outside from the enlarged foam flow path 93, via the flow path 32*d* and the internal space of the nozzle part 40.

Thereafter, when the pushing operation on the head member 30 is released, the coil spring 170 is extended by elastically returning. Therefore, the liquid piston 140 is energized by the coil spring 170 to ascend, and the piston guide 130 and the head member 30 ascend integrally with the liquid piston 140. At this time, since the liquid pump chamber 220 has a negative pressure by expansion of the liquid pump chamber 220, the ball valve 180 comes into contact with the valve seat part 131, and the liquid discharge valve is closed.

In a process of ascending of the piston guide 130, the poppet 160 slightly ascends following the piston guide 130 due to friction with the rib 136. This separates the valve body 162 from the valve seat 127, and causes the liquid suction valve to be open. After the spring receiving part 162*a* of the valve body 162 comes into contact with the lower end of the coil spring 170, the poppet 160 stops ascending, and the piston guide 130 ascends while the rib 136 slides with respect to the poppet 160.

As the piston guide 130 and the liquid piston 140 further ascend to expand the liquid pump chamber 220, the liquid 101 in the storage container 10 is sucked into the liquid pump chamber 220 via the dip tube 128.

Further, in the process of ascending of the piston guide 130, the piston guide 130 ascends relatively to the gas piston 150, and a lower end of the cylindrical part 151 of the gas piston 150 is fitted into the valve forming groove 134 of the flange part 133. This causes the gas discharge valve to be closed.

When the piston guide 130 further ascends, the gas piston 150 ascends integrally with the piston guide 130.

Since the inside of the gas pump chamber 210 has a negative pressure as the gas piston 150 ascends to expand the gas pump chamber 210, the valve body of the suction valve member 155 is separated from the lower surface of the piston part 152, and the gas suction valve is open. This allows the air outside the foam discharger 100 to flow into the gas pump chamber 210, through a gap between the upper end of the upright cylinder part 113 and the lower end of the outer cylinder part 33, a gap between the upright cylinder part 113 and the inner cylinder part 32, a gap between the annular closing part 112 and the piston part 152, and through the suction opening 154 of the piston part 152 and the gas suction valve.

The ascending of the head member 30, the piston guide 130, the liquid piston 140, and the gas piston 150 is stopped, for example, by regulating the ascending of the piston part 152 with the annular closing part 112.

When the liquid 101 in the storage container 10 is sucked into the liquid pump chamber 220 at a time of the ascending of the head member 30 or the like after the pushing operation is released, a space above a liquid surface of the liquid 101 in the storage container 10 has a negative pressure because the volume is increased.

However, when the head member 30 is pushed down thereafter, and the through hole 129 shifts from a state of being closed by the outer peripheral ring part 153 to a state of being not closed, the air outside the foam discharger 100 flows into the storage container 10 through a gap between the upper end of the upright cylinder part 113 and the lower end of the outer cylinder part 33, a gap between the upright cylinder part 113 and the inner cylinder part 32, a gap between the annular closing part 112 and the piston part 152, and the through hole 129. This allows the space above the liquid surface of the liquid 101 in the storage container 10 to return to the atmospheric pressure.

The structure and operation of the foam discharge cap 200 described here are merely examples, and other widely known structures and operations may be applied to the present embodiment without departing from the spirit of the present invention.

According to the second embodiment as described above as well, since the liquid inlet 52 is arranged at a position corresponding to the merging part 22 of the gases supplied to the mixing part 21 from the plurality of adjacent gas flow paths 71 via the gas inlet 72, the liquid can be effectively foamed by an airflow, by causing the liquid column to swing as described above. Therefore, it is possible to mix a gas and liquid satisfactorily to generate sufficiently uniform foam.

Third Embodiment

Next, a third embodiment will be described with reference to FIGS. 4 and 14 to 27.

Figure 16A:
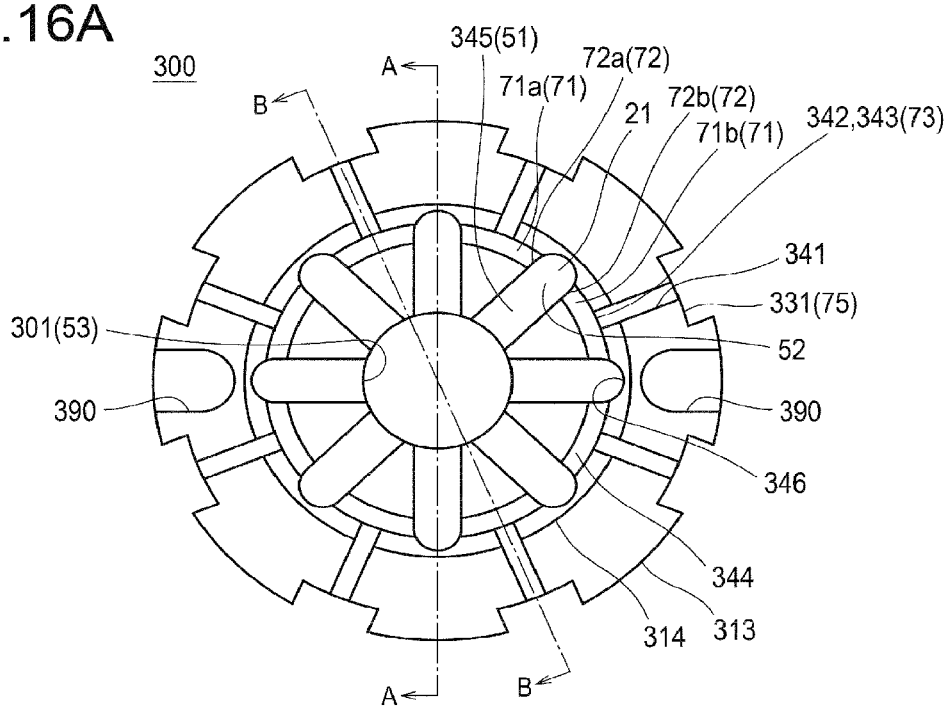
Figure 16B:
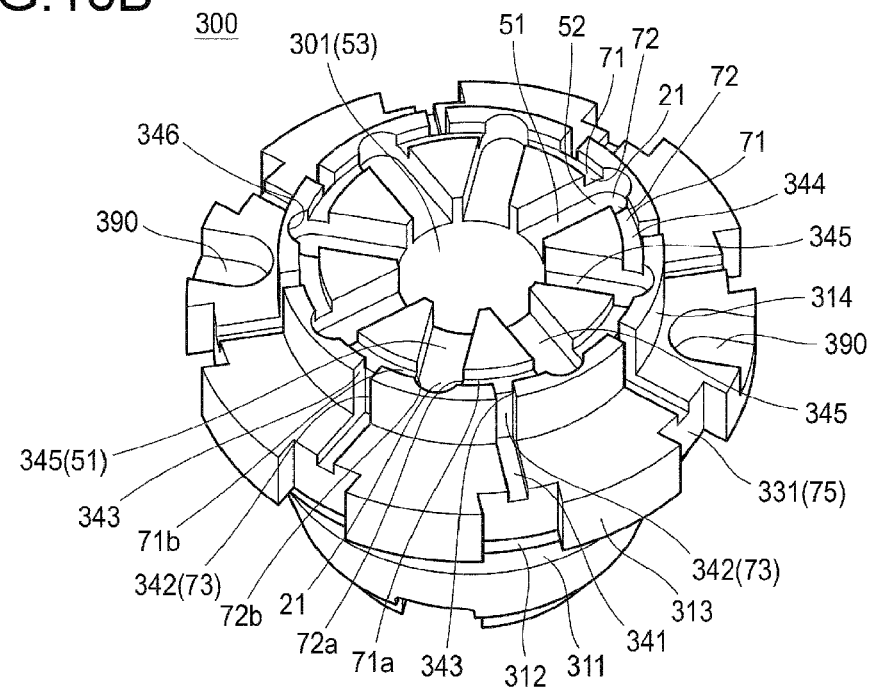
Figure 17A:
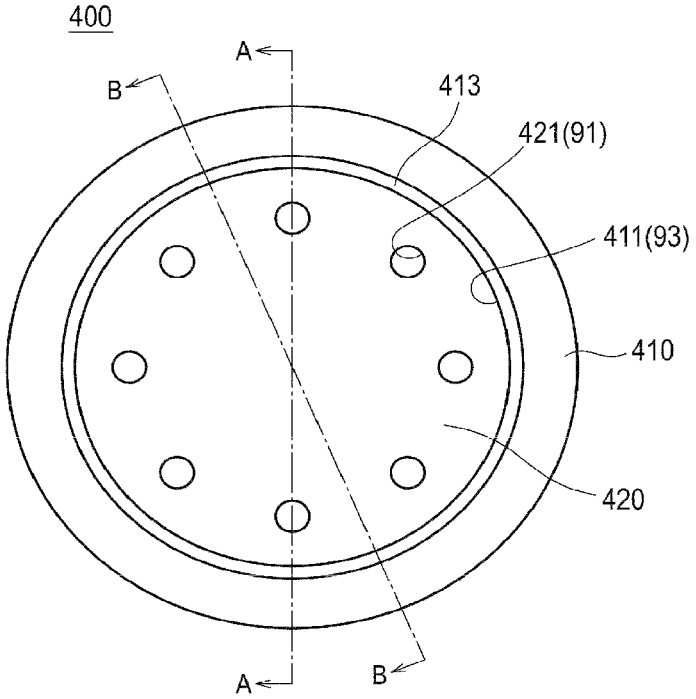
Figure 18:
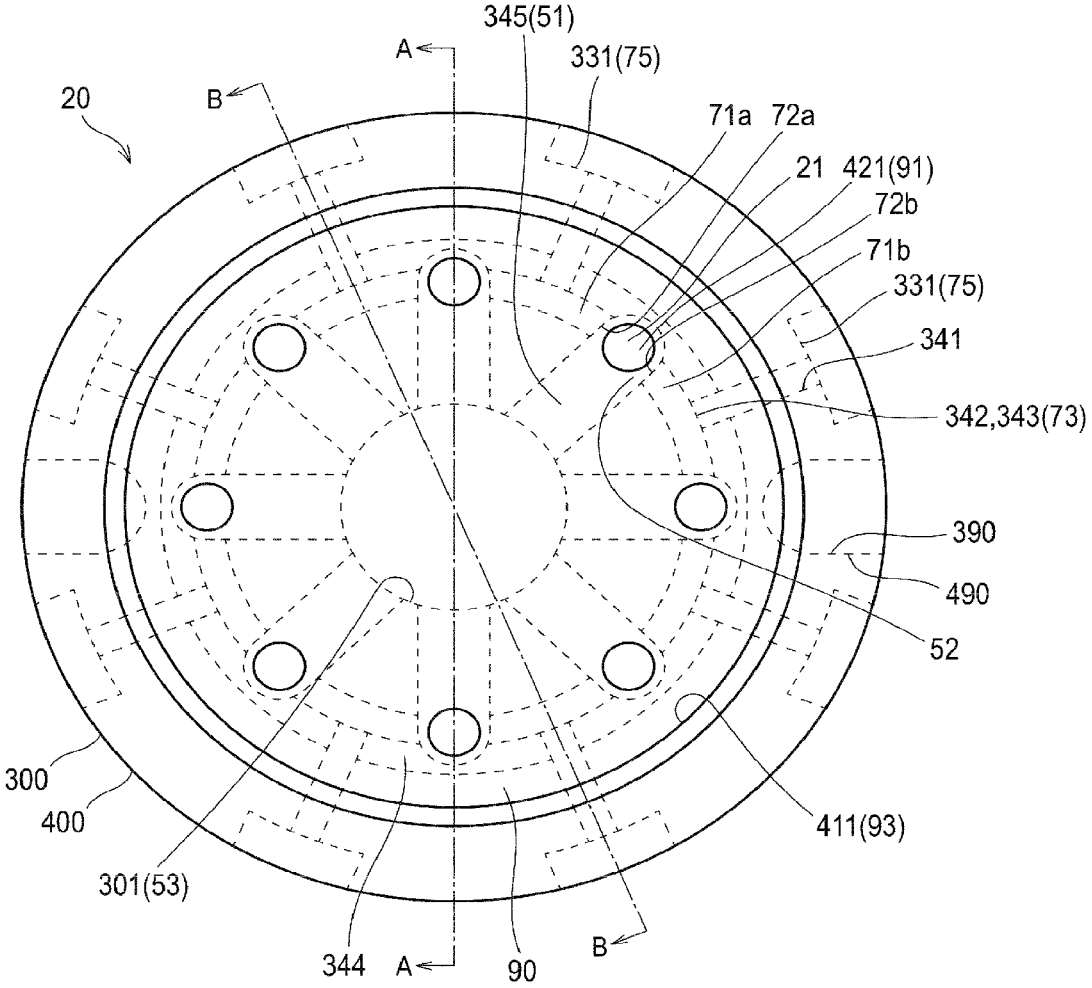
FIG. 18 is a plan view showing a state in which the first member and the second member included in the foamer mechanism of the foam discharger according to the third embodiment are assembled.
Figure 19:
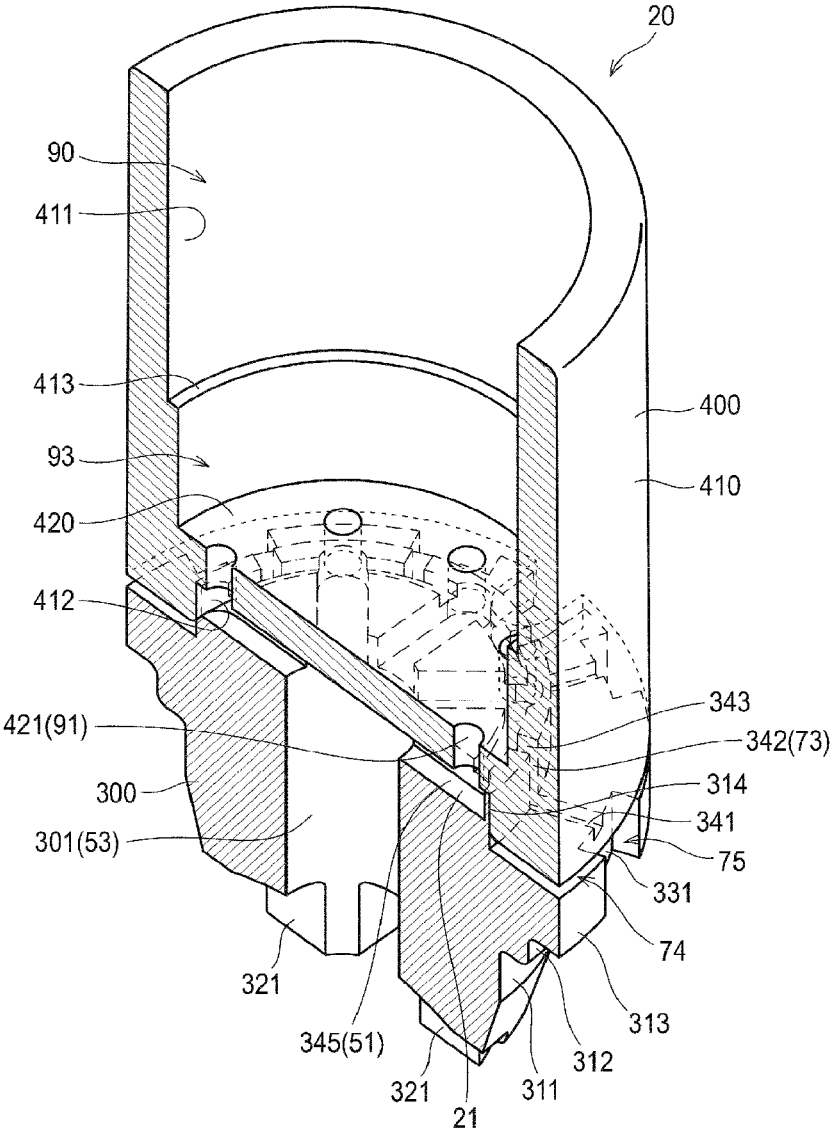
FIG. 19 is a perspective cross-sectional view taken along line A-A in FIG. 18.

Positions of lines A-A in FIGS. 16A, 17A, and 18 correspond to each other, and positions of lines B-B in FIGS. 16A, 17A, and 18 correspond to each other.

A foamer mechanism 20 of a foam discharger 100 according to the present embodiment is different from the foamer mechanism 20 of the foam discharger 100 according to the above-described first embodiment in the following points. In other respects, a configuration is similar to that of the foamer mechanism 20 of the foam discharger 100 according to the first embodiment.

In addition, regarding a configuration other than the foamer mechanism 20, the foam discharger 100 and a foam discharge cap 200 according to the present embodiment are configured similarly to the foam discharger 100 and the foam discharge cap 200 according to the above-described second embodiment.

The foamer mechanism 20 in the above-described second embodiment includes the first member 810 and the second member 820. In the case of the present embodiment, as an example, a first member 300 (FIGS. 16A and 16B) and a second member 400 (FIGS. 17A and 17B) individually described below are combined to constitute the foamer mechanism 20.

As shown in any of FIGS. 15, 16A, 16B, 19, and 20, the first member 300 is a cylindrical member, and an axis of the first member 300 extends vertically.

The first member 300 includes: a first cylinder part 311; a second cylinder part 312 connected above the first cylinder part 311; a third cylinder part 313 connected above the second cylinder part 312; a fourth cylinder part 314 connected above the third cylinder part 313; and a plurality of (for example, four) projections 321 projecting downward from the first cylinder part 311.

The lower part of the first cylinder part 311 is reduced in diameter downward in a tapered shape, for example.

The second cylinder part 312 is formed to have a larger diameter than that of the first cylinder part 311.

The third cylinder part 313 is formed to have an even larger diameter than that of the second cylinder part 312.

The fourth cylinder part 314 is formed to have a smaller diameter than that of the third cylinder part 313.

The first cylinder part 311, the second cylinder part 312, the third cylinder part 313, and the fourth cylinder part 314 are coaxially arranged.

At a center part of the first member 300, a center hole 301 penetrating vertically through the first member 300 is formed.

On an outer peripheral surface of the third cylinder part 313, there are formed a plurality of outer peripheral cutout parts 331 that are intermittently arranged in a circumferential direction. The outer peripheral cutout part 331 is formed from a lower end to an upper end of the third cylinder part 313. More specifically, for example, eight outer peripheral cutout parts 331 are arranged at equal angular intervals.

On an upper surface of the third cylinder part 313, a plurality of radial gas grooves 341 each extending radially are formed. Each radial gas groove 341 is arranged at a center position of each outer peripheral cutout part 331 in a circumferential direction of the third cylinder part 313. Therefore, in the case of the present embodiment, eight radial gas grooves 341 are arranged at equal angular intervals. The radial gas groove 341 extends radially from an outer end to an inner end on the upper surface of the third cylinder part 313.

Further, on the upper surface of the third cylinder part 313, a plurality of (for example, two) alignment recesses 390 are formed at positions avoiding the outer peripheral cutout part 331 and the radial gas groove 341.

On an outer peripheral surface of the fourth cylinder part 314, a plurality of axial gas grooves 342 arranged intermittently in a circumferential direction are formed. Each axial gas groove 342 extends upward from an inner end part of each radial gas groove 341. Therefore, in the case of the present embodiment, eight axial gas grooves 342 are arranged at equal angular intervals. The axial gas groove 342 is formed from a lower end to an upper end of the outer peripheral surface of the fourth cylinder part 314.

On an upper surface of the fourth cylinder part 314, a plurality of radial grooves 345 intermittently arranged in the circumferential direction are formed. Each radial groove 345 extends from a radially inner end to an outer end part radially on the upper surface of the fourth cylinder part 314. A radially outer end part of the radial groove 345 is, for example, a groove tip end 346 bulging in an arc shape in plan view.

The radial groove 345 is formed to have a constant depth (vertical dimension) and width regardless of a radial position, for example.

Each radial groove 345 is arranged at an intermediate position between adjacent axial gas grooves 342 in a circumferential direction of the first member 300.

Further, at a peripheral part of the upper surface of the fourth cylinder part 314, a peripheral circumferential groove 344 shallower than the radial groove 345 is formed. The peripheral circumferential groove 344 connects adjacent radial grooves 345 at the vicinity of radially outer end parts thereof. Each peripheral circumferential groove 344 is formed in an arc shape centered on a central axis of the first member 300. The peripheral circumferential groove 344 is formed to have a constant depth (vertical dimension) and width regardless of the position in the circumferential direction, for example.

As shown in any of FIGS. 15, 17A, 17B, 19, and 20, the second member 400 includes, for example, a cylinder part 410 having a cylindrical shape, and a disc-shaped plate part 420.

An axis of the cylinder part 410 extends vertically.

The plate part 420 is arranged horizontally inside the cylinder part 410 at an intermediate position between an upper end and a lower end of the cylinder part 410. The plate part 420 is arranged, for example, below a center in a vertical direction of the cylinder part 410

In the cylinder part 410, a space above the plate part 420 is a recess 411, and a space below the plate part 420 is a recess 412.

For example, an inner diameter of the recess 411 is set to be larger than an inner diameter of the recess 412.

The plate part 420 is formed with a plurality of (for example, eight) holes 421 penetrating vertically through the plate part 420 from the recess 411 to the recess 412.

The holes 421 are arranged at equal angular intervals around the axis of the cylinder part 410.

Figure 17B:
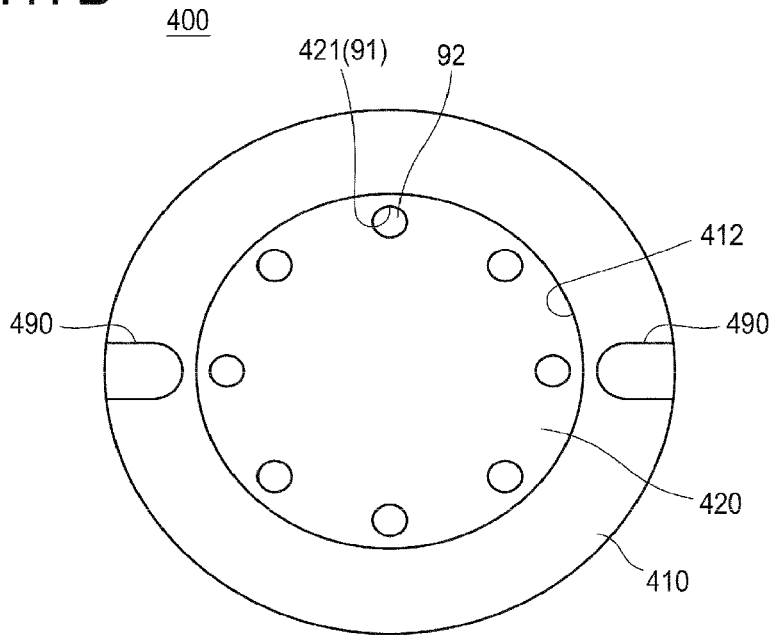

As shown in FIG. 17B, a plurality of (for example, two) alignment projections 490 are formed on a lower surface of the cylinder part 410.

Note that the recess 411 may be formed with a step part 413. In the recess 411, an inner diameter of a portion above the step part 413 is slightly larger than an inner diameter of a portion below the step part 413.

As shown in FIGS. 15, 19, 20, and 21, an inner diameter of the recess 412 is set to be equal to an outer diameter of the fourth cylinder part 314, and the first member 300 and the second member 400 are assembled to each other by fitting the fourth cylinder part 314 into the recess 412.

Here, the first member 300 and the second member 400 are assembled such that the alignment projections 490 are fitted into the respective alignment recesses 390, this allows the first member 300 and the second member 400 to be aligned with each other in the circumferential direction.

As shown in FIG. 18, the respective holes 421 are arranged near the radially outer end part of the radial groove 345 in plan view.

The upper surface of the fourth cylinder part 314 is in airtight contact with a lower surface of the plate part 420.

The outer peripheral surface of the fourth cylinder part 314 is in airtight contact with the inner peripheral surface of the recess 412.

An outer diameter of the cylinder part 410 is set to be equal to an outer diameter of the third cylinder part 313.

Figure 15:
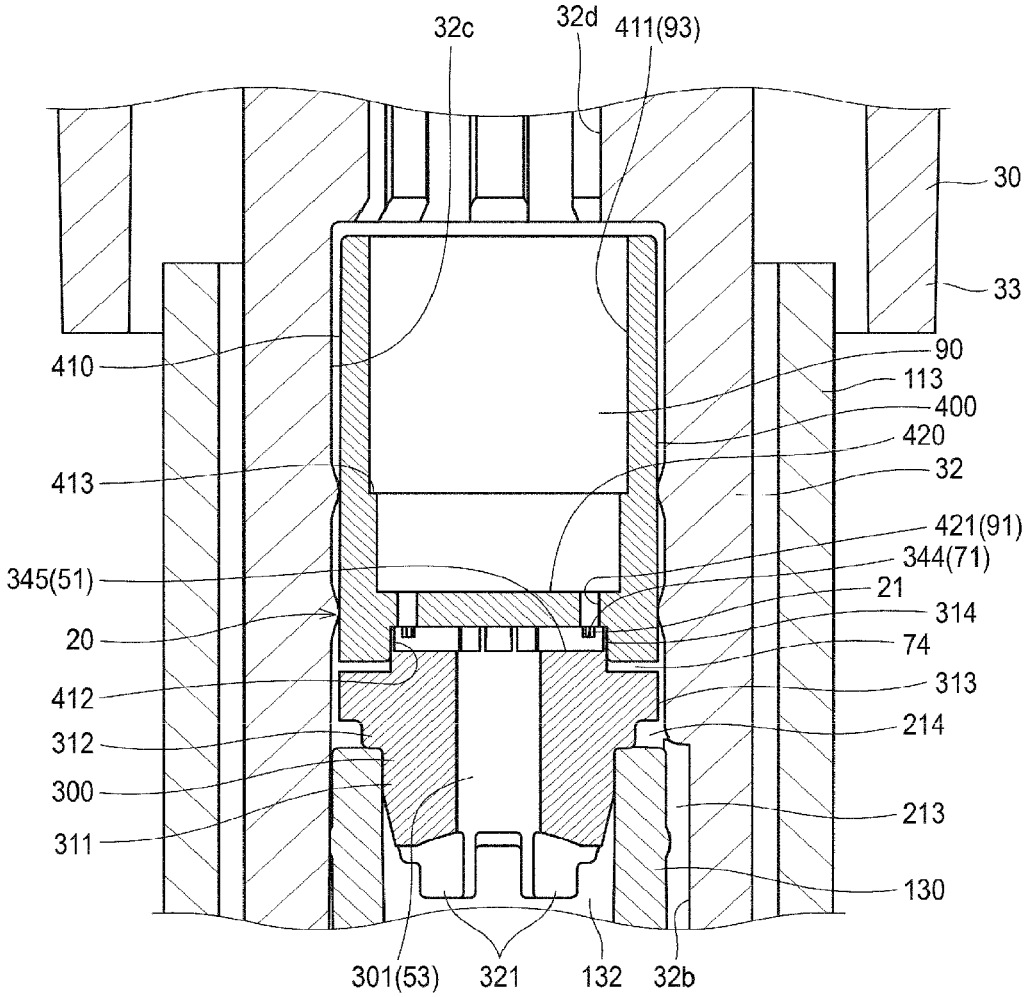
FIG. 15 is a partially enlarged view of FIG. 14.

As shown in FIG. 15, inside an inner cylinder part 32, there is formed a holding part 32*c* that houses and holds the first member 300 and the second member 400 assembled together. An internal space of the holding part 32*c* is a columnar space. The first member 300 and the second member 400 that are assembled to each other are fitted and fixed to the holding part 32*c*.

The first cylinder part 311 is fitted and fixed to an upper end part of a piston guide 130.

The projection 321 is arranged inside a housing space 132.

An outer peripheral surface of the first cylinder part 311 is circumferentially in airtight contact with an inner peripheral surface of the upper end part of the piston guide 130.

Between an outer peripheral surface of the second cylinder part 312 and an inner peripheral surface of the holding part 32*c*, a circular flow path 214 (FIG. 20) is formed.

By the outer peripheral cutout part 331, an axial communication gas flow path 75 (FIG. 20) is formed between the outer peripheral surface of the third cylinder part 313 and the inner peripheral surface of the holding part 32*c*. In the case of the present embodiment, the foamer mechanism 20 has a plurality of (for example, eight) axial communication gas flow paths 75.

An internal space of the center hole 301 constitutes a large-diameter liquid flow path 53.

Between the upper surface of the third cylinder part 313 and the lower surface of the cylinder part 410, a circular gas flow path 74 (FIGS. 20 and 22) is formed. The circular gas flow path 74 also includes a space in the radial gas groove 341.

The outer peripheral surface of the fourth cylinder part 314 is in airtight contact with the inner peripheral surface of the recess 412, except for the axial gas groove 342. The axial gas groove 342 forms an axial gas flow path (FIGS. 20 and 23) extending vertically, between the outer peripheral surface of the fourth cylinder part 314 and the inner peripheral surface of the recess 412. In the case of the present embodiment, the foamer mechanism 20 has a plurality of (for example, eight) axial gas flow paths 73. The axial gas flow path 73 extends parallel to the large-diameter liquid flow path 53. That is, the axial gas flow path 73 (intersecting gas flow path) extends in a direction parallel to the large-diameter liquid flow path 53.

Further, a plurality of axial gas flow paths 73 (intersecting gas flow paths) are intermittently arranged around the large-diameter liquid flow path 53.

The upper surface of the fourth cylinder part 314 is in airtight contact with the lower surface of the plate part 420, except for the radial groove 345 (including the groove tip end 346) and the peripheral circumferential groove 344.

The radial groove 345 forms an adjacent liquid flow path 51 and a mixing part 21 between the upper surface of the fourth cylinder part 314 and the lower surface of the plate part 420.

The adjacent liquid flow path 51 is formed between the plate part 420 and a portion of the radial groove 345 that is radially inner than an intersection with the peripheral circumferential groove 344.

Here, the large-diameter liquid flow path 53 has a larger flow path area than that of the adjacent liquid flow path 51. Each adjacent liquid flow path 51 extends from a downstream end part of the large-diameter liquid flow path 53 to a periphery in a direction intersecting (for example, orthogonal to) an axial direction of the large-diameter liquid flow path 53.

The mixing portion 21 is formed between the plate part 420 and an intersection of the radial groove 345 with the peripheral circumferential groove 344 and a portion radially outside the intersection (groove tip end 346).

In the case of the present embodiment, a maximum value of an inner cavity cross-sectional area of the mixing part 21 orthogonal to an axial direction of the adjacent liquid flow path 51 is the same as a flow path area of the adjacent liquid flow path 51.

In the case of the present embodiment, the foamer mechanism 20 has one adjacent liquid flow path 51 in correspondence to each mixing part 21.

In the case of the present embodiment, the foamer mechanism 20 includes a plurality of (for example, eight) adjacent liquid flow paths 51 arranged radially and a plurality of (for example, eight) mixing parts 21.

The plurality of mixing parts 21 are arranged along the circumference, and the plurality of adjacent liquid flow paths 51 are radially arranged inside the circumference.

As described above, the foamer mechanism 20 includes the plurality of mixing parts 21, the liquid flow path 50 includes the large-diameter liquid flow path 53 being adjacent on the upstream side of the adjacent liquid flow path 51 and having a larger flow path area than that of the adjacent liquid flow path 51, the plurality of mixing parts 21 are arranged around the downstream end part of the large-diameter liquid flow path 53, and the plurality of adjacent liquid flow paths 51 extend from the downstream end part of the large-diameter liquid flow path 53 toward a periphery in an in-plane direction intersecting the axial direction of the large-diameter liquid flow path 53.

Such a structure can suitably realize a configuration in which the foamer mechanism 20 includes the plurality of mixing parts 21.

Further, the peripheral circumferential groove 344 forms an adjacent gas flow path 71 between the upper surface of the fourth cylinder part 314 and the lower surface of the plate part 420.

Here, the peripheral circumferential groove 344 and the axial gas groove 342 communicate with each other at a groove upper end part 343 that is an upper end part of the axial gas groove 342. That is, an upper end part of the axial gas flow path 73 communicates with the adjacent gas flow path 71.

Figure 24:
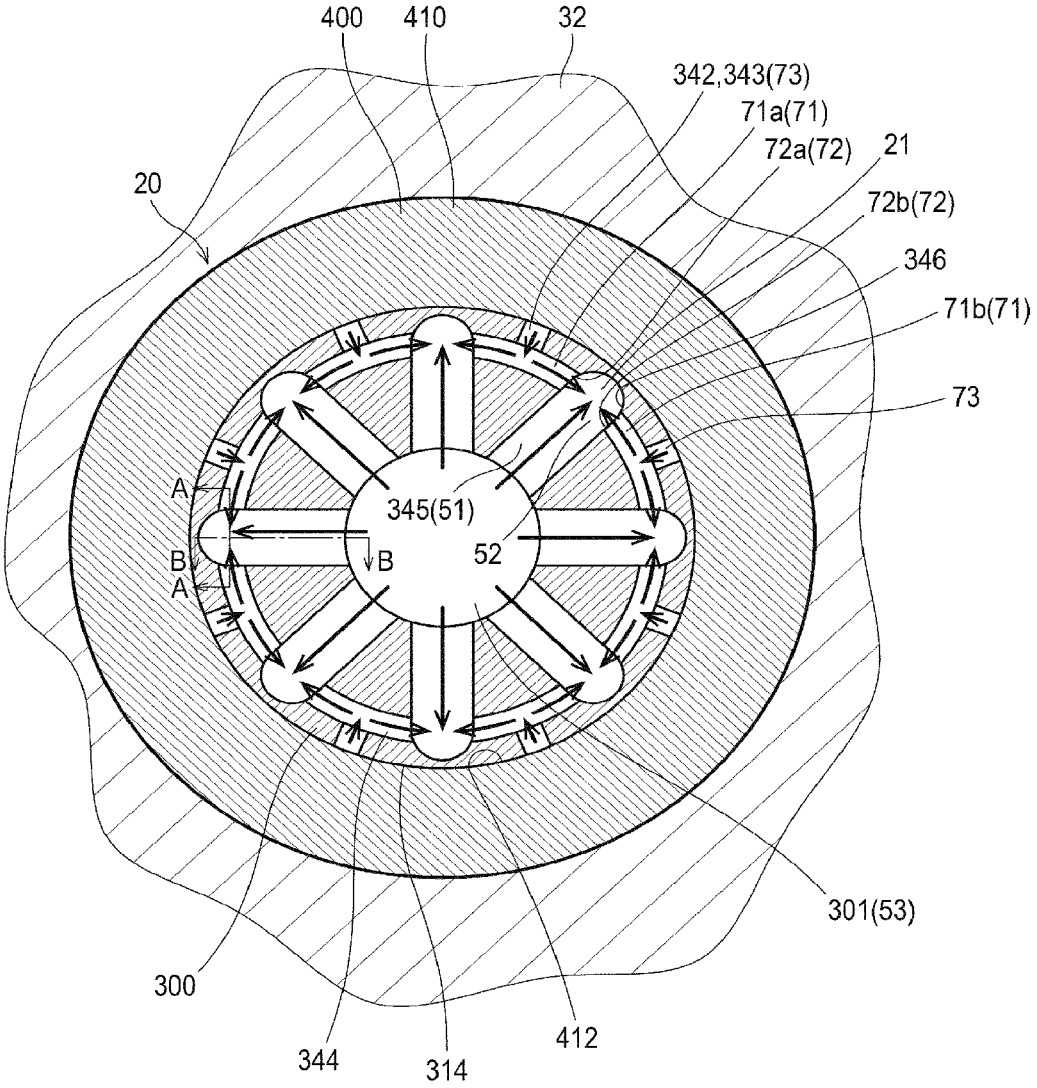
FIG. 24 is a cross-sectional view taken along line C-C in FIG. 21.
Figure 25:
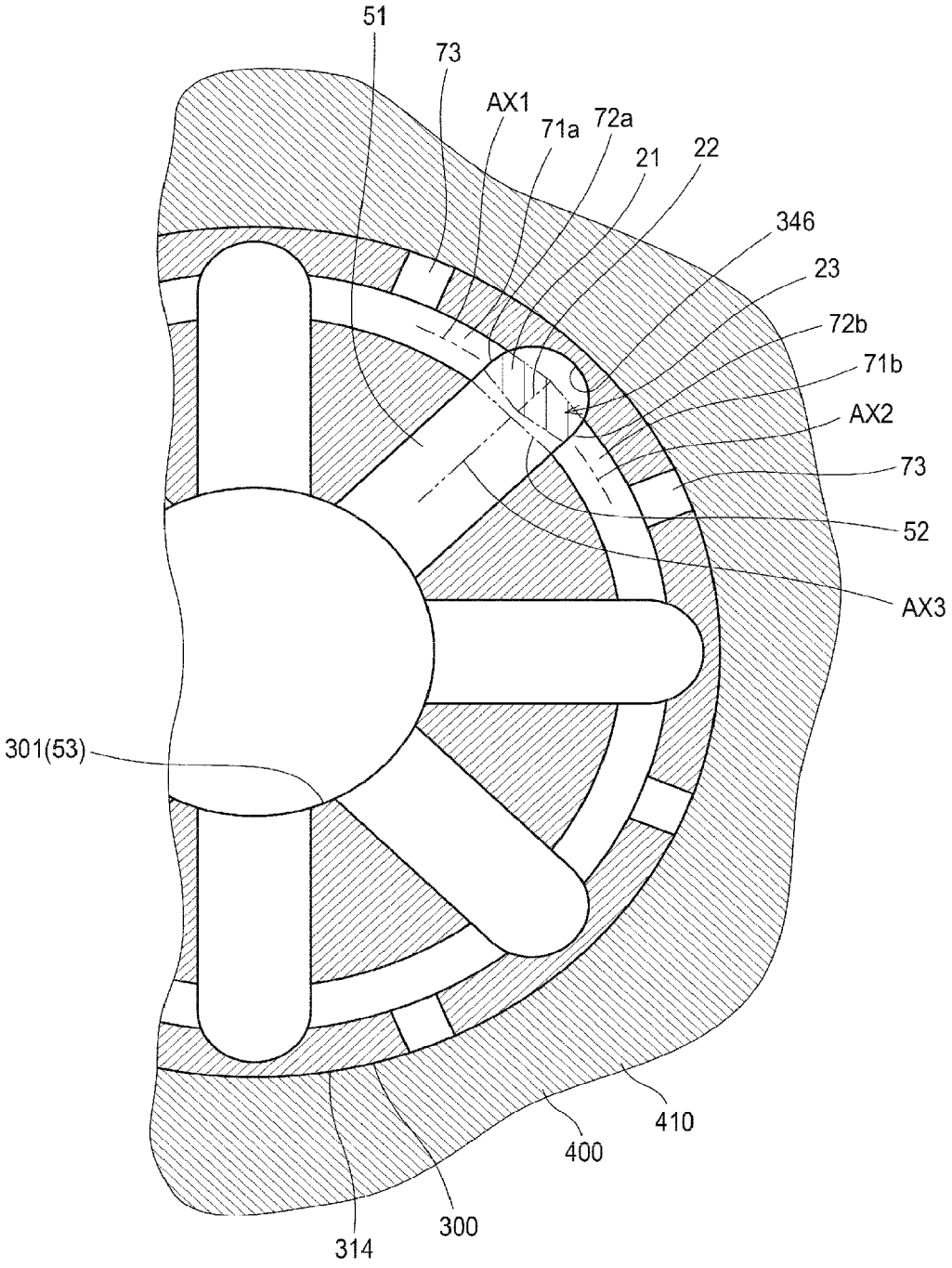
FIG. 25 is a partially enlarged view of FIG. 24.

As shown in FIGS. 24 and 25, each axial gas flow path 73 branches from an upper end part into two adjacent gas flow paths 71. Each adjacent gas flow path 71 extends horizontally in an arc shape.

In the case of the present embodiment, the foamer mechanism 20 each has a plurality (for example, a pair) of adjacent gas flow paths 71 in correspondence to one mixing part 21. That is, the foamer mechanism 20 has, for example, a total of 16 pieces of adjacent gas flow path 71.

In the case of the present embodiment, a flow path area of the adjacent gas flow path 71 is smaller than a flow path area of the adjacent liquid flow path 51.

Each adjacent gas flow path 71 is configured by a part of an annular flow path arranged along the circumference.

Thus, a gas flow path 70 includes the intersecting gas flow path (axial gas flow path 73) that is adjacent on the upstream side of the adjacent gas flow path 71 and extends in a direction intersecting the adjacent gas flow path 71, and one intersecting gas flow path branches into one of a pair of adjacent gas flow paths 71 corresponding to one mixing part 21 (adjacent gas flow path 71*a*), and one of a pair of adjacent gas flow paths 71 corresponding to another mixing part 21 (adjacent gas flow path 71*a*).

Figure 26:
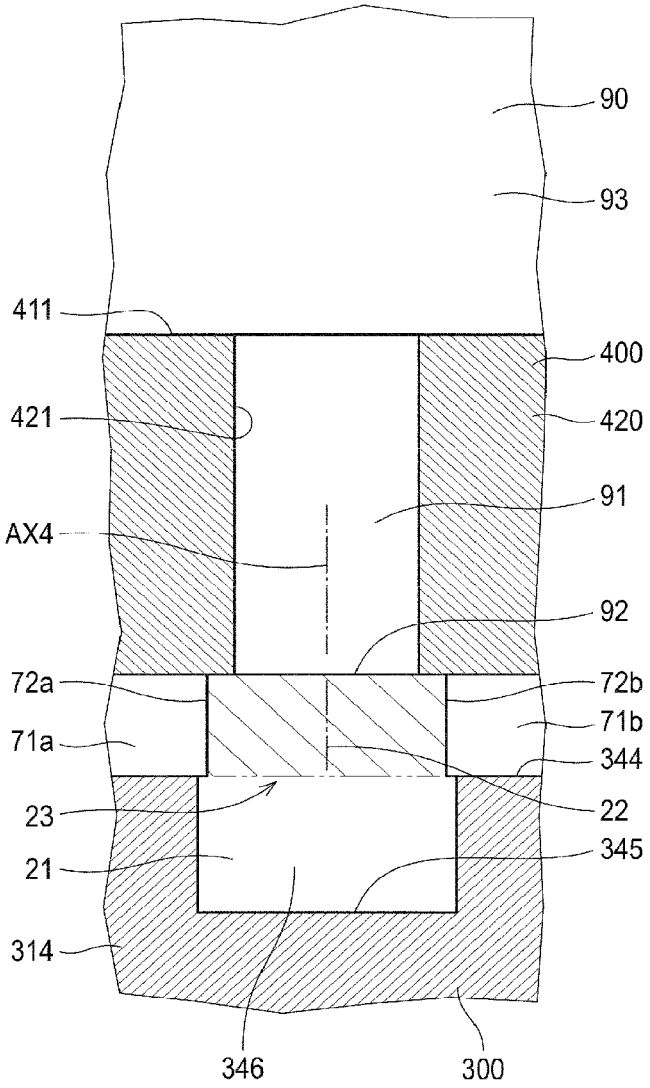
FIG. 26 is a cross-sectional view taken along line A-A in FIG. 24.
Figure 27:
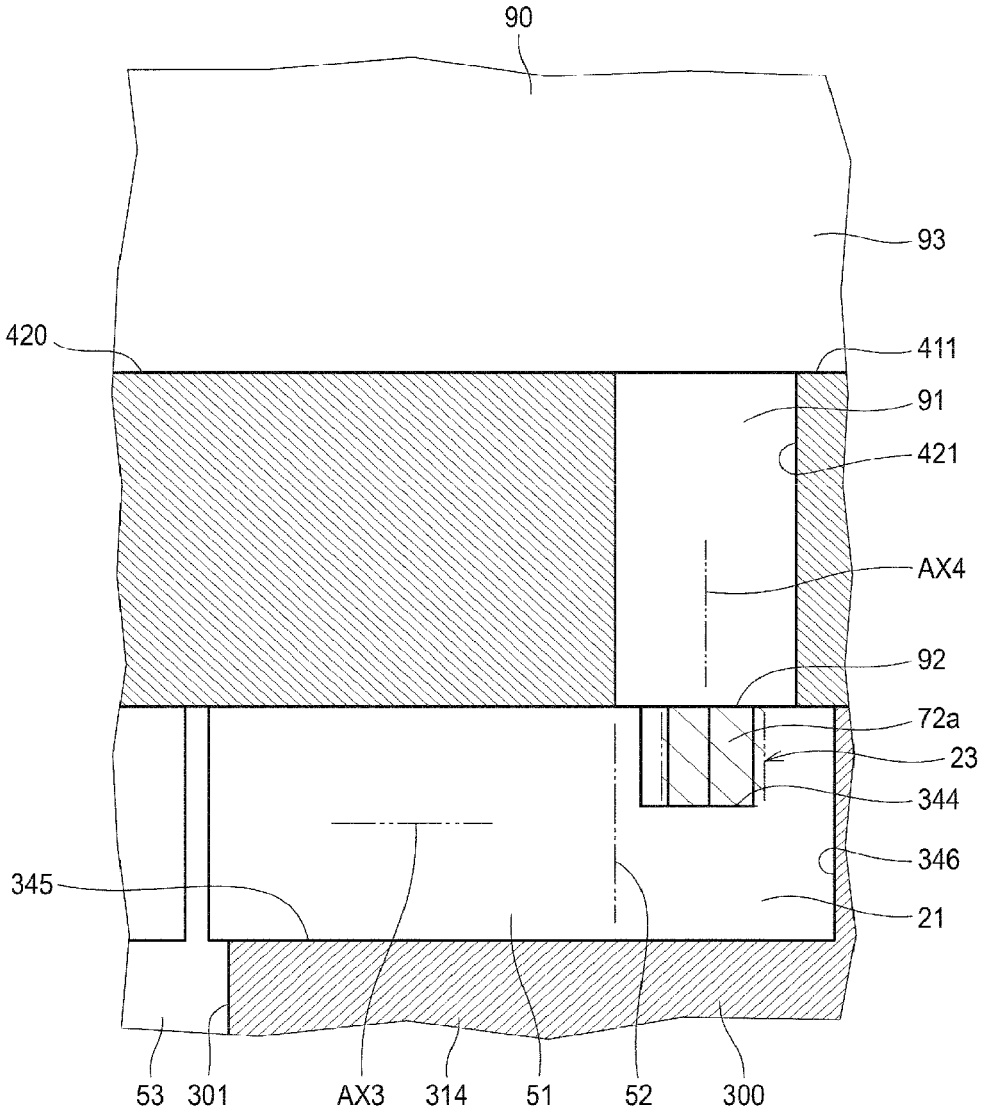
FIG. 27 is a cross-sectional view taken along line B-B in FIG. 24.

As shown in FIGS. 25 to 27, in the case of the present embodiment, a gas-liquid contact region 23 is an overlapping region of: a region extended from the adjacent gas flow path 71*a* in an direction of an axis AX1 at a downstream end of the adjacent gas flow path 71*a*; a region extended from the adjacent gas flow path 71*b* in an direction of an axis AX2 at a downstream end of the adjacent gas flow path 71*b*; and a region extended from the adjacent liquid flow path 51 in an direction of an axis AX3 of the adjacent liquid flow path 51.

A merging part 22 is located in the middle between the gas inlet 72*a* and the gas inlet 72*b*.

In the case of the present embodiment, since the gas inlet 72*a* and the gas inlet 72*b* are not strictly parallel to each other, the merging part 22 is not strictly a plane but a line. However, the merging part 22 is represented as a plane as shown in FIGS. 25 and 26 for convenience, since the gas inlet 72*a* and the gas inlet 72*b* are arranged substantially in parallel to each other.

By forming the groove tip end 346 bulging in an arc shape at the radially outer end part of the radial groove 345, the gas-liquid contact region 23 and the merging part 22 are arranged near the center of the mixing part 21 in plan view.

As shown in FIGS. 18, 26, and 27, an adjacent foam flow path 91 is arranged above each mixing part 21, and the adjacent foam flow path 91 extends vertically. That is, the foamer mechanism 20 has a plurality of (for example, eight) adjacent foam flow paths 91. A cross-sectional shape of the adjacent foam flow path 91 is, for example, circular. The adjacent foam flow path 91 may be gradually expanded or reduced (in a tapered shape) toward an enlarged foam flow path 93, or may be expanded or reduced step by step.

In the case of the present embodiment, as shown in FIGS. 26 and 27, dimensions of the gas inlets 72*a* and 72*b* in an direction of an axis AX4 of the adjacent foam flow path 91 are smaller than a dimension of the mixing part 21 in the direction, and the gas inlets 72*a* and 72*b* are open at an end part on the adjacent foam flow path 91 side in the mixing part 21.

Therefore, the gas is supplied to the end part on the adjacent foam flow path 91 side in the mixing part 21, and the liquid can be stocked at an end part of the mixing part 21 opposite to the adjacent foam flow path 91 side. Therefore, since shortage of liquid provided for the mixing of the gas and the liquid can be suppressed, the gas and the liquid can be mixed stably and continuously, and the foam can be continuously generated.

More specifically, vertical dimensions of the gas inlets 72*a* and 72*b* are smaller than a vertical dimension of the mixing part 21, and the gas inlets 72*a* and 72*b* are open at an upper end part of the mixing part 21.

In the case of the present embodiment, an area of each gas inlet 72 is smaller than an area of the liquid inlet 52. More specifically, the area of the liquid inlet 52 is equal to or larger than twice the area of the gas inlet 72.

That is, the area of each gas inlet 72 arranged in correspondence to one mixing part 21 is smaller than the area of the liquid inlet 52 arranged in correspondence to one mixing part 21.

Further, a total area of the gas inlets 72 arranged in correspondence to one mixing part 21 is smaller than the area of the liquid inlet 52 arranged in correspondence to one mixing part 21.

However, the present invention is not limited to this example, and the total area of the gas inlets 72 arranged in correspondence to one mixing part 21 may be equal to the area of the liquid inlet 52 arranged in correspondence to one mixing part 21, or may be larger than the area.

Note that, as shown in FIG. 18, each adjacent foam flow path 91 is located inside each mixing part 21 in plan view. In the case of the present embodiment, a flow path area of the adjacent foam flow path 91 is smaller than a maximum value of an inner cavity cross-sectional area orthogonal to an axial direction of the adjacent foam flow path 91 of the mixing part 21 (the inner cavity cross-sectional area of the mixing part 21 orthogonal to the axial direction of the adjacent foam flow path 91). Therefore, a swing of a liquid column as described in the first embodiment can be performed in a more limited space, and a flow path of an airflow passing around the liquid column is also restricted. Therefore, fine foam can be intermittently generated more satisfactorily.

In the case of the present embodiment, among surfaces defining the mixing part 21, a surface having a foam outlet 92 includes the foam outlet 92 and a wall surface (the lower surface of the plate part 420) around the foam outlet 92.

Also in the case of the present embodiment, a length of the adjacent foam flow path 91 is longer than a dimension of the gas inlet 72 in the axial direction of the adjacent foam flow path 91. Therefore, fine foam can be intermittently generated while the swing of the liquid column as described above is more reliably performed.

More specifically, the length of the adjacent foam flow path 91 is longer than the dimension of the mixing part 21 in the axial direction of the adjacent foam flow path 91.

In the case of the present embodiment, the axis AX3 of the adjacent liquid flow path 51 and the axis AX4 of the adjacent foam flow path 91 intersect (for example, orthogonal to) each other.

Further, the enlarged foam flow path 93 is arranged above the adjacent foam flow path 91. The adjacent foam flow path 91 each merges into one enlarged foam flow path 93.

That is, the foamer mechanism 20 includes a plurality of mixing parts 21, the foam flow path 90 includes each adjacent foam flow path 91 in correspondence to each of the mixing parts 21, the foam flow path 90 includes the enlarged foam flow path 93 being adjacent on the downstream side of the adjacent foam flow path 91 and having a larger flow path area than that of the adjacent foam flow path 91, and the adjacent foam flow paths 91 respectively corresponding to the plurality of mixing parts 21 merge into one enlarged foam flow path 93.

Therefore, the foam generated by mixing the gas and the liquid in the plurality of mixing parts 21 can be merged to the enlarged foam flow path 93, and can be collectively discharged from a discharge port 41.

A space above the second member 400 in an internal space of the inner cylinder part 32 constitutes a flow path 32*d* through which foam flowing from the enlarged foam flow path 93 passes.

An upper end of the flow path 32*d* communicates with the discharge port 41 via an internal space of a nozzle part 40.

In the case of the present embodiment, the gas flow path 70 includes the axial communication gas flow path 75, the circular gas flow path 74, the axial gas flow path 73, and the adjacent gas flow path 71.

As shown in FIG. 24, a gas supplied from the axial gas flow path 73 to the adjacent gas flow path 71 branches into the adjacent gas flow path 71*a* and the gas inlet 72*b*, and supplied to the corresponding mixing part 21.

In the case of the present embodiment, the liquid flow path 50 includes the large-diameter liquid flow path 53 and the adjacent liquid flow path 51. The large-diameter liquid flow path 53 has a larger flow path area than that of the adjacent liquid flow path 51.

In the case of the present embodiment, a ball valve 180 is held to be vertically movable, between a valve seat part 131 and a lower end of the projection 321 of the first member 300.

An internal space of a portion above the valve seat part 131 in the piston guide 130 constitutes the housing space 132 that houses the ball valve 180 and the first cylinder part 311 of the first member 300.

In the case of the present embodiment, when liquid 101 in a liquid pump chamber 220 is pressurized by a pushing operation of a head member 30, a liquid discharge valve including the ball valve 180 and the valve seat part 131 opens, the liquid 101 in the liquid pump chamber 220 flows into the housing space 132 via the liquid discharge valve, and the liquid is supplied into the center hole 301 of the first member 300 disposed above the housing space 132, that is, into the large-diameter liquid flow path 53 of the liquid flow path 50 of the foamer mechanism 20. The liquid 101 is supplied from the large-diameter liquid flow path 53 to the adjacent liquid flow path 51 (FIGS. 15 and 24), and further supplied to the mixing part 21 (FIG. 24).

In the case of the present embodiment, above an axial flow path 213, there is provided the circular flow path 214 (FIGS. 14 and 15) that is disposed circumferentially around the second cylinder part 312 (described later) of the first member 300.

Above the circular flow path 214, there are arranged a plurality of axial communication gas flow paths 75 (FIG. 20) extending vertically along the outer peripheral surface of the third cylinder part 313 (described later) of the first member 300. The circular flow path 214 communicates with lower end parts of the axial communication gas flow paths 75.

Above the axial communication gas flow path 75, the circular gas flow path 74 (FIG. 20) is located between the upper surface of the third cylinder part 313 of the first member 300 and the lower surface of the cylinder part 410 of the second member 400 described later. An upper end part of each axial communication gas flow path 75 communicates with the circular gas flow path 74.

Figure 20:
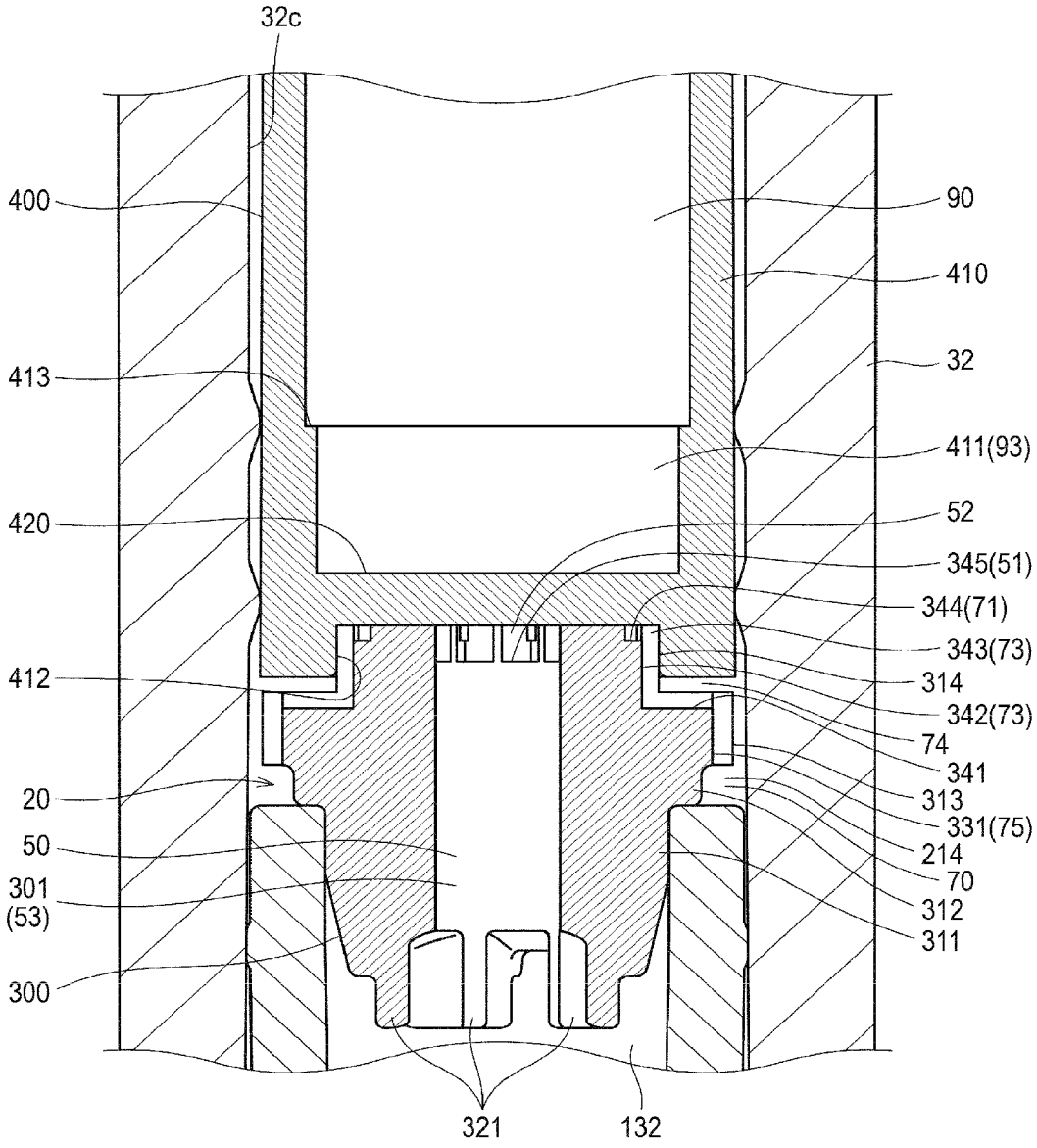
FIG. 20 is a cross-sectional view of the foam discharger taken along line B-B in FIG. 18.
Figure 21:
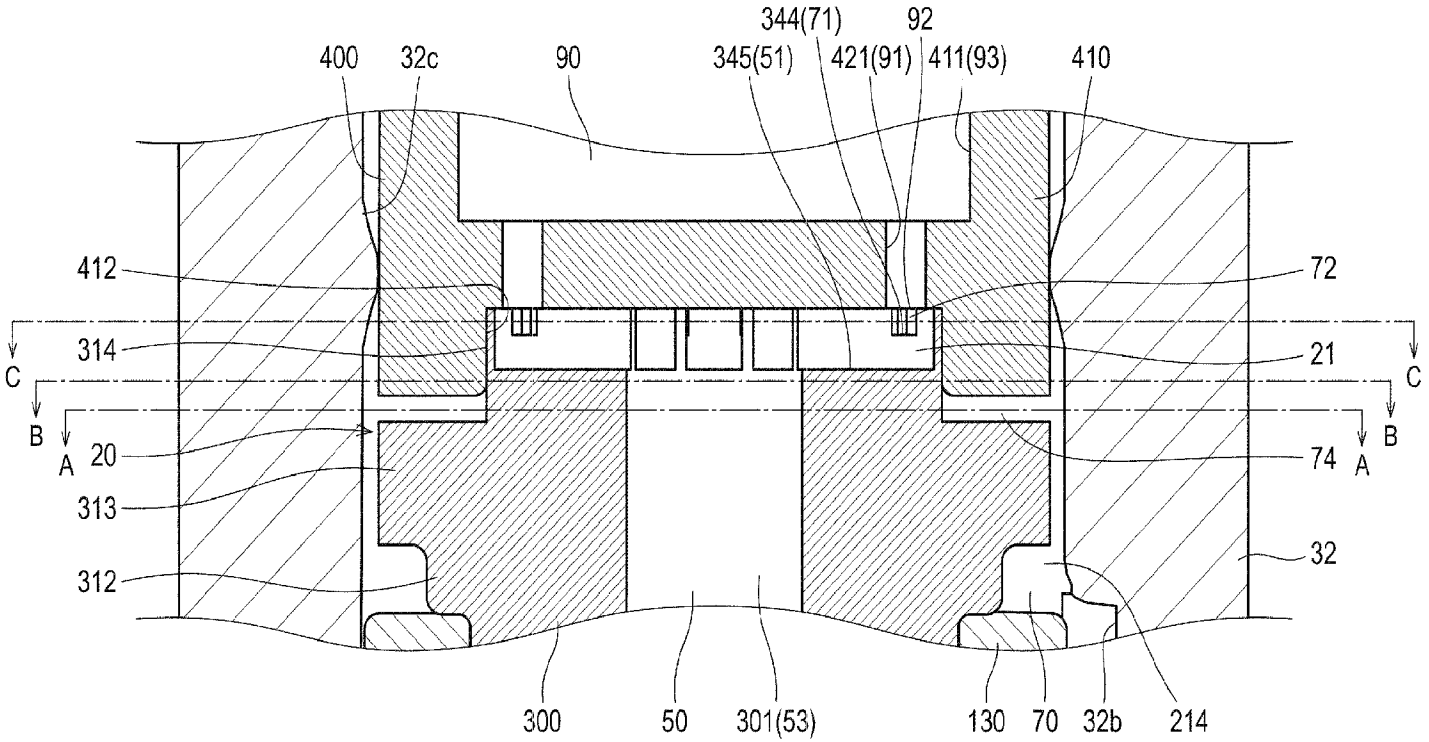
FIG. 21 is a partially enlarged view of FIG. 15.

A gas is supplied from the circular gas flow path 74 to the axial gas flow path 73 (FIG. 20), and further supplied to the adjacent gas flow path 71 (FIGS. 20 and 24).

Thus, the gas sent upward through a flow path 211 passes through a cylindrical gas flow path 212, the axial flow path 213, the circular flow path 214, the circular gas flow path 74, and the axial gas flow path 73 in this order, and is supplied to the adjacent gas flow path 71.

The foam discharger 100 is configured as described above.

Next, an operation will be described.

Figure 14:
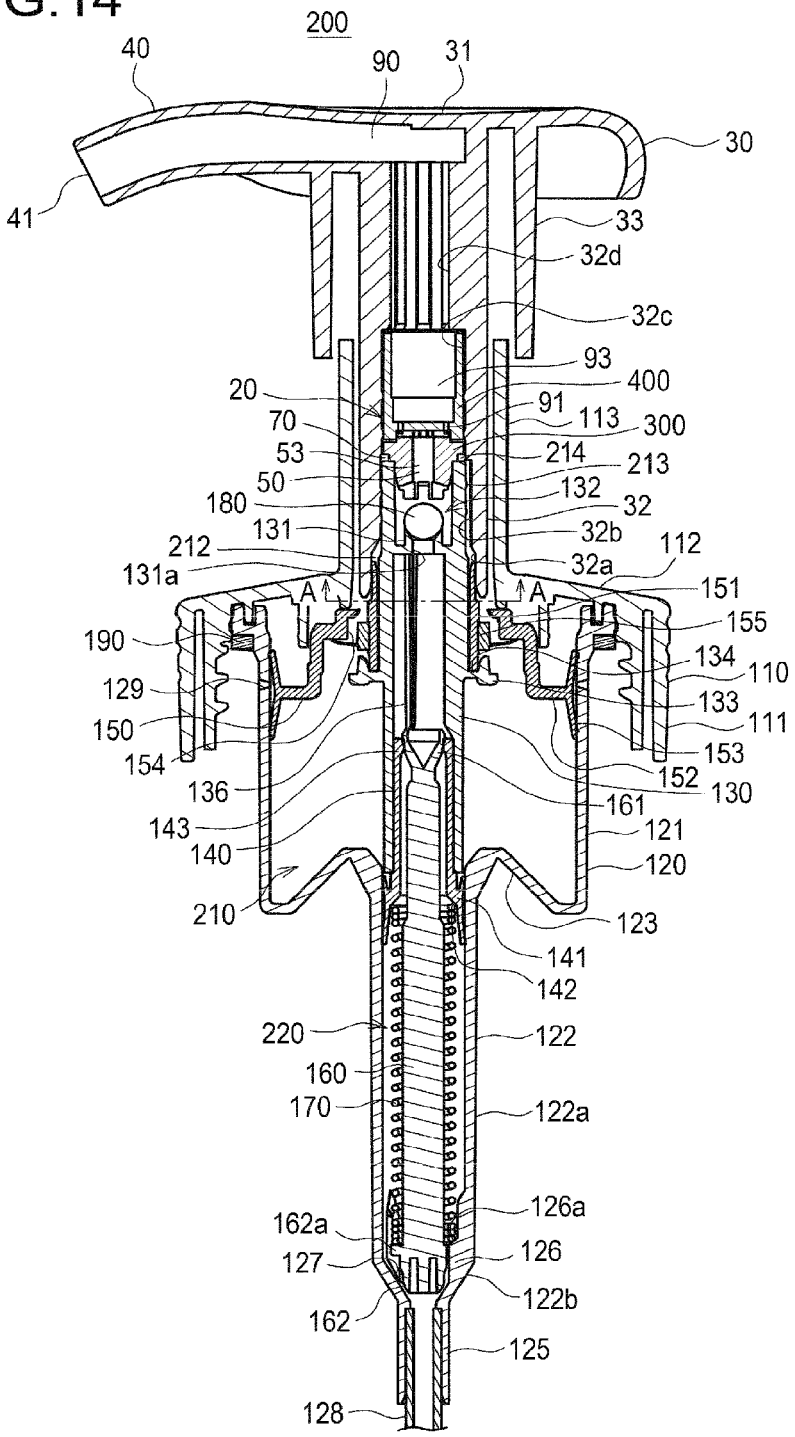
FIG. 14 is a side cross-sectional view of a foam discharge cap according to a third embodiment.

First, in a normal state where the head member 30 is not pushed down, the head member 30 is present at a top dead center position as shown in FIG. 14.

When the head member 30 is pushed down, the liquid 101 in the liquid pump chamber 220 is pressurized, and the liquid 101 flows from the liquid pump chamber 220 into the large-diameter liquid flow path 53 of the liquid flow path 50 via the liquid discharge valve and the housing space 132.

Further, the liquid 101 branches and flows from an upper end part of the large-diameter liquid flow path 53 to eight adjacent liquid flow paths 51.

Here, the adjacent liquid flow paths 51 are arranged at equal angular intervals around the large-diameter liquid flow path 53, and the flow path widths of the adjacent liquid flow paths 51 are equal to each other. Therefore, the liquid 101 flows into the adjacent liquid flow paths 51 evenly.

Further, the liquid 101 passes through each adjacent liquid flow path 51, and flows into the mixing part 21 connected to a radially outer end part of each adjacent liquid flow path 51, via the liquid inlet 52 of each adjacent liquid flow path 51.

In addition, when the head member 30 is pushed down, a gas in the gas pump chamber 210 is compressed and sent to the foamer mechanism 20 by pressure.

That is, the gas in the gas pump chamber 210 is evenly distributed and supplied to the eight axial communication gas flow paths 75 (FIG. 22) of the gas flow path 70, via a gas discharge valve, the flow path 211 (FIG. 10), the cylindrical gas flow path 212 (FIG. 14), the axial flow path 213 (FIGS. 14 and 15), and the circular flow path 214 (FIGS. 15 and 21) in this order.

Figure 22:
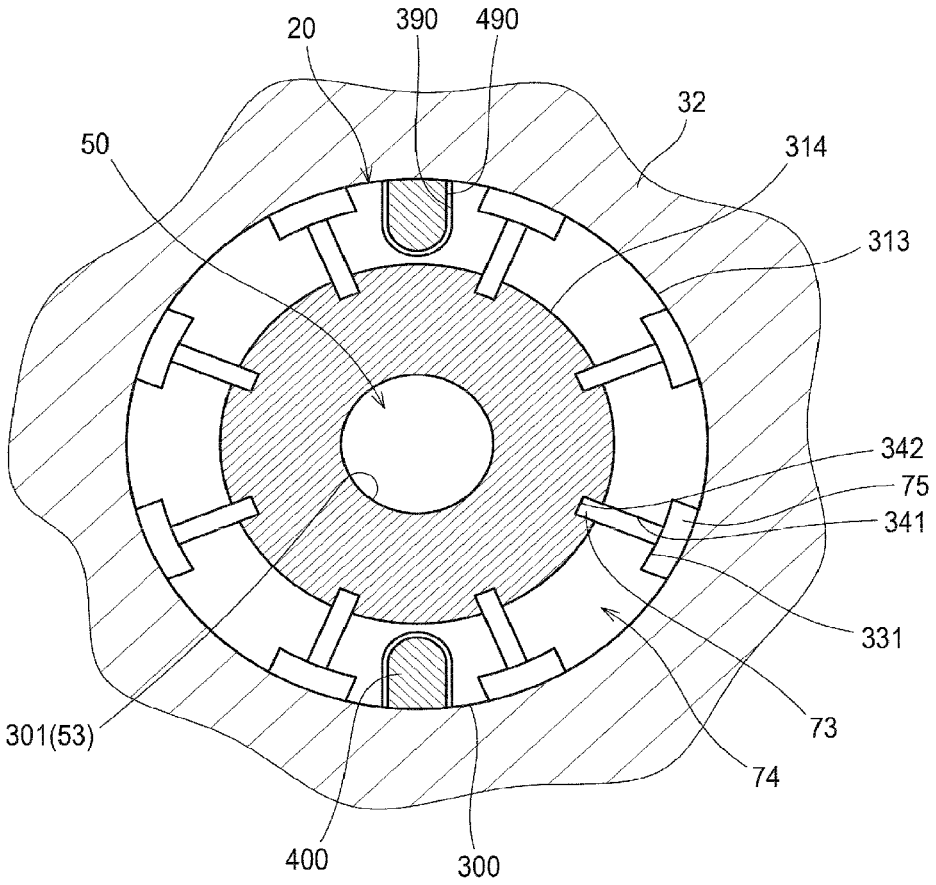
FIG. 22 is a cross-sectional view taken along line A-A in FIG. 21.
Figure 23:
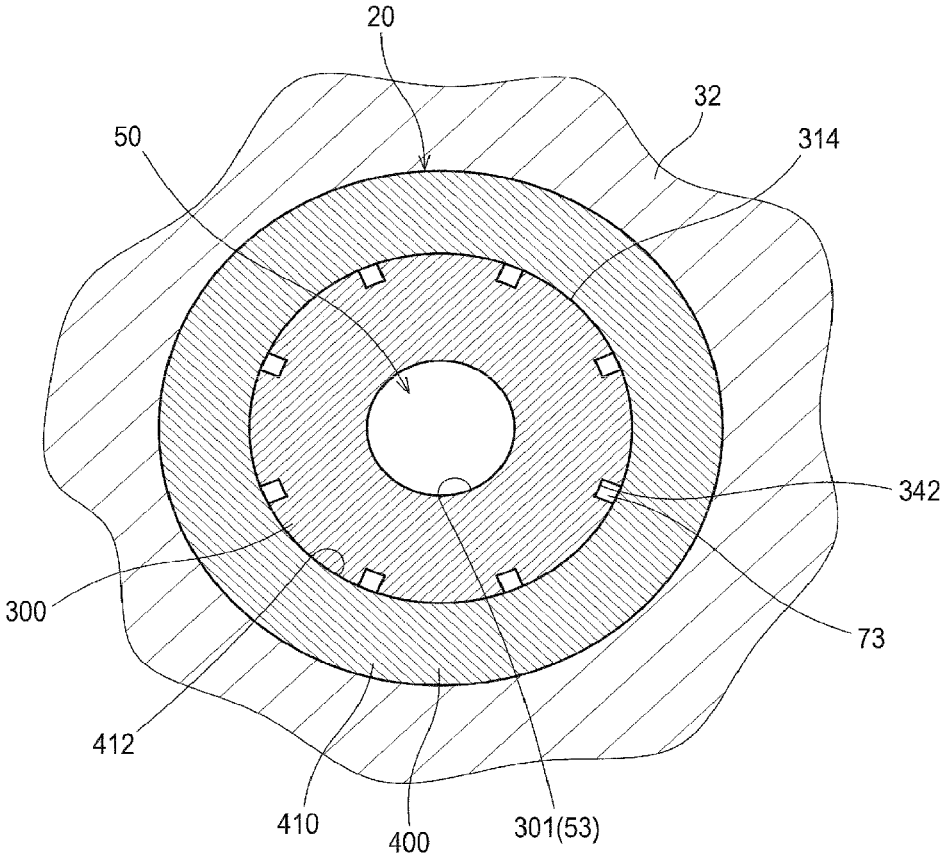
FIG. 23 is a cross-sectional view taken along line B-B in FIG. 21.

The gases flowing into the eight axial communication gas flow paths 75 pass through these axial communication gas flow paths 75, then once merge in the circular gas flow path 74, and thereafter are further evenly distributed and supplied to the eight axial gas flow paths 73 (FIGS. 22 and 23).

Further, the gas branches from each of the eight axial gas flow paths 73 to two adjacent gas flow paths 71*a* and 71*b*.

Then, the gas flows into each of the mixing parts 21 from the corresponding adjacent gas flow paths 71*a* and 71*b* via the gas inlets 72*a* and 72*b*.

That is, for each mixing part 21, the gas is supplied from the adjacent gas flow paths 71*a* and 71*b* via the gas inlets 72*a* and 72*b*, the liquid is supplied from the adjacent liquid flow path 51 via the liquid inlet 52, and the gas and the liquid are mixed in the mixing part 21.

Here, also in the case of the present embodiment, the liquid inlet 52 is arranged at a position corresponding to the merging part 22 of the gases supplied to the mixing part 21 from the adjacent gas flow paths 71*a* and 71*b* via the gas inlets 72*a* and 72*b*. Therefore, the liquid can be effectively foamed by an airflow. That is, for example, as described in the first embodiment, an action is generated in which the liquid column is formed by the liquid supplied to the mixing part 21 from the adjacent liquid flow path 51, this liquid column swings at high speed alternately in a direction away from the adjacent gas flow path 71*b* and a direction away from the adjacent gas flow path 71*a*, and the liquid column intermittently generates fine foam.

Therefore, it is possible to mix a gas and liquid satisfactorily to generate sufficiently uniform foam.

In addition, individual mixing parts 21 are arranged in correspondence to the respective adjacent liquid flow paths 51. Therefore, the escape of a gas and liquid from the mixing part 21 is restricted, so that the gas and the liquid in the mixing part 21 can be mixed more reliably.

By arranging a plurality of dedicated adjacent gas flow paths 71 in correspondence to each mixing part 21, the escape of the gas and the liquid from the mixing part 21 is further restricted, so that the gas and the liquid in the mixing part 21 can be mixed more reliably.

In addition, since gas supply directions from the pair of adjacent gas flow paths 71*a* and 71*b* to the corresponding mixing part 21 are opposed to each other, the airflows can be more satisfactorily pushed each other at the merging part 22. Therefore, fine foam can be intermittently generated while the swing of the liquid column as described above is more reliably performed.

Note that the foam may also be generated in the adjacent foam flow path 91 and the enlarged foam flow path 93, in addition to the mixing part 21.

That is, the foam generated in the mixing part 21 and the adjacent foam flow path 91 merge to the enlarged foam flow path 93, and the foam may become finer here as well.

The foam is discharged from the discharge port 41 to the outside from the enlarged foam flow path 93, via the flow path 32*d* and the internal space of the nozzle part 40.

According to the third embodiment as described above as well, since the liquid inlet 52 is arranged at a position corresponding to the merging part 22 of the gases supplied to the mixing part 21 from the plurality of adjacent gas flow paths 71 via the gas inlet 72, the liquid can be effectively foamed by an airflow, by causing the liquid column to swing as described above. Therefore, it is possible to mix a gas and liquid satisfactorily to generate sufficiently uniform foam.

Fourth Embodiment

Figure 28:
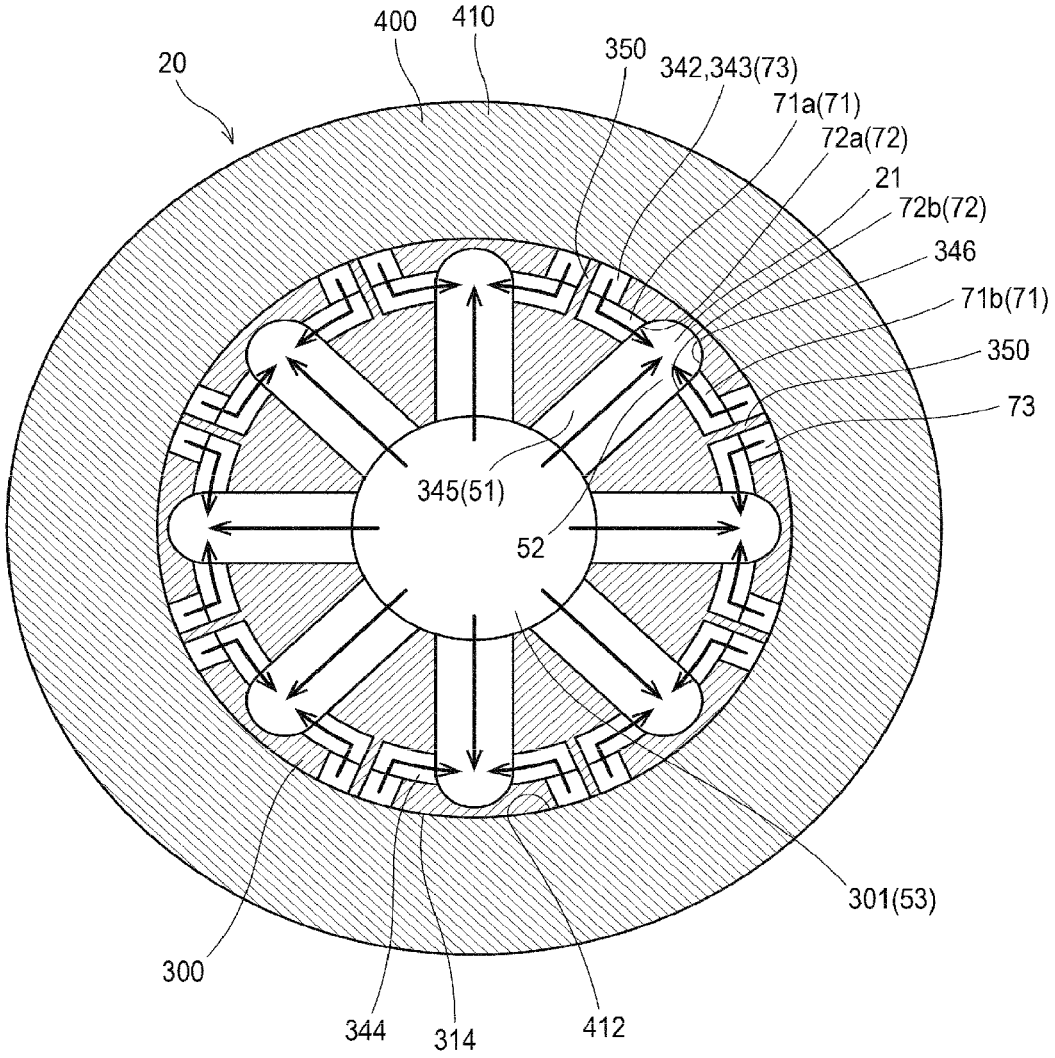
FIG. 28 is a cross-sectional view of a foam discharger according to a fourth embodiment.

Next, a foam discharger according to a fourth embodiment will be described with reference to FIG. 28. The foam discharger according to the present embodiment is different from the foam discharger 100 according to the above-described third embodiment in that a foamer mechanism 20 has a partition 350, and is configured similarly to the foam discharger 100 according to the third embodiment in other respects.

In the case of the present embodiment, a first member 300 has the partition 350. While an axial gas flow path 73 in the third embodiment is divided into two by the partition 350, an adjacent gas flow path 71*a* and an adjacent gas flow path 71*b* arranged adjacent to each other in the third embodiment are partitioned from each other.

Therefore, each axial gas flow path 73 is a dedicated flow path for each of the adjacent gas flow paths 71*a* and 71*b*, as in the above-described second embodiment.

According to the present embodiment, it can be expected that pressure of a gas supplied from the adjacent gas flow paths 71*a* and 71*b* to one mixing part 21 is more stable. Therefore, it can be expected that fine and uniform foam can be generated more stably.

Further, as compared to a case where each axial gas flow path 73 is a flow path shared by a pair of adjacent gas flow paths 71 (the third embodiment), dependence on an amount of the gas and liquid supplied to the mixing part 21 per unit time is reduced regarding the uniformity of the fineness of the foam.

Further, magnitude of a force required to push down a head member 30 is reduced as compared with the case where each axial gas flow path 73 is a flow path shared by a pair of adjacent gas flow paths 71 (the third embodiment).

<Modification 1>

Figure 29A:
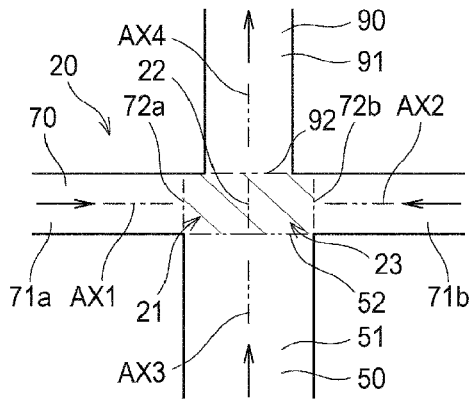
FIG. 29A is a schematic view for explaining a foam discharger according to Modification 1.

The case of Modification 1 shown in FIG. 29A is different from the above-described first embodiment in that a flow path area of an adjacent foam flow path 91 is smaller than an inner cavity cross-sectional area of the mixing part 21 orthogonal to an axis AX4 of the adjacent foam flow path 91, and a flow path area of the adjacent gas flow path 71 is smaller than a flow path area of an adjacent liquid flow path 51. Other respects are similar to the first embodiment described above.

In the case of the present modification, among surfaces defining the mixing part 21, a surface having a foam outlet 92 includes the foam outlet 92 and a wall surface around the foam outlet 92.

<Modification 2>

Figure 29B:
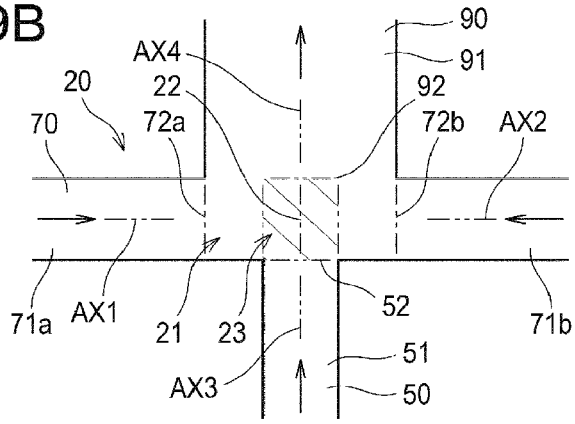
FIG. 29B is a schematic view for explaining a foam discharger according to Modification 2.

The case of Modification 2 shown in FIG. 29B is different from the above-described first embodiment in that an inner cavity cross-sectional area of the mixing part 21 orthogonal to an axis AX3 of the adjacent liquid flow path 51 is larger than a flow path area of the adjacent liquid flow path 51, and a flow path area of the adjacent gas flow path 71 is larger than a flow path area of the adjacent liquid flow path 51. Other respects are similar to the first embodiment described above.

In the case of the present modification, among surfaces defining the mixing part 21, a surface having a liquid inlet 52 includes the foam outlet 92 and a wall surface around the liquid inlet 52.

<Modification 3>

Figure 29C:
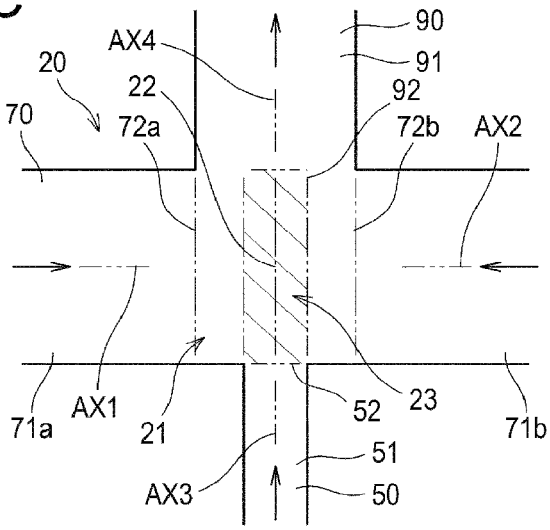
FIG. 29C is a schematic view for explaining a foam discharger according to Modification 3.

The case of Modification 3 shown in FIG. 29C is different from Modification 2 in that a flow path area of the adjacent gas flow path 71 is larger than a flow path area of the adjacent liquid flow path 51, and other respects are similar to Modification 2 described above.

<Modification 4>

Figure 30A:
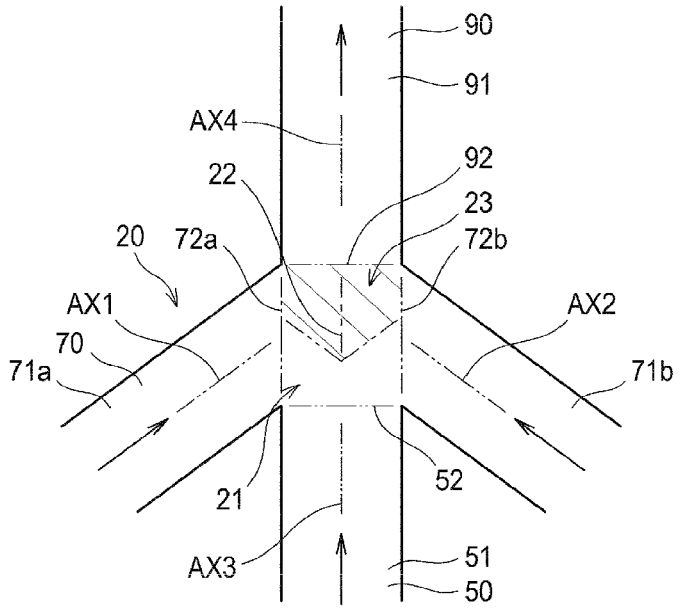
FIG. 30A is a schematic view for explaining a foam discharger according to Modification 4.

The case of Modification 4 shown in FIG. 30A is different from the first embodiment described above in that an axis AX1 of the adjacent gas flow path 71*a* and an axis AX2 of the adjacent gas flow path 71*b* intersect at an angle of less than 90 degrees with respect to an axis AX3 of the adjacent liquid flow path 51, and a gas inlet 72*a* and a gas inlet 72*b* are opposed to each other in parallel. Other respects are similar to the first embodiment described above. Gas flow directions from the adjacent gas flow paths 71*a* and 71*b* to the mixing part 21 are forward with respect to a liquid flow direction from the adjacent liquid flow path 51 to the mixing part 21.

<Modification 5>

Figure 30B:
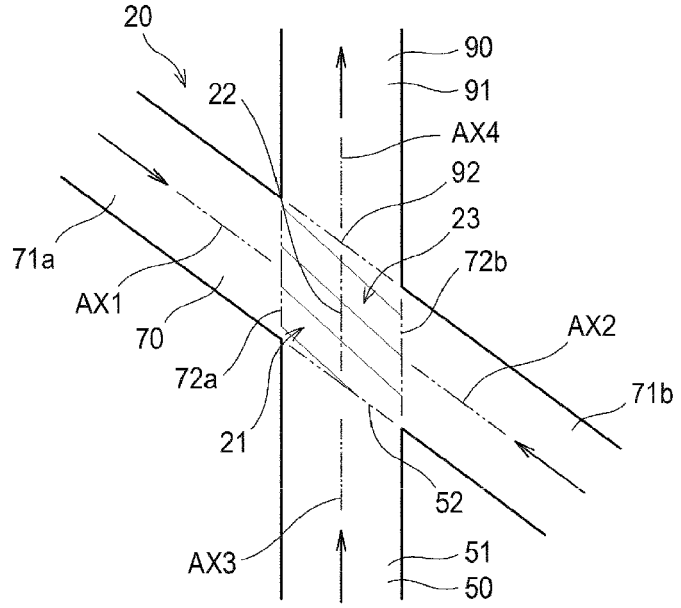
FIG. 30B is a schematic view for explaining a foam discharger according to Modification 5.

The case of Modification 5 shown in FIG. 30B is different from Modification 4 in that a gas flow direction from the adjacent gas flow path 71*a* to the mixing part 21 is not forward but reverse to a liquid flow direction from the adjacent liquid flow path 51 to the mixing part 21. Other respects are similar to Modification 4 described above.

<Modification 6>

Figure 31A:
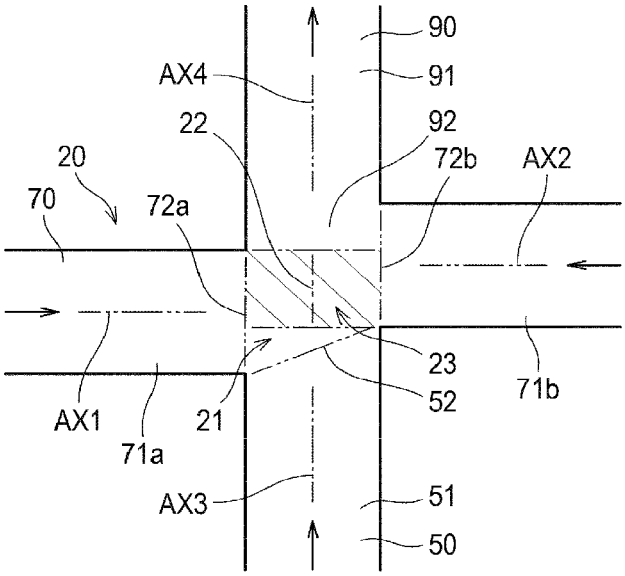
FIG. 31A is a schematic view for explaining a foam discharger according to Modification 6.

In the case of Modification 6 shown in FIG. 31A, the axis AX1 of the adjacent gas flow path 71*a* and an axis AX2 of the adjacent gas flow path 71*b* are parallel to each other, but are arranged at positions shifted from each other. The gas inlet 72*a* and the gas inlet 72*b* are opposed to each other in parallel, but a part of the gas inlet 72*a* and a part of the gas inlet 72*b* are opposed to each other, and remaining parts are not opposed to each other. The case of this modification is also similar the first embodiment described above in other respects.

In the case of this modification, a dimension of a gas-liquid contact region 23 in directions of axes AX3 and AX4 of the adjacent liquid flow path 51 and the adjacent foam flow path 91 is smaller than that in the first embodiment.

<Modification 7>

Figure 31B:
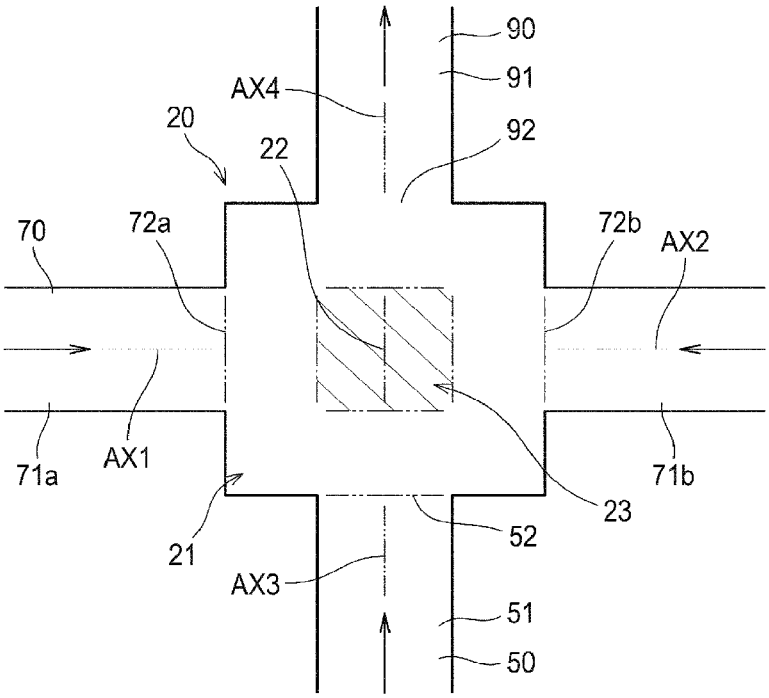
FIG. 31B is a schematic view for explaining a foam discharger according to Modification 7.

In the case of Modification 7 shown in FIG. 31B, among surfaces defining the mixing part 21, a surface having the liquid inlet 52, a surface having the gas inlet 72*a*, a surface having the gas inlet 72*b*, and a surface having the foam outlet 92 each include a peripheral wall surface.

The case of this modification is also similar the first embodiment described above in other respects.

<Modification 8>

Figure 32:
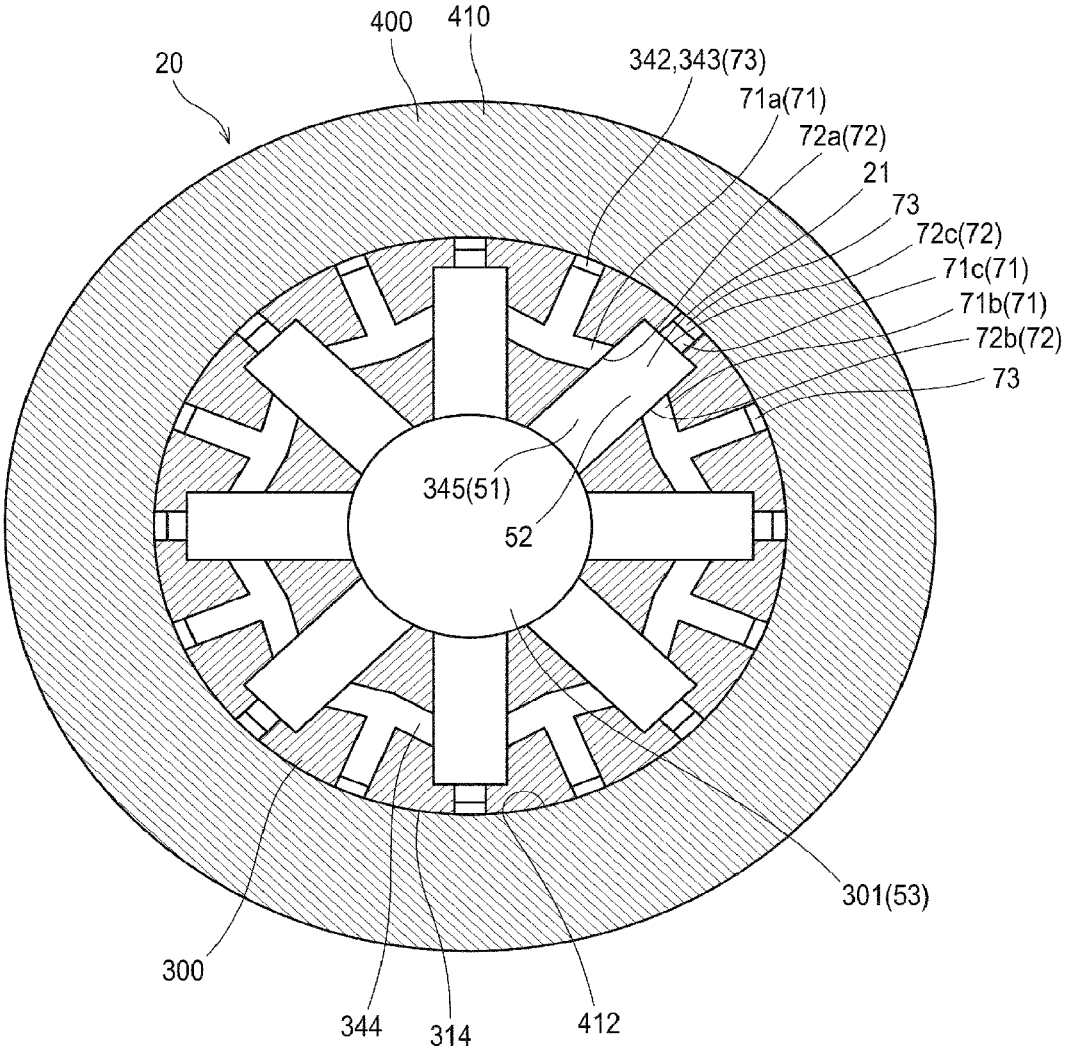
FIG. 32 is a schematic view for explaining a foam discharger according to Modification 8.

In the case of Modification 8 shown in FIG. 32, three adjacent gas flow paths 71 (adjacent gas flow paths 71*a*, 71*b*, and 71*c*) are arranged in correspondence to one mixing part 21. The three adjacent gas flow paths 71 corresponding to one mixing part 21 individually extend, for example, on a same plane.

The adjacent gas flow path 71*a* is arranged at a position opposed to the adjacent liquid flow path 51 with the mixing part 21 as a reference.

As shown in FIG. 32, the gas inlet 72*a* of the adjacent gas flow path 71*a*, the gas inlet 72*a* that is the gas inlet 72 of the adjacent gas flow path 71*a*, the gas inlet 72*b* that is the gas inlet 72 of the adjacent gas flow path 71*b*, and a gas inlet 72*c* that is a gas inlet 72 of the adjacent gas flow path 71*c*, are preferably arranged at substantially equal angular intervals with a center of the mixing part 21 as a reference. This allows a gas to be evenly supplied from each adjacent gas flow path 71 to the mixing part 21.

Further, it is preferable that axes of these three adjacent gas flow paths 71 are arranged at substantially equal angular intervals with the center of the mixing part 21 as a reference such that gas supply directions to one mixing part 21 from the three adjacent gas flow paths 71 corresponding to the mixing part 21 are arranged at equal angular intervals. Therefore, a peripheral circumferential groove 344 is formed in a bent line shape at a downstream end of the axial gas flow path 73. Also by arranging the gas supply directions to one mixing part 21 from the three adjacent gas flow paths 71 corresponding to the mixing part 21 at equal angular intervals, a gas can be evenly supplied from each adjacent gas flow path 71 to the mixing part 21.

In the case of this modification, as compared with a case where the number of adjacent gas flow paths 71 corresponding to one mixing part 21 is two, the number of times the liquid column swings per unit time increases, and the number of pieces of foam generated per unit time increases (this point is similar to the above-described second embodiment). Therefore, it is possible to generate finer foam.

Note that, in each of the above-described embodiments and modifications, each component of the foam discharger 100 and the foam discharge cap 200 does not need to exist independently of each other. It is allowed that a plurality of components are formed as one member, that one component is formed by a plurality of members, that one component is part of another component, that a part of a certain component and a part of another component are overlapped, and the like.

The present invention is not limited to the above-described embodiments and modifications, but includes various aspects of modifications and improvements as long as an object of the present invention is achieved.

For example, a diameter of the adjacent liquid flow path 51 may be reduced (reduced gradually (in a tapered shape) or step by step) toward the liquid inlet 52.

Further, a diameter of the adjacent gas flow path 71 may be reduced (reduced gradually (in a tapered shape) or step by step) toward the gas inlet 72.

Further, the foam discharger 100 may include a mesh as needed. For example, in the second embodiment and the third embodiment, a cylindrical member provided with a mesh at one end or both ends can be arranged in the recess 411 of the second member 400.

Further, when a pair of adjacent gas flow paths 71*a* and 71*b* are arranged for one mixing part 21, an opening area of the gas inlet 72*a* and an opening area of the gas inlet 72*b* may be slightly different. This causes pressure of an airflow supplied from the gas inlet 72*a* to the mixing part 21 and pressure of a gas flow supplied from the gas inlet 72*b* to the mixing part 21 to become unbalanced from an initial state, so that it can be expected that the swing of the liquid column as described above can be started more quickly.

Fifth Embodiment

Meanwhile, as a foam discharger that generates and discharges foam from a liquid, for example, there is a squeeze foamer described in Patent Document 2.

The squeeze foamer of Patent Document 2 includes a mixing unit that mixes liquid and air to generate foam, and a discharge hole that discharges foam from the mixing unit, and a thread-shaped or bellows-shaped uneven portion is formed on an inner surface of a discharge port.

According to the study by the present inventors, the technique of Patent Document 2 cannot always discharge sufficiently fine foam.

The present embodiment relates to a foam discharger having a structure capable of more reliably discharging fine foam, and a liquid-filled foam discharger (liquid-filled product).

The present embodiment relates to a foam discharger including a foam generation unit that generates foam from a liquid, a foam flow path through which the foam generated by the foam generation unit passes, and a discharge port that discharges the foam that has passed through the foam flow path. The foam flow path includes: an upstream flow path; and a narrow flow path arranged adjacent on a downstream side of the upstream flow path and having a smaller flow path area than that of the upstream flow path, the narrow flow path is arranged at a center part of the upstream flow path when viewed in an axial direction at an upstream end of the narrow flow path, and an orthogonal cross-sectional shape of the narrow flow path orthogonal to a longitudinal direction of the narrow flow path is a flat shape.

According to the present embodiment, it is possible to more reliably discharge fine foam.

The present embodiment can be realized as a combination with the above-described first to fourth embodiments or modifications thereof, and can also be realized with the present embodiment alone without assuming the configuration of the first to fourth embodiments or modifications thereof.

The foam generation unit described in the present embodiment has a configuration corresponding to the foamer mechanism 20 described in the first to fourth embodiments or modifications thereof. For example, a structure similar to that of the foamer mechanism 20 described in the first to fourth embodiments or modifications thereof can be employed. Therefore, the foam generation unit is denoted by the same reference numeral as the foamer mechanism 20.

However, the foam generation unit 20 in the present embodiment can have a different structure from the foamer mechanism 20 described in the first to fourth embodiments or modifications thereof, and may have other widely known structures.

Hereinafter, the present embodiment will be described in more detail with reference to FIGS. 36 to 39.

Figure 36:
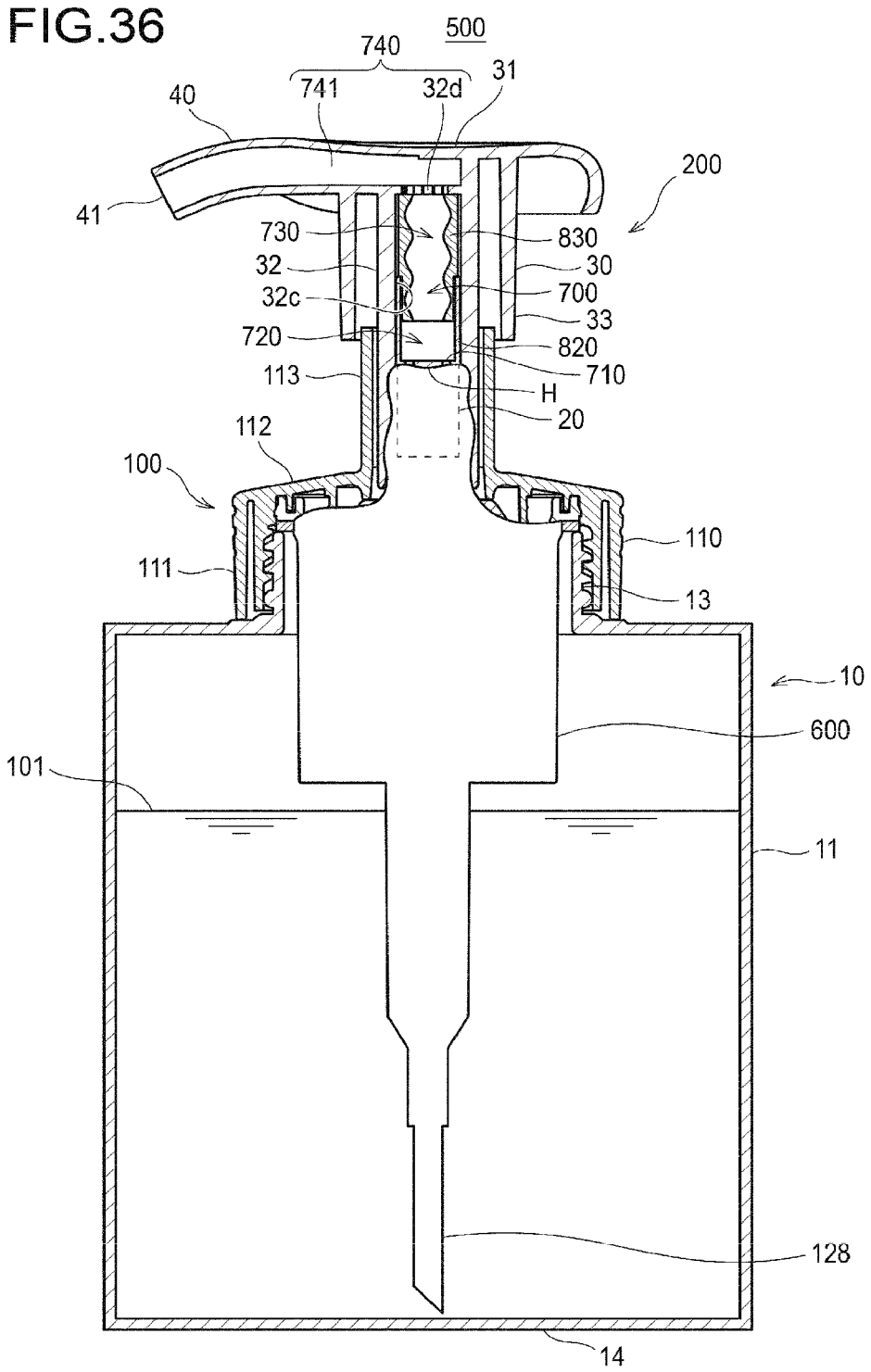
FIG. 36 is a front cross-sectional view of a foam discharger according to a fifth embodiment.
Figure 37:
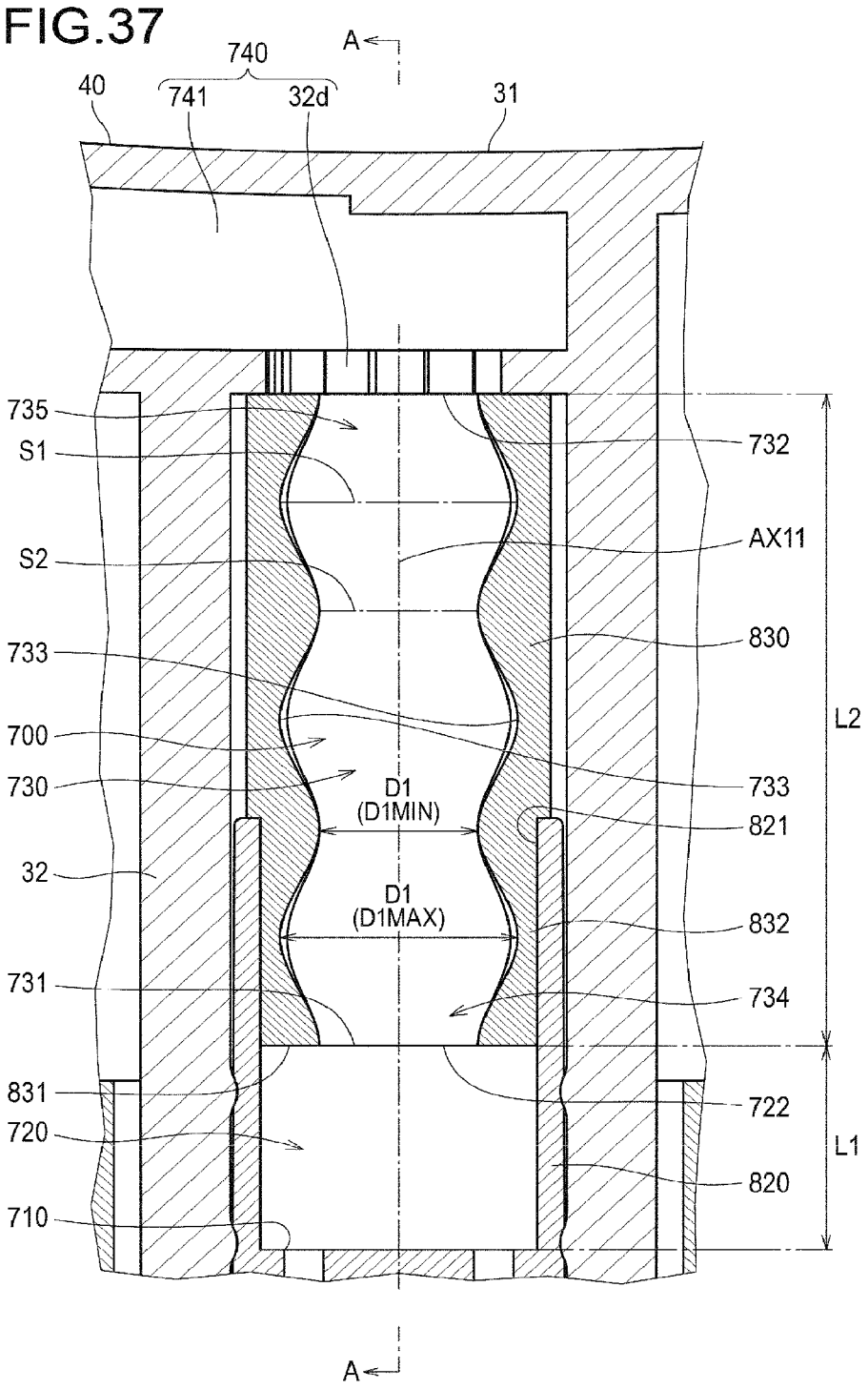
FIG. 37 is a partially enlarged view of FIG. 36.
Figure 38:
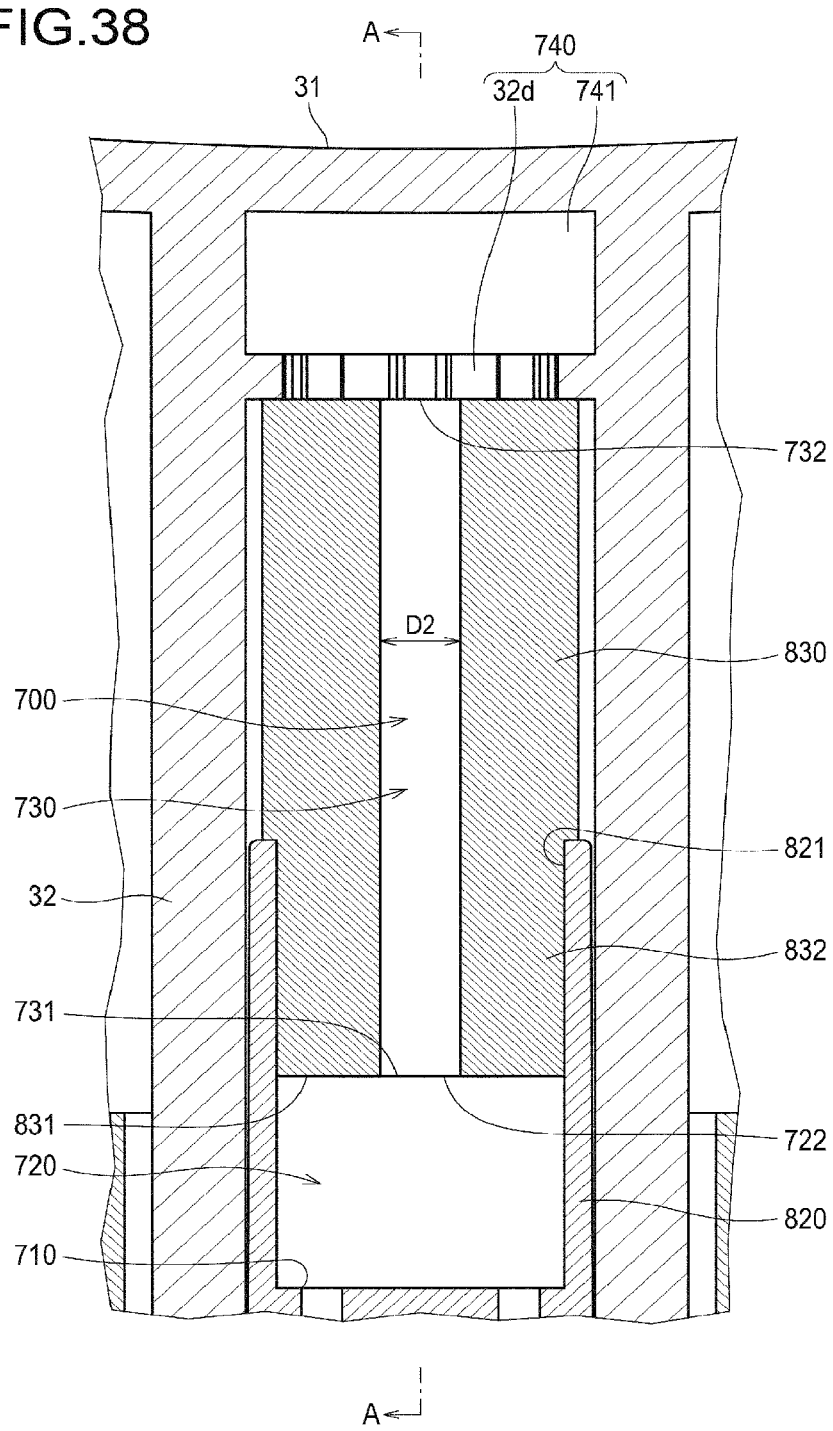
FIG. 38 is a cross-sectional view taken along line A-A in FIG. 37.

A downward direction in FIGS. 36 to 38 is downward, and an upward direction is upward. That is, also in the case of the present embodiment, the downward direction (downward) is a direction of gravity in a state where a bottom part 14 of a foam discharger 100 is placed on a horizontal placing surface and the foam discharger 100 stands alone.

In FIG. 36, in a configuration of a foam discharge cap 200 (described later) provided to the foam discharger 100, only an outline is shown for a portion below a curve H.

FIG. 37 is a partially enlarged view of FIG. 36, and is also a cross-sectional view taken along line A-A in FIG. 38.

Figure 39:
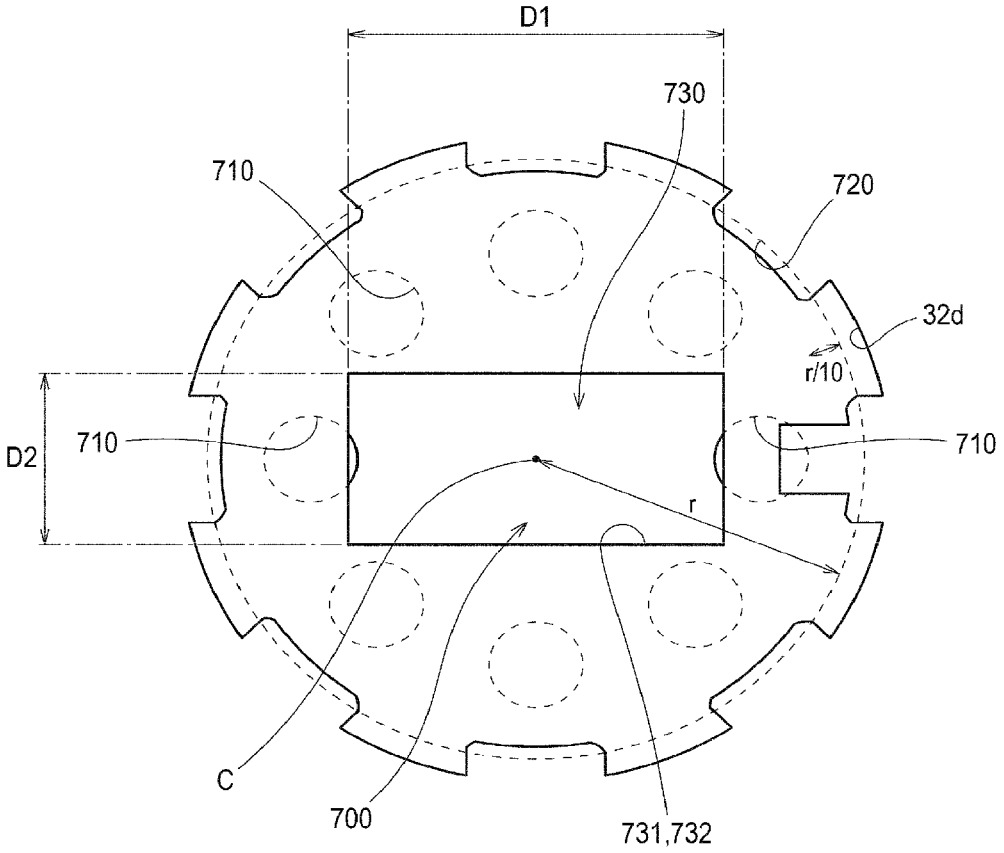
FIG. 39 is a view showing a planar positional relationship between each part of a foam flow path and a foam outlet from a foam generation unit.

FIG. 39 shows a planar shape of each part of a foam flow path 700 and a foam outlet 710 from the foam generation unit 20. More specifically, FIG. 39 shows outlines of an upstream end 731 and a downstream end 732 of a narrow flow path 730 (in the present embodiment, these two outlines coincide with each other), an outline of an upstream flow path 720, a plurality of foam outlets 710, and a flow path 32*d* that constitutes a part of a downstream flow path 740.

As shown in any of FIGS. 36 to 39, the foam discharger 100 according to the present embodiment includes: the foam generation unit 20 (FIG. 36) that generates foam from liquid 101; the foam flow path 700 through which the foam generated by the foam generation unit 20 passes; and a discharge port 41 that discharges the foam that has passed through the foam flow path 700.

As shown in FIGS. 37 and 38, the foam flow path 700 includes the upstream flow path 720, and the narrow flow path 730 that is arranged adjacent on a downstream side of the upstream flow path 720 and has a flow path area smaller than that of the upstream flow path 720.

As shown in FIG. 39, when viewed in an axial direction at the upstream end 731 of the narrow flow path 730 (a direction of an axis AX11 shown in FIGS. 37 and 38), the narrow flow path 730 is arranged at a center part of the upstream flow path 720.

An orthogonal cross-sectional shape of the narrow flow path 730 orthogonal to a longitudinal direction of the narrow flow path 730 is a flat shape.

According to the present embodiment, when the foam generated by the foam generation unit 20 passes through the narrow flow path 730 having the flat orthogonal cross-sectional shape, the foam is applied with a shear force due to viscous resistance between an inner peripheral surface of the narrow flow path 730 and the foam, which fines the foam. More specifically, it is considered that the foam is fined by a repeated action in which the foam is stretched in the longitudinal direction of the narrow flow path 730 and the foam is divided when the foam passes through the narrow flow path 730. Since the orthogonal cross-sectional shape of the narrow flow path 730 is flat, a maximum distance between the foam and the inner peripheral surface of the narrow flow path 730 can be reduced, so that the foam in the narrow flow path 730 is sheared more reliably.

Moreover, the narrow flow path 730 is arranged at the center part of the upstream flow path 720 when viewed in the axial direction at the upstream end 731 of the narrow flow path 730. Therefore, since a flow rate of the foam is moderately reduced at a stage where the foam flows into the narrow flow path 730 from the upstream flow path 720, the foam is suppressed from passing as it is through the narrow flow path 730, and the foam in the narrow flow path 730 is sheared more reliably.

Therefore, the foam can be fined and discharged from the discharge port 41 more reliably.

Further, according to the study by the present inventors, it is possible to fine and discharge the foam regardless of the flow rate of the foam passing through the foam flow path 700 (described later).

In the case of the present embodiment, the axial direction at the upstream end 731 of the narrow flow path 730 is the vertical direction. Therefore, as shown in FIG. 39, arrangement of the upstream flow path 720 and the narrow flow path 730 in plan view of the narrow flow path 730 and the upstream flow path 720 is arrangement of the narrow flow path 730 and the upstream flow path 720 when viewed in the axial direction at the upstream end 731 of the narrow flow path 730.

The center part of the upstream flow path 720 is a region avoiding a peripheral part of the upstream flow path 720. As shown in FIG. 39, when a radius (or a circle-equivalent radius) of the upstream flow path 720 when viewed in the axial direction at the upstream end 731 of the narrow flow path 730 is r, the peripheral part of the upstream flow path 720 can be set to a region of r/10 from an outer periphery of the upstream flow path 720, for example. That is, when viewed in the axial direction at the upstream end 731 of the narrow flow path 730, the foam flow path 700 preferably has the narrow flow path 730 in a circular region having a radius of 9r/10 with a center C of the upstream flow path 720 as a reference. Note that the present invention does not exclude that the foam flow path 700 has the narrow flow path 730 arranged in the region of r/10 from the outer periphery of the upstream flow path 720, and the foam flow path 700 may have a narrow flow path 730 arranged at the peripheral part of the upstream flow path 720, separately from the narrow flow path 730 arranged at the center part of the upstream flow path 720.

The number of the narrow flow paths 730 included in the foam flow path 700 may be one or more, but is preferably one. When the number of the narrow flow paths 730 is one, the center C of the upstream flow path 720 is preferably located inside an outline of the narrow flow path 730 when viewed in the axial direction at the upstream end 731 of the narrow flow path 730. Even when the number of the narrow flow paths 730 is plural, it is preferable that the center C of the upstream flow path 720 is located inside an outline of one narrow flow path 730 among the plurality of narrow flow paths 730 when viewed in the axial direction at the upstream end 731 of the narrow flow path 730.

Further, the fact that the orthogonal cross-sectional shape of the narrow flow path 730 orthogonal to the longitudinal direction of the foam flow path 700 is a flat shape means that a dimension D1 (FIGS. 37 and 39) in a major axis direction in the orthogonal cross-sectional shape is larger than a dimension D2 (FIGS. 38 and 39) in a minor axis direction in the orthogonal cross-sectional shape. Examples of the orthogonal cross-sectional shape include, for example, a rectangular shape or a rounded rectangular shape, but may be a polygonal shape other than a quadrangle, a polygonal shape with rounded corners, an elliptical shape, an oval shape, or the like.

In the case of the present embodiment, as shown in FIG. 39, the orthogonal cross-sectional shape is a rectangular shape. A shape of the upstream end 731 and the downstream end 732 of the narrow flow path 730 is also a rectangular shape.

In the present embodiment, the upstream end 731 and the downstream end 732 have a same shape, and the upstream end 731 and the downstream end 732 coincide with each other in plan view. However, the present invention is not limited to this example, and the upstream end 731 and the downstream end 732 may have different shapes, and the upstream end 731 and the downstream end 732 may be arranged at positions shifted from each other in plan view.

Preferably, a ratio D1/D2 between the dimension D1 in the major axis direction and the dimension D2 in the minor axis direction in the orthogonal cross-sectional shape is equal to or more than 1.5. By setting such a ratio, the foam can be more reliably fined and the size of the foam can be made more uniform.

The ratio D1/D2 is more preferably equal to or more than 1.7. The ratio D1/D2 is preferably equal to or less than 12, and more preferably equal to or less than 8.

In the case of the present embodiment, as shown in FIG. 37, the dimension D1 in the major axis direction in the orthogonal cross-sectional shape of the narrow flow path 730 repeatedly expands and contracts from the upstream side toward the downstream side. Adopting such a configuration allows the foam to be further fined.

The reason for being able to fine the foam by repeating expansion and contraction of the dimension D1 in the major axis direction is unclear. However, the fact that division of the foam is accelerated by repeated increase and decrease of the flow rate of the foam in accordance with the change in the flow path area when the foam passes through the narrow flow path 730 is considered to contribute to the fineness of the foam.

More specifically, in the case of the present embodiment, the expansion and contraction of the dimension D1 is repeated three times. However, the number of times for repeating the expansion and contraction of the dimension D1 may be two, or equal to or more than four. Further, the number of times of the expansion and contraction of the dimension D1 may be one.

The present invention is not limited to these examples, and the dimension D1 in the major axis direction in the orthogonal cross-sectional shape of the narrow flow path 730 may be constant. Further, the narrow flow path 730 may be linearly formed, and the orthogonal cross-sectional shape may be constant.

In the case of the present embodiment, as shown in FIG. 37, the dimension D1 in the major axis direction of an upstream end part 734 of the narrow flow path 730 increases from the upstream end 731 toward the downstream side. In other words, the upstream end part 734 has a shape in which the upstream end 731 is narrowed. Adopting such a configuration can further uniformalize the size of the foam.

The reason for being able to uniformalize the size of the foam by increasing the dimension D1 in the major axis direction from the upstream end 731 toward the downstream side at the upstream end part 734 is unclear. However, it seems to be because the foam is uniformly fined when the foam flowing into the narrow flow path 730 is equally decelerated at the upstream end 731, before flowing through the narrow flow path 730.

In the case of the present embodiment, the dimension D1 in the major axis direction of a downstream end part 735 of the narrow flow path 730 increases from the downstream end 732 toward the upstream side.

In the case of the present embodiment, in a cross section (that is, the cross section in FIG. 37) along the longitudinal direction of the narrow flow path 730 and the major axis direction, an outline 733 of the narrow flow path 730 at both ends in the major axis direction has a wavy curved shape. Adopting such a configuration can further uniformalize the size of the foam.

In a cross section (the cross section in FIG. 37) along the longitudinal direction of the narrow flow path 730 and the major axis direction, regarding the outline 733 of the narrow flow path 730 at both ends in the major axis direction, a maximum inclination angle with the longitudinal direction as a reference is less than 45 degrees. Adopting such a configuration can further uniformalize the size of the foam.

It is preferable that a ratio S1/S2 between a maximum value S1 (FIG. 37) and a minimum value S2 (FIG. 37) of a flow path area of the narrow flow path 730 is equal to or less than 2. Adopting such a configuration can further uniformalize the size of the foam. The ratio S1/S2 is more preferably equal to or less than 1.7.

In the case of the present embodiment, the dimension D2 (FIG. 38) in the minor axis direction in the orthogonal cross-sectional shape is constant. Therefore, a ratio D1MAX/D1MIN between a maximum value D1MAX (FIG. 37) and a minimum value D1MIN (FIG. 37) of the dimension D1 in the major axis direction is preferably equal to or less than 2, and the ratio D1MAX/D1MIN is more preferably equal to or less than 1.7.

It is preferable that the dimension D2 (FIG. 38) in the minor axis direction in the orthogonal cross-sectional shape is equal to or more than 0.5 mm and equal to or less than 4 mm. By adopting such a configuration, the foam can be more reliably fined and the size of the foam can be made more uniform.

The dimension D2 is more preferably equal to or more than 1.0 mm and equal to or less than 3.0 mm.

A length dimension L2 (FIG. 37) of the narrow flow path 730 is preferably equal to or more than 3 mm. By adopting such a configuration, the foam can be more sufficiently sheared in the narrow flow path 730, and the foam can be more reliably made finer.

More preferably, the length dimension L2 is equal to or more than 5 mm. The length dimension L2 is preferably equal to or less than 40 mm, and more preferably equal to or less than 20 mm.

It is preferable that a length dimension L1 (FIG. 37) of the upstream flow path 720 is equal to or more than 1 mm. By adopting such a configuration, individual foam is formed as independent foam in the upstream flow path 720 (individual foam is defined), and the foam can flow into the narrow flow path 730 to be sheared after an overall film thickness of the individual foam has been averaged. In other words, while a dynamic surface tension is large and a film thickness is uneven (oriented) immediately after generation of foam, the film thickness of the foam can be averaged in a process in which the foam passes through the upstream flow path 720 having a sufficient length before the foam flows into the narrow flow paths 730. Therefore, the foam can be more reliably made fine.

When the present embodiment is configured in combination with the above-described first to fourth embodiments or modifications thereof, a sufficient space for a swing of a liquid column as described above can be sufficiently secured, and the swing can be suitably realized by setting the length dimension L1 of the upstream flow path 720 to equal to or more than 1 mm.

More preferably, the length dimension L1 is equal to or more than 2 mm. The length dimension L1 is preferably equal to or less than 10 mm. Preferably, the length dimension L2 is longer than the length dimension L1.

At a boundary between a downstream end 722 of the upstream flow path 720 and the upstream end 731 of the narrow flow path 730, the flow path area preferably changes discontinuously. By adopting such a configuration, a flow rate of the foam can be more reliably reduced at a stage where the foam flows from the upstream flow path 720 to the narrow flow path 730. Therefore, the foam in the narrow flow path 730 can be sheared more reliably. Further, a space for sufficiently defining the foam in the upstream flow path 720 can be secured.

More specifically, a flow path area of the upstream end 731 of the narrow flow path 730 is preferably equal to or more than 1% and equal to or less than 40% of a flow path area of the downstream end 722 of the upstream flow path 720, and is more preferably equal to or more than 15% and equal to or less than 35%.

The foam flow path 700 further includes the downstream flow path 740 that is arranged adjacent on the downstream side of the narrow flow path 730 and has a larger flow path area than that of the narrow flow path 730.

Therefore, the foam that has passed through the narrow flow path 730 can be discharged from the discharge port 41 after the flow rate is sufficiently decelerated in the downstream flow path 740. Therefore, the foam discharged from the discharge port 41 can be easily received by a discharge target such as a hand, and foam breakage due to collision of the foam with the discharge target can be suppressed.

In the case of the present embodiment, the foam generation unit 20 has a plurality of foam outlets 710 each being open toward the upstream flow path 720. As an example, the foam generation unit 20 has eight foam outlets 710.

However, the present invention is not limited to this example, and the number of the foam outlets 710 may be one.

When the foam discharger 100 according to the present embodiment is realized in combination with the first to fourth embodiments or modifications thereof, a downstream end of an adjacent foam flow path 91 (a boundary with an enlarged foam flow path 93) is to be the foam outlet 710.

In addition, for example, a portion (lower part) on the upstream side of the enlarged foam flow path 93 is to be the upstream flow path 720.

As shown in FIG. 39, it is preferable that the narrow flow path 730 is arranged at a position closer to the center than an arrangement region of the plurality of foam outlets 710 when viewed in the axial direction at the upstream end 731 of the narrow flow path 730. That is, it is preferable that a center of each foam outlet 710 is arranged outside the outline of the narrow flow path 730 when viewed in the axial direction at the upstream end 731 of the narrow flow path 730.

As a result, a portion that inhibits a flow of the foam (for example, a lower end surface 831 of an upper member 830 described later) is to be present at the boundary between the upstream flow path 720 and the narrow flow path 730, and the foam can be sufficiently decelerated at the boundary between the upstream flow path 720 and the narrow flow path 730.

A flow path area at the upstream flow path 720 is larger than a total opening area of the plurality of foam outlets 710.

A flow path area at the upstream end 731 of the narrow flow path 730 is preferably equal to or larger than the total opening area of the plurality of foam outlets 710. This allows the foam discharged from the foam outlet 710 to flow smoothly (without receiving excessive pressure) into the narrow flow path 730. Therefore, foam breakage when the foam flows from the upstream flow path 720 to the narrow flow path 730 can be suppressed.

As shown in FIG. 36, the foam discharger 100 includes a storage container 10 that stores the liquid 101, and the foam discharge cap 200 that is detachably attached to the storage container 10.

Although a shape of the storage container 10 is not particularly limited, for example, the storage container 10 has a shape including a body part 11, a cylindrical mouth and neck part 13 connected above the body part 11, and the bottom part 14 closing a lower end of the body part 11. An upper end of the mouth and neck part 13 is formed with an opening.

A liquid-filled foam discharger (liquid-filled product) 500 according to the present embodiment includes the foam discharger 100 and the liquid 101 filled in the storage container 10.

Also in the present embodiment, the liquid 101 is similar to that in each of the above embodiments.

In the case of the present embodiment, the foam discharger 100 changes the liquid 101 into foam by bringing the liquid 101 stored in the storage container 10 at normal pressure into contact with a gas in the foam generation unit 20. The foam discharger 100 is, for example, a pump container that discharges foam by hand-pushing operation.

However, the present invention is not limited to this example, and the foam discharger may be a so-called squeeze bottle configured to discharge foam by squeezing a storage container, or may be an electric foam dispenser equipped with a motor or the like. Further, the foam discharger may be an aerosol container in which a liquid is filled in a storage container together with a compressed gas.

The foam discharge cap 200 includes: a cap member 110 provided detachably to the storage container 10; a pump part 600 provided to the cap member 110; a dip tube 128 to draw up the liquid 101 in the storage container 10 to the pump part 600; a head member 30 held by the pump part 600; and the foam generation unit 20 provided to the head member 30.

The cap member 110 includes: a mounting part 111 that is detachably mounted to the mouth and neck part 13 of the storage container 10 by a fastening method such as screwing; an annular closing part 112 closing an upper end of the mounting part 111; and an upright cylinder part 113 standing upward from a center part of the annular closing part 112.

The head member 30 includes: an operation receiving part 31 that receives a pushing operation by a user; an inner cylinder part 32 extending downward from the operation receiving part 31; an outer cylinder part 33 arranged around the inner cylinder part 32; and a nozzle part 40. A lower part of the inner cylinder part 32 is inserted into the upright cylinder part 113. An internal space of the inner cylinder part 32 and an in-nozzle foam flow path 741, which is an internal space of the nozzle part 40, communicate with each other via the flow path 32*d* formed at an upper end of the inner cylinder part 32. A downstream end of the in-nozzle foam flow path 741 is formed with the discharge port 41. The flow path 32*d* and the in-nozzle foam flow path 741 constitute the downstream flow path 740 of the foam flow path 700.

A space below the flow path 32*d* in the internal space of the inner cylinder part 32 is a holding part 32*c*. The holding part 32*c* houses the upper member 830 and a lower member 820, each will be described later. The lower member 820 and the upper member 830 constitute the foam outlet 710 of the foam generation unit 20, and the upstream flow path 720, and the narrow flow path 730 of the foam flow path 700.

Here, the lower member 820 can have a configuration similar to that of the second member 820 of the above-described second embodiment, and the lower member 820 is denoted by the same reference numeral as the second member 820.

The pump part 600 includes: a liquid supply pump that supplies the liquid 101 in the storage container 10 to the foam generation unit 20 when the head member 30 is pushed down by a pushing operation on the operation receiving part 31; and a gas supply pump that supplies a gas in the storage container 10 to the foam generation unit 20 when the head member 30 is pushed down. A structure of the pump part 600 is well known, and a detailed description thereof is not to be made in this specification.

The foam generation unit 20 has a gas-liquid contact part (not shown in the drawings) in which the liquid 101 supplied from the liquid supply pump and the gas supplied from the gas supply pump come into contact with each other. Note that the gas-liquid contact part can have a configuration similar to that of the mixing part 21 described in the above-described first to fourth embodiments or modifications thereof.

The liquid 101 and the gas are mixed at the gas-liquid contact part, and foam is generated. In the case of the present embodiment, as described above, the foam generation unit 20 has a plurality of foam outlets 710 each being open toward the upstream flow path 720. As an example, the foam generation unit 20 has a plurality of gas-liquid contact parts corresponding to the respective foam outlets 710.

Thus, the foam discharger 100 includes the storage container 10 that stores the liquid 101 and the mounting part 111 mounted to the storage container 10, and the mounting part 111 holds the foam generation unit 20, the foam flow path 700, and the discharge port 41.

By attaching the foam discharge cap 200 to the storage container 10, an opening at the upper end of the mouth and neck part 13 is closed by the foam discharge cap 200.

Note that the structure of the foam discharge cap 200 (including the pump part 600) described here is an example, and other widely known structures may be applied as the structure of the foam discharge cap 200 without departing from the gist of the present invention.

When a user performs one pushing operation (operation of pushing down the head member 30 from a top dead center to a bottom dead center) on the operation receiving part 31 of the head member 30, that is, performs a foam discharge operation, a fixed amount of foam is discharged from the foam discharger 100. Strictly speaking, when the discharge operation is performed after a long time interval, the amount of foam to be discharged is smaller than that of when the discharge operation is continuously performed.

Since the foam flow path is narrowed in the narrow flow path 730, the amount of foam remaining in a portion from the foam outlet 710 to the discharge port 41 can be reduced. Therefore, a larger proportion of the foam generated in the foam generation unit 20 in accordance with the discharge operation can be discharged from the discharge ports 41.

As shown in FIGS. 37 and 38, the lower member 820 includes, for example, a cylindrical portion having a recess 821 having a cylindrical shape being open upward. On a bottom surface of the recess 821, a plurality of foam outlets 710 are opened. In the case of the present embodiment, as shown in FIG. 39, eight foam outlets 710 are arranged at equal angular intervals on a peripheral part of the bottom surface of the recess 821.

As shown in FIGS. 37 and 38, the upper member 830 is formed in a vertically long column shape. At a center part of the upper member 830, a hole penetrating vertically through the upper member 830 is formed. An internal space of the hole constitutes the narrow flow path 730.

A lower part of the upper member 830 is a fitting part 832 that is fitted and fixed to an upper part of the recess 821 of the lower member 820.

The lower end surface 831 of the upper member 830 is arranged at a position separated upward from the bottom surface of the recess 821.

A lower part of the recess 821, that is, a space located in an interval between the lower end surface 831 of the upper member 830 and the recess 821 constitutes the upstream flow path 720.

As shown in FIG. 39, the plurality of foam outlets 710 are preferably arranged inside an outline of the upstream flow path 720 when viewed in the axial direction at the upstream end 731 of the narrow flow path 730.

A flow path area of the flow path 32*d* and a flow path area of the in-nozzle foam flow path 741 are larger than a flow path area of the narrow flow path 730. That is, the downstream flow path 740 is arranged adjacent on the downstream side of the narrow flow path 730, and has a larger flow path area than that of the narrow flow path 730.

In the case of the present embodiment, the foam discharger 100 does not include a mesh that fines the generated foam. Therefore, even when the liquid 101 contains a scrubbing agent, it is possible to suitably generate and discharge the foam.

However, the present invention is not limited to this example, and the foam discharger 100 may include a mesh that fines the generated foam. For example, a mesh can be arranged at a boundary between the foam generation unit 20 and the upstream flow path 720, and in this case, each lattice-shaped opening of the mesh is to be the foam outlet 710.

Each of FIGS. 40A, 40B, 40C, and 40D is a view showing a captured image of foam discharged by the foam discharger 100 according to the present embodiment. More specifically, the images shown in FIGS. 40A to 40D are images of the foam when a length dimension L1 is 5.7 mm, a length dimension L2 is 18 mm, a dimension D1MIN is 4.0 mm, a dimension D1MAX is 6.0 mm, a dimension D2 is 2.0 mm, an inner diameter of the foam outlet 710 is 1.0 mm, and an inner diameter of the upstream flow path 720 is 7.0 mm.

Whereas, each of FIGS. 48A, 48B, 48C, and 48D shows a captured image of foam discharged by a foam discharger (not shown in the drawings) according to a comparative embodiment.

The foam discharger according to the comparative embodiment is different from the foam discharger 100 according to the present embodiment in that the upper member 830 is not provided (that is, the narrow flow path 730 is not provided), and is configured similarly to the foam discharger 100 according to the present embodiment in other respects.

Figure 40B:
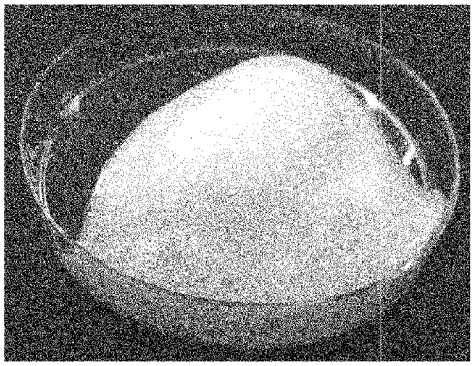
FIGS. 40A, 40B, 40C, and 40D each are views showing a captured image of foam discharged by the foam discharger according to the fifth embodiment.
Figure 40D:
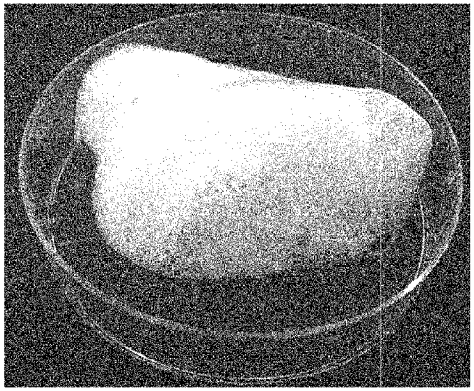
Figure 40A:
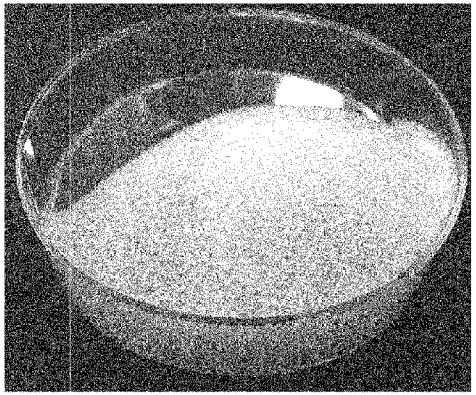
Figure 40C:
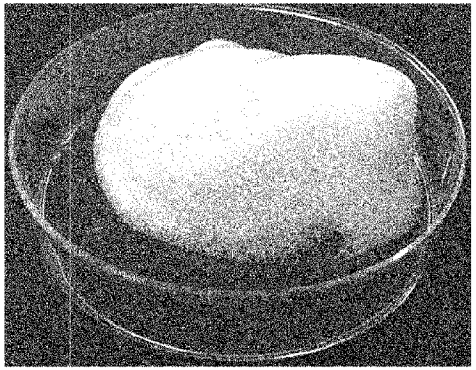
Figure 48A:
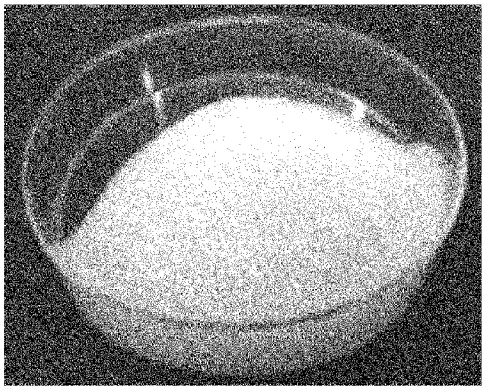
FIGS. 48A, 48B, 48C, and 48D each are views showing a captured image of foam discharged by a foam discharger according to a comparative embodiment of the fifth embodiment and a sixth embodiment.
Figure 48B:
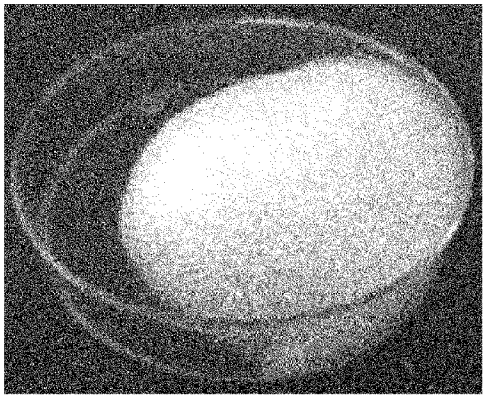
Figure 48C:
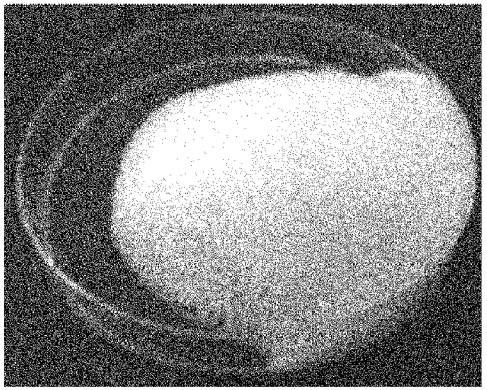
Figure 48D:
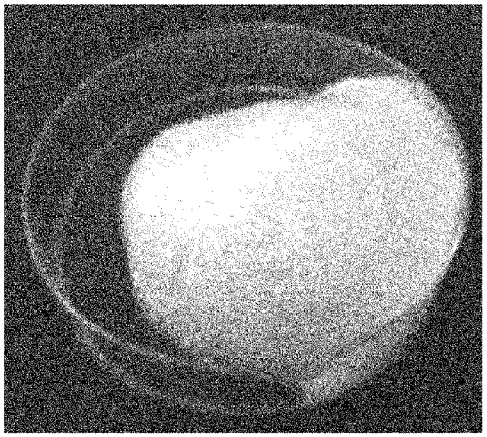

FIGS. 40A and 48A are images of foam discharged at a speed of pushing down the head member 30 (pushing speed) of 10 mm/sec. FIGS. 40B and 48B are images of foam discharged at a pushing speed of 30 mm/sec, FIGS. 40C and 48C are images of foam discharged at a pushing speed of 50 mm/sec, and FIGS. 40D and 48D are images of foam discharged at a pushing speed of 70 mm/sec.

The foam discharged by the foam discharger 100 according to the present embodiment has been fine and uniform irrespective of the pushing speed, as compared to the foam discharged by the foam discharger according to the comparative embodiment. That is, regardless of the flow rate of the foam passing through the foam flow path 700, it has been possible to fine and discharge the foam.

As compared with the example whose images of foam are shown in FIGS. 40A to 40D, also in an example that differs in that the dimension D2 is 1.5 mm, an example that differs in that the dimension D2 is 2.5 mm, an example that differs in that the dimension D2 is 3.0 mm, and an example that differs in that the dimension D2 is 4.0 mm, the foam has been fine and uniform regardless of the pushing speed.

Also in an example in which the number of the narrow flow paths 730 having the same dimension as that in the example whose images of the foam are shown in FIGS. 40A to 40D is two, the foam has been fine and uniform regardless of the pushing speed.

Figure 42C:
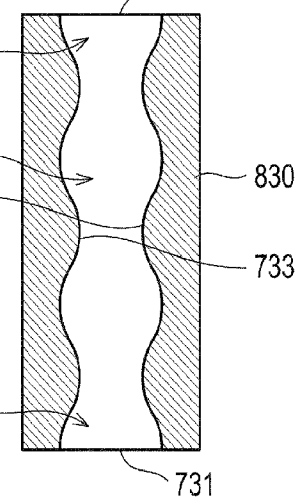
FIGS. 42A, 42B, 42C, 42D, and 42E each are views showing modifications of a vertical cross-sectional shape of the narrow flow path.

Also in the example shown in FIG. 42A (described later), the example shown in FIG. 42B (described later), and the example shown in FIG. 42E (described later), the foam has been fine and uniform regardless of the pushing speed.

<Modification of Shape of Upstream End or Downstream End of Narrow Flow Path>

Next, modifications of a shape of the upstream end 731 or the downstream end 732 of the narrow flow path 730 will be described.

Figure 41A:
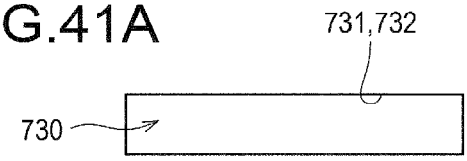
FIGS. 41A, 41B, 41C, 41D, 41E, 41F, and 41G each are views showing modifications of a shape of an upstream end or a downstream end of a narrow flow path.

In the example of FIG. 41A, the upstream end 731 or the downstream end 732 has a rectangular shape as in the above embodiment, but has a more elongated shape in a major axis direction as compared with the above embodiment.

Figure 41B:
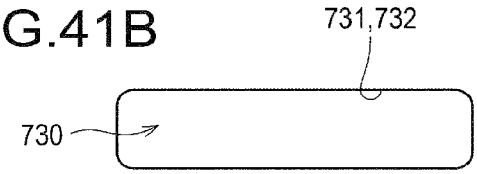

In the example of FIG. 41B, the upstream end 731 or the downstream end 732 has a rounded rectangular shape.

Figure 41C:
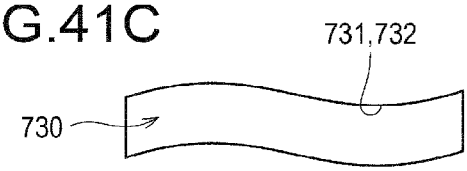

The upstream end 731 or the downstream end 732 is not limited to a shape extending linearly in the major axis direction, and may extend in a curved shape. For example, as shown in FIG. 41C, the upstream end 731 or the downstream end 732 may extend in a wavy line in the major axis direction.

Figure 41D:
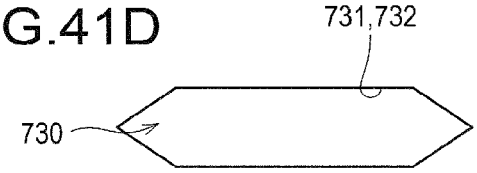

In the example of FIG. 41D, the upstream end 731 or the downstream end 732 has a hexagonal shape that is long in the major axis direction.

Figure 41E:
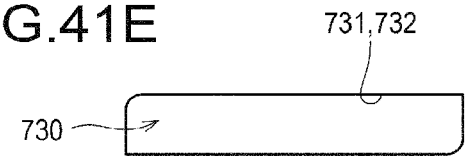

In the example of FIG. 41E, each of two corners located on a diagonal line of the upstream end 731 or the downstream end 732 is rounded, and remaining two corners are in an angular shape.

Figure 41F:
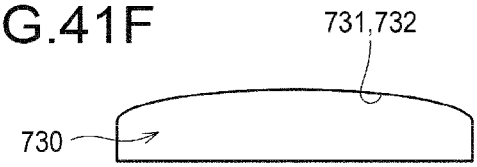

In the example of FIG. 41F, one outline in the minor axis direction of the upstream end 731 or the downstream end 732 protrudes outward in an arc shape, and each of two corners located on one side in the minor axis direction is rounded.

Figure 41G:
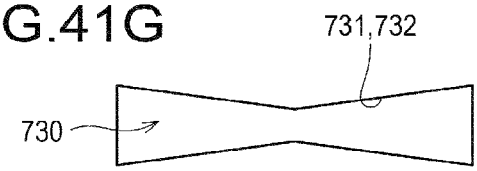

In the example of FIG. 41G, each of two outlines in the minor axis direction is bent inward.

In each modification, a shape (a orthogonal cross-sectional shape) of a middle portion between the upstream end 731 and the downstream end 732 may be the same shape and dimension as those of the upstream end 731 or the downstream end 732, or may be a shape obtained by enlarging the shape of the upstream end 731 or the downstream end 732 in the major axis direction.

<Modification of Vertical Cross-Sectional Shape of Narrow Flow Path>

Next, modifications of a cross-sectional shape of the narrow flow path 730 along the longitudinal direction and the major axis direction will be described.

The number of times that the dimension in the major axis direction in the orthogonal cross-sectional shape of the narrow flow path 730 expands and contracts from the upstream side toward the downstream side may be one. That is, as shown in FIG. 42A, for example, the dimension may only contract again toward the downstream end 732 after once having expanded from the upstream end 731 toward the downstream side. In this case, a shape of the outline 733 is, for example, an arc shape. Further, contrary to the example of FIG. 42A, as shown in FIG. 42E, the dimension may only expands toward the downstream end 732 again after once having contracted from the upstream end 731 toward the downstream side.

Figure 42B:
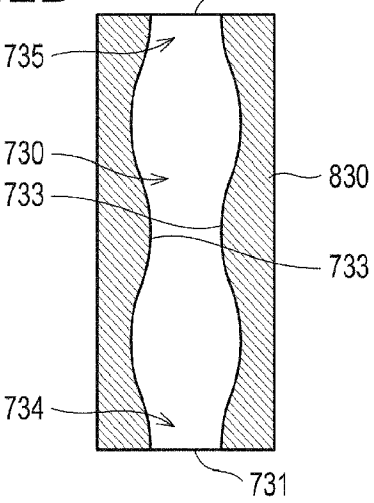
Figure 42A:
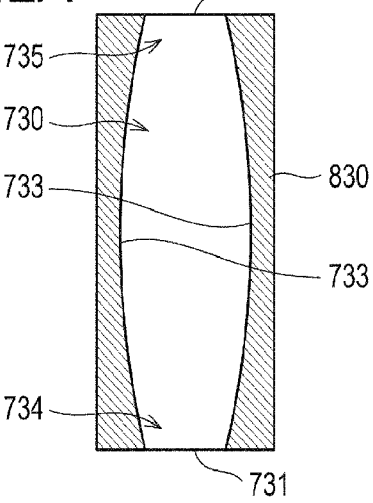
Figure 42E:
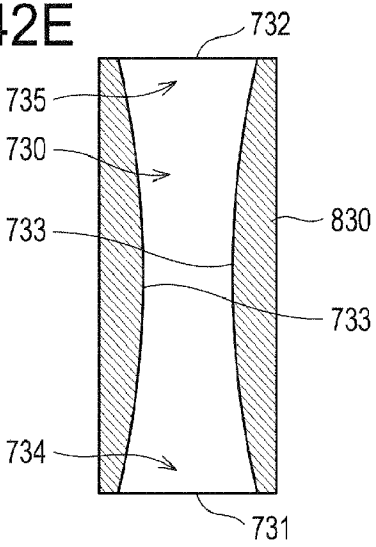

In the example of FIG. 42B, the number of times that the dimension in the major axis direction in the orthogonal cross-sectional shape of the narrow flow path 730 expands and contracts is two.

As shown in FIG. 42C, the upstream end part 734 of the narrow flow path 730 may have a dimension in the major axis direction that is narrower from the upstream end 731 toward the downstream side, or the downstream end part 735 may have a dimension in the major axis direction that is narrower from the downstream end 732 toward the upstream side.

Figure 42D:
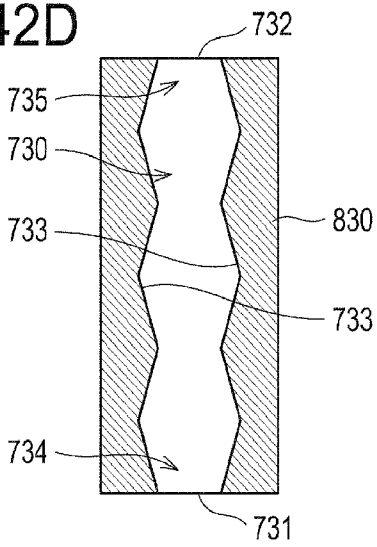

As shown in FIG. 42D, the outline 733 may have a linear polygonal line shape.

Sixth Embodiment

Similarly to the fifth embodiment, the present embodiment relates to a foam discharger having a structure capable of more reliably discharging fine foam, and a liquid-filled foam discharger (liquid-filled product).

The present embodiment relates to a foam discharger including: a foam generation unit that generates foam from liquid; a foam flow path through which the foam generated by the foam generation unit passes; and a discharge port that discharges foam that has passed through the foam flow path. The foam flow path includes: an upstream flow path; a narrow flow path arranged adjacent on a downstream side of the upstream flow path and having a smaller flow path area than that of the upstream flow path; and a downstream flow path arranged adjacent on a downstream side of the narrow flow path and having a larger flow path area than that of the narrow flow path. The foam generation unit has a plurality of foam outlets each being open toward the upstream flow path, and a length dimension of the narrow flow path is larger than a length dimension of the upstream flow path.

According to the present embodiment, it is possible to more reliably discharge fine foam.

The present embodiment can be realized as a combination with the above-described first to fourth embodiments or modifications thereof, and can also be realized with the present embodiment alone without assuming the configuration of the first to fourth embodiments or modifications thereof.

The foam generation unit described in the present embodiment has a configuration corresponding to the foamer mechanism 20 described in the first to fourth embodiments or modifications thereof. For example, a structure similar to that of the foamer mechanism 20 described in the first to fourth embodiments or modifications thereof can be employed. Therefore, the foam generation unit is denoted by the same reference numeral as the foamer mechanism 20.

However, the foam generation unit 20 in the present embodiment can have a different structure from the foamer mechanism 20 described in the first to fourth embodiments or modifications thereof, and may have other widely known structures.

Hereinafter, the present embodiment will be described in more detail with reference to FIGS. 43 to 45.

Figure 43:
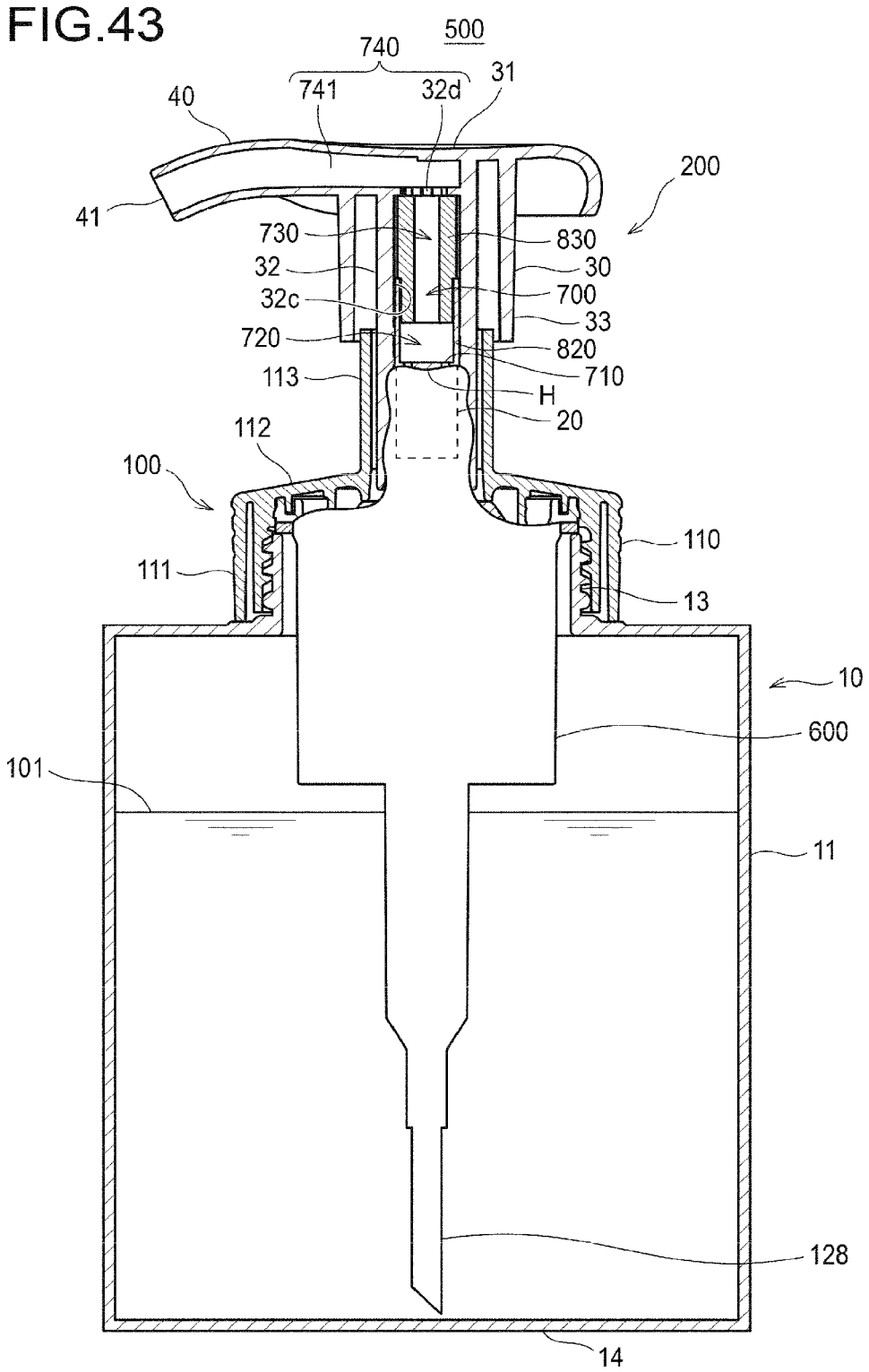
FIG. 43 is a front cross-sectional view of a foam discharger according to an embodiment.
Figure 44:
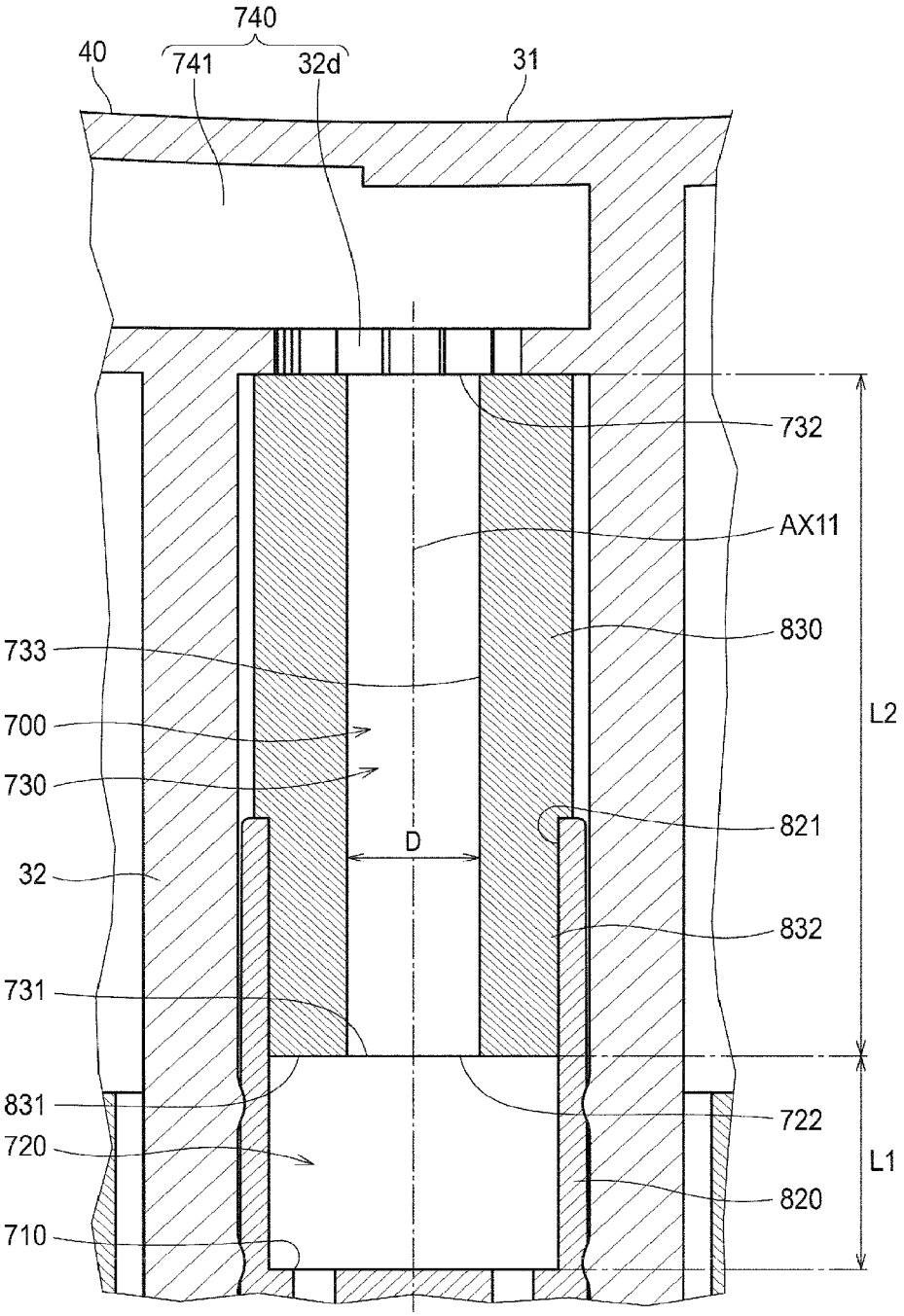
FIG. 44 is a partially enlarged view of FIG. 43.
Figure 45:
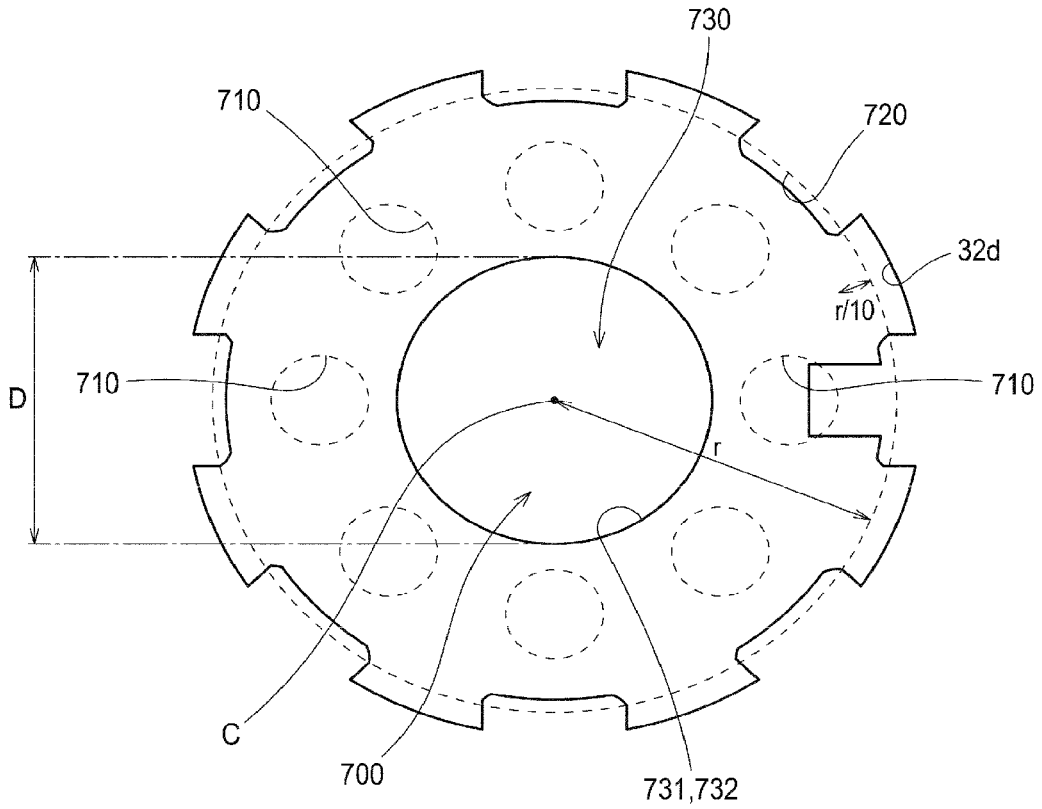
FIG. 45 is a view showing a planar positional relationship between each part of a foam flow path and a foam outlet from a foam generation unit.

A downward direction in FIGS. 43 to 45 is downward, and an upward direction is upward. That is, also in the case of the present embodiment, the downward direction (downward) is a direction of gravity in a state where a bottom part 14 of a foam discharger 100 is placed on a horizontal placing surface and the foam discharger 100 stands alone.

In FIG. 43, in a configuration of a foam discharge cap 200 (described later) provided to the foam discharger 100, only an outline is shown for a portion below a curve H.

FIG. 45 shows a planar shape of each part of a foam flow path 700 and a foam outlet 710 from the foam generation unit 20. More specifically, FIG. 45 shows outlines of an upstream end 731 and a downstream end 732 (in the present embodiment, these two outlines coincide with each other) of a narrow flow path 730, an outline of an upstream flow path 720, a plurality of foam outlets 710, and a flow path 32*d* that constitutes a part of a downstream flow path 740.

As shown in any of FIGS. 43 to 45, the foam discharger 100 according to the present embodiment includes: the foam generation unit 20 (FIG. 43) that generates foam from liquid 101, the foam flow path 700 through which the foam generated by the foam generation unit 20 passes, and a discharge port 41 that discharges foam that has passed through the foam flow path 700.

As shown in FIG. 44, the foam flow path 700 includes: the upstream flow path 720; the narrow flow path 730 arranged adjacent on a downstream side of the upstream flow path 720 and having a smaller flow path area than that of the upstream flow path 720; and the downstream flow path 740 arranged adjacent on a downstream side of the narrow flow path 730 and having a larger flow path area than that of the narrow flow path 730.

The foam generation unit 20 has a plurality of foam outlets 710 (FIGS. 44 and 45) each being open toward the upstream flow path 720. The number of the foam outlets 710 is not particularly limited as long as it is plural, but in the case of the present embodiment, as shown in FIG. 45, the number of the foam outlets 710 is eight.

The number of the narrow flow paths 730 included in the foam flow path 700 may be one or more, but is preferably one.

A length dimension L2 (FIG. 44) of the narrow flow path 730 is larger than a length dimension L1 (FIG. 44) of the upstream flow path 720.

According to the present embodiment, when the foam generated by the foam generation unit 20 passes through the narrow flow path 730, the foam is applied with a shear force due to viscous resistance between an inner peripheral surface of the narrow flow path 730 and the foam, which fines the foam. More specifically, it is considered that the foam is fined by a repeated action in which the foam is stretched in the longitudinal direction of the narrow flow path 730 and the foam is divided when the foam passes through the narrow flow path 730.

Moreover, since the length dimension L2 of the narrow flow path 730 is larger than the length dimension L1 of the upstream flow path 720, it is possible to more sufficiently fine the foam by shearing.

Therefore, the foam can be fined and discharged from the discharge port 41 more reliably.

Since the foam flow path 700 includes the downstream flow path 740 that is arranged adjacent on the downstream side of the narrow flow path 730 and has a larger flow path area than that of the narrow flow path 730, the foam having passed through the narrow flow path 730 can be discharged from the discharge port 41 after the flow rate is sufficiently decelerated in the downstream flow path 740. Therefore, the foam discharged from the discharge port 41 can be easily received by a discharge target such as a hand, and foam breakage due to collision of the foam with the discharge target can be suppressed.

Further, according to the study by the present inventors, it is possible to fine and discharge the foam regardless of the flow rate of the foam passing through the foam flow path 700 (described later).

When the foam discharger 100 according to the present embodiment is realized in combination with the first to fourth embodiments or modifications thereof, a downstream end of an adjacent foam flow path 91 (a boundary with an enlarged foam flow path 93) is to be the foam outlet 710.

In addition, for example, a portion on an upstream side of the enlarged foam flow path 93 is to be the upstream flow path 720.

An orthogonal cross-sectional shape of the narrow flow path 730 orthogonal to the longitudinal direction of the foam flow path 700 is not particularly limited. In the case of the present embodiment, this orthogonal cross-sectional shape is circular.

However, the present invention is not limited to this example, and the orthogonal cross-sectional shape may be other shape such as a polygonal shape or a rounded polygonal shape.

In the case of the present embodiment, a shape of the upstream end 731 and the downstream end 732 of the narrow flow path 730 is also circular.

In the present embodiment, the upstream end 731 and the downstream end 732 have a same shape, and the upstream end 731 and the downstream end 732 coincide with each other in plan view. However, the present invention is not limited to this example, and the upstream end 731 and the downstream end 732 may have different shapes, and the upstream end 731 and the downstream end 732 may be arranged at positions shifted from each other in plan view.

More specifically, in the case of the present embodiment, an internal space of the narrow flow path 730 has a columnar shape.

An inner diameter D (FIG. 44) or a circle equivalent diameter of the narrow flow path 730 is not particularly limited, but is preferably equal to or more than 0.5 mm and equal to or less than 6.0 mm, more preferably equal to or more than 1.0 mm and equal to or less than 4.0 mm, and even more preferably equal to or more than 2.0 mm. By setting the inner diameter D or the circle-equivalent diameter of the narrow flow path 730 to equal to or more than 0.5 mm and equal to or less than 6.0 mm, the foam can be more reliably made fine.

When viewed in an axial direction at the upstream end 731 of the narrow flow path 730 (a direction of an axis AX11 shown in FIG. 44), the narrow flow path 730 is arranged at a center part of the upstream flow path 720.

Therefore, since a flow rate of the foam is moderately reduced at a stage where the foam flows into the narrow flow path 730 from the upstream flow path 720, the foam is suppressed from passing as it is through the narrow flow path 730, and the foam in the narrow flow path 730 is sheared more reliably.

In the case of the present embodiment, the axial direction at the upstream end 731 of the narrow flow path 730 is the vertical direction. Therefore, as shown in FIG. 45, arrangement of the upstream flow path 720 and the narrow flow path 730 in plan view of the narrow flow path 730 and the upstream flow path 720 is arrangement of the narrow flow path 730 and the upstream flow path 720 when viewed in the axial direction at the upstream end 731 of the narrow flow path 730.

The center part of the upstream flow path 720 is a region avoiding a peripheral part of the upstream flow path 720. As shown in FIG. 45, when a radius (or a circle-equivalent radius) of the upstream flow path 720 when viewed in the axial direction at the upstream end 731 of the narrow flow path 730 is r, the peripheral part of the upstream flow path 720 can be set to a region of r/10 from an outer periphery of the upstream flow path 720, for example. That is, when viewed in the axial direction at the upstream end 731 of the narrow flow path 730, the foam flow path 700 preferably has the narrow flow path 730 in a circular region having a radius of 9r/10 with a center C of the upstream flow path 720 as a reference. Note that the present invention does not exclude that the foam flow path 700 has the narrow flow path 730 arranged in the region of r/10 from the outer periphery of the upstream flow path 720, and the foam flow path 700 may have a narrow flow path 730 arranged at the peripheral part of the upstream flow path 720, separately from the narrow flow path 730 arranged at the center part of the upstream flow path 720.

When the number of the narrow flow paths 730 is one, the center C of the upstream flow path 720 is preferably located inside an outline of the narrow flow path 730 when viewed in the axial direction at the upstream end 731 of the narrow flow path 730. Even when the number of the narrow flow paths 730 is plural, it is preferable that the center C of the upstream flow path 720 is located inside an outline of one narrow flow path 730 among the plurality of narrow flow paths 730 when viewed in the axial direction at the upstream end 731 of the narrow flow path 730.

As shown in FIG. 45, it is preferable that the narrow flow path 730 is arranged at a position closer to the center than an arrangement region of the plurality of foam outlets 710 when viewed in the axial direction at the upstream end 731 of the narrow flow path 730. That is, it is preferable that a center of each foam outlet 710 is arranged outside the outline of the narrow flow path 730 when viewed in the axial direction at the upstream end 731 of the narrow flow path 730.

As a result, a portion that inhibits a flow of the foam (for example, a lower end surface 831 of an upper member 830 described later) is to be present at the boundary between the upstream flow path 720 and the narrow flow path 730, and the foam can be sufficiently decelerated at the boundary between the upstream flow path 720 and the narrow flow path 730.

The length dimension L2 (FIG. 44) of the narrow flow path 730 is preferably equal to or more than 3 mm. By adopting such a configuration, the foam can be more sufficiently sheared in the narrow flow path 730, and the foam can be more reliably made finer.

More preferably, the length dimension L2 is equal to or more than 5 mm. The length dimension L2 is preferably equal to or less than 40 mm, and more preferably equal to or less than 20 mm.

The length dimension L1 (FIG. 44) of the upstream flow path 720 is preferably equal to or more than 1 mm. By adopting such a configuration, individual foam is formed as independent foam in the upstream flow path 720 (individual foam is defined), and the foam can flow into the narrow flow path 730 to be sheared after an overall film thickness of the individual foam has been averaged. In other words, while a dynamic surface tension is large and a film thickness is uneven (oriented) immediately after generation of foam, the film thickness of the foam can be averaged in a process in which the foam passes through the upstream flow path 720 having a sufficient length before the foam flows into the narrow flow paths 730. Therefore, the foam can be more reliably made fine.

When the present embodiment is configured in combination with the above-described first to fourth embodiments or modifications thereof, a sufficient space for a swing of a liquid column as described above can be sufficiently secured, and the swing can be suitably realized by setting the length dimension L1 of the upstream flow path 720 to equal to or more than 1 mm.

More preferably, the length dimension L1 is equal to or more than 2 mm. The length dimension L1 is preferably equal to or less than 10 mm.

At a boundary between a downstream end 722 of the upstream flow path 720 and the upstream end 731 of the narrow flow path 730, the flow path area preferably changes discontinuously. By adopting such a configuration, a flow rate of the foam can be more reliably reduced at a stage where the foam flows from the upstream flow path 720 to the narrow flow path 730. Therefore, the foam in the narrow flow path 730 can be sheared more reliably. Further, a space for sufficiently defining the foam in the upstream flow path 720 can be secured.

More specifically, a flow path area of the upstream end 731 of the narrow flow path 730 is preferably equal to or more than 1% and equal to or less than 40% of a flow path area of the downstream end 722 of the upstream flow path 720, and is more preferably equal to or more than 15% and equal to or less than 35%.

A flow path area at the upstream flow path 720 is larger than a total opening area of the plurality of foam outlets 710.

A flow path area at the upstream end 731 of the narrow flow path 730 is preferably equal to or larger than the total opening area of the plurality of foam outlets 710. This allows the foam discharged from the foam outlet 710 to flow smoothly (without receiving excessive pressure) into the narrow flow path 730. Therefore, foam breakage when the foam flows from the upstream flow path 720 to the narrow flow path 730 can be suppressed.

As shown in FIG. 43, the foam discharger 100 includes a storage container 10 that stores liquid 101, and the foam discharge cap 200 that is detachably attached to the storage container 10.

The storage container 10 is similar to that in the fifth embodiment.

A liquid-filled foam discharger (liquid-filled product) 500 according to the present embodiment includes the foam discharger 100 and the liquid 101 filled in the storage container 10.

Also in the present embodiment, the liquid 101 is similar to that in each of the above embodiments.

Also in the case of the present embodiment, the foam discharger 100 may be a pump container as in the fifth embodiment, or may be a squeeze bottle, an electric foam dispenser equipped with a motor or the like, or an aerosol container.

A cap member 110, a pump part 600, a dip tube 128, a head member 30, and the foam generation unit 20 of the foam discharge cap 200 are similar to those in the fifth embodiment.

Also in the case of the present embodiment, as in the fifth embodiment, the upper member 830 and a lower member 820 are housed in a holding part 32*c*. The lower member 820 and the upper member 830 constitute the foam outlet 710 of the foam generation unit 20, and the upstream flow path 720, and the narrow flow path 730 of the foam flow path 700.

Also in the case of the present embodiment, since the foam flow path 700 is narrowed in the narrow flow path 730, an amount of foam remaining in a portion from the foam outlet 710 to the discharge port 41 can be reduced. Therefore, a larger proportion of the foam generated in the foam generation unit 20 in accordance with the discharge operation can be discharged from the discharge ports 41.

As shown in FIG. 45, also in the case of the present embodiment, the plurality of foam outlets 710 are preferably arranged inside an outline of the upstream flow path 720 when viewed in the axial direction at the upstream end 731 of the narrow flow path 730.

A flow path area of the flow path 32*d* and a flow path area of an in-nozzle foam flow path 741 are larger than a flow path area of the narrow flow path 730. That is, the downstream flow path 740 is arranged adjacent on the downstream side of the narrow flow path 730, and has a larger flow path area than that of the narrow flow path 730.

In the case of the present embodiment, the foam discharger 100 does not include a mesh that fines the generated foam. Therefore, even when the liquid 101 contains a scrubbing agent, it is possible to suitably generate and discharge the foam.

However, the present invention is not limited to this example, and the foam discharger 100 may include a mesh that fines the generated foam. For example, a mesh can be arranged at a boundary between the foam generation unit 20 and the upstream flow path 720, and in this case, each lattice-shaped opening of the mesh is to be the foam outlet 710.

Each of FIGS. 46A, 46B, 46C, and 46D is a view showing a captured image of foam discharged by the foam discharger 100 according to the present embodiment. More specifically, the images shown in FIGS. 46A to 46D are images of the foam when a length dimension L1 is 5.7 mm, a length dimension L2 is 18 mm, an inner diameter D of the narrow flow path 730 is 3.2 mm, an inner diameter of the foam outlet 710 is 1.0 mm, and an inner diameter of the upstream flow path 720 is 7.0 mm.

Whereas, each of FIGS. 48A, 48B, 48C, and 48D shows a captured image of foam discharged by a foam discharger (not shown in the drawings) according to a comparative embodiment.

The foam discharger according to the comparative embodiment is different from the foam discharger 100 according to the present embodiment in that the upper member 830 is not provided (that is, the narrow flow path 730 is not provided), and is configured similarly to the foam discharger 100 according to the present embodiment in other respects.

Figure 46A:
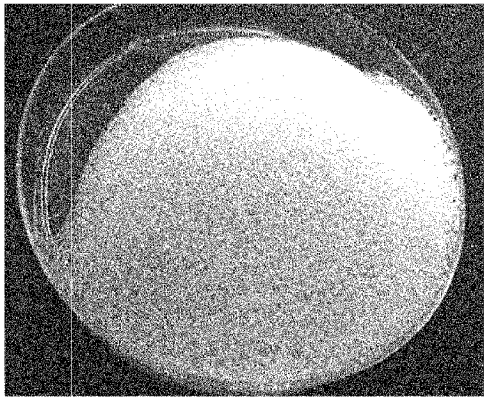
FIGS. 46A, 46B, 46C, and 46D each are views showing a captured image of foam discharged by a foam discharger according to an embodiment.
Figure 46B:
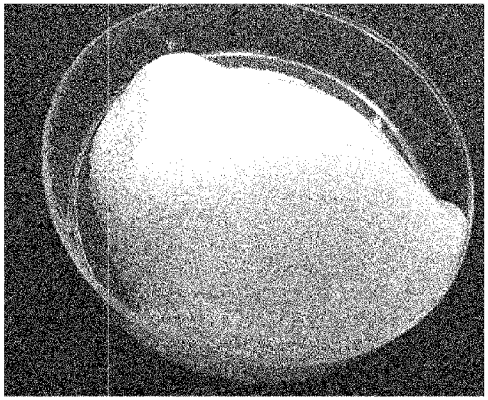
Figure 46C:
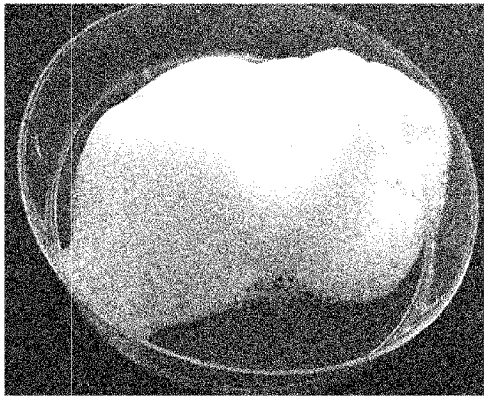
Figure 46D:
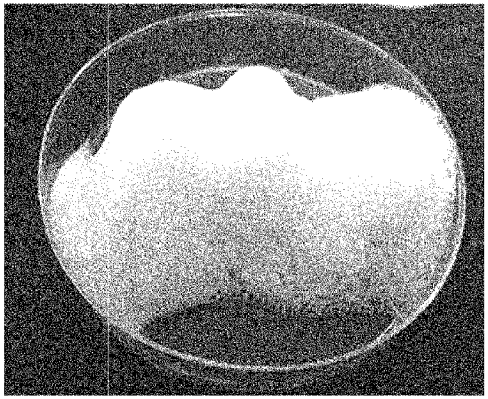

FIGS. 46A and 48A are images of foam discharged at a speed of pushing down the head member 30 (pushing speed) of 10 mm/sec. FIGS. 46B and 48B are images of foam discharged at a pushing speed of 30 mm/sec, FIGS. 46C and 48C are images of foam discharged at a pushing speed of 50 mm/sec, and FIGS. 46D and 48D are images of foam discharged at a pushing speed of 70 mm/sec.

The foam discharged by the foam discharger 100 according to the present embodiment has been fine and uniform irrespective of the pushing speed, as compared to the foam discharged by the foam discharger according to the comparative embodiment. That is, regardless of the flow rate of the foam passing through the foam flow path 700, it has been possible to fine and discharge the foam.

As compared with the example whose images of foam are shown in FIGS. 46A to 46D, also in an example that differs in that the inner diameter D is 4.0 mm, the foam has become fine and uniform regardless of the pushing speed.

Also in the example shown in FIG. 47A (described later), which is an example in which the inner diameter D is 3.2 mm and an example in which the inner diameter D is 4.0 mm, the foam has become fine and uniform regardless of the pushing speed.

<Modification of Vertical Cross-Sectional Shape of Narrow Flow Path>

Next, modifications of a cross-sectional shape along the longitudinal direction of the narrow flow path 730 will be described.

Figure 47A:
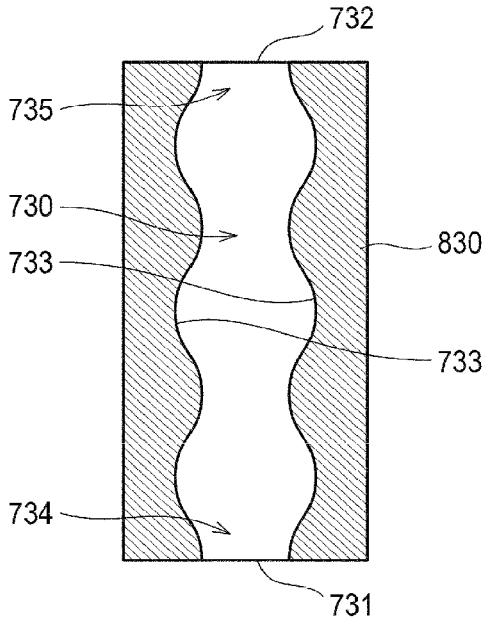
FIGS. 47A and 47B each are views showing modifications of a vertical cross-sectional shape of the narrow flow path.
Figure 47B:
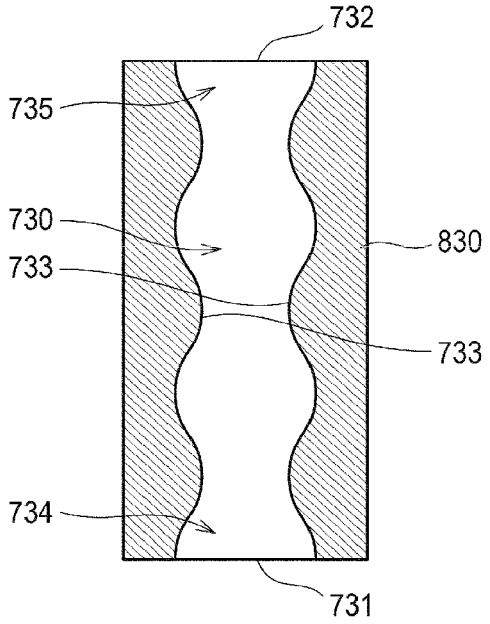

In the example shown in FIGS. 47A and 47B, the flow path area of the narrow flow path 730 repeatedly expands and contracts from the upstream side toward the downstream side. Adopting such a configuration allows the foam to be further fined.

The reason for being able to fine the foam by repeating the expansion and contraction of the flow path area of the narrow flow path 730 is unclear. However, the fact that division of the foam is accelerated by repeated increase and decrease of the flow rate of the foam in accordance with the change in the flow path area when the foam passes through the narrow flow path 730 is considered to contribute to the fineness of the foam.

The number of times the flow path area of the narrow flow path 730 expands and contracts may be one.

As shown in FIG. 47A, the upstream end part 734 of the narrow flow path 730 may have a flow path area increasing from the upstream end 731 toward the downstream side. Further, the downstream end part 735 of the narrow flow path 730 may have a flow path area increasing from the downstream end 732 toward the upstream side.

As shown in FIG. 47B, the upstream end part 734 of the narrow flow path 730 may have a flow path area decreasing from the upstream end 731 toward the downstream side. Further, the downstream end part 735 of the narrow flow path 730 may have a flow path area decreasing from the downstream end 732 toward the upstream side.

In a cross section along the longitudinal direction of the narrow flow path 730, an outline 733 of the narrow flow path 730 at both end sides in the direction orthogonal to the longitudinal direction may be a wavy curved line shape as shown in FIGS. 47A and 47B, or may be a linear polygonal line shape (not shown in the drawings).

In the example of FIGS. 47A and 47B, the narrow flow path 730 has a bellows shape.

The present invention is not limited to the above-described embodiment, but includes various aspects of modifications and improvements as long as an object of the present invention is achieved.

For example, the axis of the narrow flow path 730 may not necessarily extend linearly, but may extend in a curved shape. For example, the axis of the narrow flow path 730 may be bent in an arc shape. As an example, the narrow flow path 730 having a bent shape may be formed by pushing the upper member 830 made of rubber into a bent tubular part. This makes it possible to realize a configuration in which, for example, an upstream portion of the narrow flow path 730 extends vertically, while a downstream portion of the narrow flow path 730 extends horizontally or substantially horizontally along the in-nozzle foam flow path 741.

Further, the upper member 830 may have a divided structure of being divided at one or more locations in the longitudinal direction of the narrow flow path 730. This makes it possible to easily realize a structure in which the narrow flow path 730 repeatedly expands and contracts from the upstream side toward the downstream side.

In addition, the various components of the foam discharger 100 need not be individually independent, and it is allowed that a plurality of components are formed as one member, that one component is formed by a plurality of members, that one component is part of another component, that a part of a certain component and a part of another component are overlapped, and the like.

The embodiments described above include the following technical concept.

<1> A foam discharger including:

a foamer mechanism that generates foam from liquid; a liquid supply unit that supplies liquid to the foamer mechanism;

a gas supply unit that supplies a gas to the foamer mechanism;

a discharge port that discharges the foam generated by the foamer mechanism; and a foam flow path through which the foam from the foamer mechanism toward the discharge port passes, in which the foamer mechanism includes:

a mixing part where the liquid supplied from the liquid supply unit and the gas supplied from the gas supply unit meet;

a liquid flow path through which the liquid supplied from the liquid supply unit to the mixing part passes; and a gas flow path through which the gas supplied from the gas supply unit to the mixing part passes, the foam flow path includes an adjacent foam flow path being adjacent on a downstream side of the mixing part, the liquid flow path includes an adjacent liquid flow path being adjacent on an upstream side of the mixing part and having a liquid inlet that is open to the mixing part, the gas flow path includes a plurality of adjacent gas flow paths being adjacent on an upstream side of the mixing part and each having a gas inlet that is open to the mixing part, and the liquid inlet is arranged at a position corresponding to a merging part of the gases supplied from the plurality of adjacent gas flow paths to the mixing part via the gas inlet.

<2> The foam discharger according to <1>, in which the foamer mechanism has one or more of the adjacent liquid flow paths, and the mixing part is arranged in correspondence to each of the adjacent liquid flow paths.

<3> The foam discharger according to <2>, in which the plurality of adjacent gas flow paths for exclusive use are arranged in correspondence to each piece of the mixing part.

<4> The foam discharger according to <3>, in which the foamer mechanism includes: a plurality of the mixing parts; and a partition that mutually partitions each of the adjacent gas flow paths corresponding to one of the mixing parts among the mixing parts adjacent to each other and each of the adjacent gas flow paths corresponding to another of the mixing parts.

<5> The foam discharger according to any one of <2> to <4>, in which the foamer mechanism includes a plurality of the mixing parts, the liquid flow path includes a large-diameter liquid flow path being adjacent on an upstream side of the adjacent liquid flow path and having a flow path area larger than that of the adjacent liquid flow path, the plurality of mixing parts are arranged around a downstream end part of the large-diameter liquid flow path, and a plurality of the adjacent liquid flow paths extend from a downstream end part of the large-diameter liquid flow path toward a periphery in an in-plane direction intersecting an axial direction of the large-diameter liquid flow path.

<6> The foam discharger according to any one of <2> to <5>, in which the foamer mechanism includes a plurality of the mixing parts, and the foam flow path includes each piece of the adjacent foam flow path in correspondence to each of the mixing parts.

<7> The foam discharger according to <6>, in which the foam flow path includes an enlarged foam flow path being adjacent on a downstream side of the adjacent foam flow path and having a flow path area larger than that of the adjacent foam flow path, and the adjacent foam flow path corresponding to each of the plurality of the mixing parts merges into one piece of the enlarged foam flow path.

<8> The foam discharger according to any one of <1> to <7>, in which a flow path area of the adjacent foam flow path is equal to a maximum value of an inner cavity cross-sectional area orthogonal to an axial direction of the adjacent foam flow path of the mixing part, or smaller than the inner cavity cross-sectional area.

<9> The foam discharger according to <8>, in which a length of the adjacent foam flow path is longer than a dimension of the gas inlet in the axial direction of the adjacent foam flow path.

<10> The foam discharger according to any one of <1> to <9>, in which the foamer mechanism has one or more of the mixing parts, and a pair of the adjacent gas flow paths are arranged in correspondence to each of the mixing parts, and supply directions of the gas from the pair of adjacent gas flow paths to the corresponding mixing part are opposed to each other.

<11> The foam discharger according to any one of <1> to <9>, in which the foamer mechanism includes one or more of the mixing parts, and three of the adjacent gas flow paths are arranged in correspondence to each of the mixing parts, supply directions of the gas from the three adjacent gas flow paths to the corresponding mixing part are located on a same plane, and a supply direction of the liquid from the adjacent liquid flow path to the mixing part is a direction intersecting the plane.

<12> The foam discharger according to any one of <1> to <11>, in which the adjacent foam flow path has a foam outlet being open to the mixing part.

<13> The foam discharger according to <12>, in which the foamer mechanism includes a plurality of the mixing parts, and each of the plurality of mixing parts is defined by a plurality of the gas inlets, the liquid inlet, the foam outlet, and a wall surface.

<14> The foam discharger according to any one of <1> to <13>, further including:

a storage container that stores the liquid; and a mounting part that is mounted to the storage container, in which the foamer mechanism, the discharge port, and the foam flow path are held by the mounting part.

<15> The foam discharger according to any one of the above items, in which a length of the adjacent foam flow path is longer than a dimension of the mixing part in the axial direction of the adjacent foam flow path.

<16> The foam discharger according to any one of the above items, in which the foam flow path includes an enlarged foam flow path being adjacent on a downstream side of the adjacent foam flow path and having a larger flow path area than that of the adjacent foam flow path.

<17> The foam discharger according to any one of the above items, in which the plurality of mixing parts are arranged along a circumference, and the plurality of adjacent liquid flow paths are radially arranged inside the circumference.

<18> The foam discharger according to <17>, in which each of the adjacent gas flow paths includes each portion of an annular flow path arranged along the circumference.

<19> The foam discharger according to any one of the above items, in which an axis of the adjacent liquid flow path and an axis of the adjacent foam flow path intersect with each other.

<20> The foam discharger according to any one of the above items, in which a number of the adjacent foam flow paths arranged in correspondence to each piece of the mixing part is one.

<21> The foam discharger according to any one of the above items, in which a number of the adjacent liquid flow paths arranged in correspondence to each piece of the mixing part is one.

<22> The foam discharger according to any one of the above items, in which the gas flow path includes an intersecting gas flow path being adjacent on an upstream side of the adjacent gas flow paths and extending in a direction intersecting the adjacent gas flow paths, and one piece of the intersecting gas flow path branches into one of a pair of the adjacent gas flow paths corresponding to one piece of the mixing part and into one of a pair of the adjacent gas flow paths corresponding to another piece of the mixing part.

<23> The foam discharger according to any one of the above items, in which a pair of the adjacent gas flow paths are arranged in correspondence to one piece of the mixing part, the gas flow path includes an intersecting gas flow path being adjacent on an upstream side of the adjacent gas flow paths and extending in a direction intersecting the adjacent gas flow paths, one piece of the intersecting gas flow path branches into one of a pair of the adjacent gas flow paths corresponding to one piece of the mixing part and into one of a pair of the adjacent gas flow paths corresponding to another piece of the mixing part, and the intersecting gas flow path extends in a direction parallel to the large-diameter liquid flow path.

<24> The foam discharger according to any one of the above items, in which a plurality of the intersecting gas flow paths are intermittently arranged around the large-diameter liquid flow path.

<25> The foam discharger according to any one of the above items, in which the adjacent foam flow path and the adjacent liquid flow path are arranged on opposite sides of each other with the mixing part as a reference.

<26> The foam discharger according to any one of the above items, in which the liquid supply unit is configured to pressurize liquid inside to supply the liquid to the foamer mechanism, and the gas supply unit is arranged around the liquid supply unit, and is configured to pressurize a gas inside to supply the gas to the foamer mechanism.

<27> The foam discharger according to any one of the above items, further including:

a head part that is held by the mounting part to be vertically movable with respect to the mounting part, and is pushed down relatively to the mounting part, in which the foamer mechanism and the discharge port are held by the head part, and when the head part is pushed down relatively to the mounting part, the liquid inside the liquid supply unit and the gas inside the gas supply unit are individually pressurized and supplied to the foamer mechanism.

<28> The foam discharger according to any one of the above items, in which at least the adjacent foam flow path constitutes a swing region in which a liquid column formed by the liquid sequentially swings in a direction away from the gas inlet of each of the plurality of adjacent gas flow paths, the gas inlet being open to the mixing part.

<29> The foam discharger according to <24>, in which a pair of the adjacent gas flow paths are arranged for one piece of the mixing part, and the liquid column alternately swings in the swing region.

<30> The foam discharger according to any one of the above items, in which equal to or more than three of the adjacent gas flow paths are arranged for one piece of the mixing part, and axes of the equal to or more than three adjacent gas flow paths are arranged on a same plane.

<31> The foam discharger according to any one of the above items, in which the adjacent liquid flow path extends linearly.

<32> The foam discharger according to any one of the above items, in which the adjacent foam flow path extends linearly.

<33> The foam discharger according to any one of the above items, in which the gas inlets are respectively arranged at positions on both sides of a region on an extension of the adjacent liquid flow path, in the mixing part.

<34> The foam discharger according to <33>, in which each of the gas inlets arranged at positions on both sides of a region on an extension of the adjacent liquid flow path is directed toward the region.

<35> The foam discharger according to any one of the above items, in which a pair of the adjacent gas flow paths are arranged for one piece of the mixing part, and the gas inlets being open to the one piece of mixing part are opposed to each other with the mixing part interposed in between.

<36> The foam discharger according to any one of the above items, in which shapes of the gas inlets being open to the mixing part are equal to each other.

<37> The foam discharger according to any one of the above items, in which areas of the gas inlets being open to the mixing part are equal to each other.

<38> The foam discharger according to any one of the above items, in which a total area of the gas inlets arranged in correspondence to one mixing part is equal to an area of the liquid inlet arranged in correspondence to one mixing part, or smaller than the area.

<39> The foam discharger according to any one of the above items, in which an area of each of the gas inlets arranged in correspondence to one mixing part is smaller than an area of the liquid inlet arranged in correspondence to one mixing part.

<40> The foam discharger according to any one of <1> to <39>, in which the foam flow path includes: an upstream flow path; and a narrow flow path arranged adjacent on a downstream side of the upstream flow path and having a smaller flow path area than that of the upstream flow path, the narrow flow path is arranged at a center part of the upstream flow path when viewed in an axial direction at an upstream end of the narrow flow path, and an orthogonal cross-sectional shape of the narrow flow path orthogonal to a longitudinal direction of the narrow flow path is a flat shape.

<41> The foam discharger according to <40>, in which a dimension D1 in a major axis direction in the orthogonal cross-sectional shape of the narrow flow path repeatedly expands and contracts from an upstream side toward a downstream side.

<42> The foam discharger according to <41>, in which, in an upstream end part of the narrow flow path, a dimension D1 in the major axis direction increases from an upstream end toward a downstream side.

<43> The foam discharger according to <41> or <42>, in which, in a cross section along the longitudinal direction and the major axis direction, an outline of the narrow flow path at both ends in the major axis direction has a wavy curved shape.

<44> The foam discharger according to any one of <41> to <43>, in which, in a cross section along the longitudinal direction and the major axis direction, regarding an outline of the narrow flow path at both ends in the major axis direction, a maximum inclination angle with the longitudinal direction as a reference is less than 45 degrees.

<45> The foam discharger according to any one of <40> to <44>, in which a ratio S1/S2 between a maximum value S1 and a minimum value S2 of a flow path area of the narrow flow path is equal to or less than 2.

<46> The foam discharger according to any one of <40> to <45>, in which a ratio D1MAX/D1MIN between a maximum value D1MAX and a minimum value D1MIN of a dimension D1 in a major axis direction in the orthogonal cross-sectional shape of the narrow flow path is preferably equal to or less than 2, and the ratio D1MAX/D1MIN is more preferably equal to or less than 1.7.

<47> The foam discharger according to any one of <40> to <46>, in which a dimension D2 in a minor axis direction in the orthogonal cross-sectional shape is equal to or more than 0.5 mm and equal to or less than 4 mm.

<48> The foam discharger according to any one of <40> to <47>, in which a ratio D1/D2 between a dimension D1 in a major axis direction and a dimension D2 in a minor axis direction in the orthogonal cross-sectional shape is equal to or more than 1.5.

<49> The foam discharger according to any one of <40> to <48>, in which, in the orthogonal cross-sectional shape, a ratio D1/D2 between a dimension D1 in a major axis direction and a dimension D2 in a minor axis direction is preferably equal to or more than 1.7, and the ratio D1/D2 is preferably equal to or less than 12, and more preferably equal to or less than 8.

<50> The foam discharger according to any one of <40> to <49>, in which a length dimension L2 of the narrow flow path is equal to or more than 3 mm.

<51> The foam discharger according to any one of <40> to <50>, in which a length dimension L2 of the narrow flow path is more preferably equal to or more than 5 mm, and the length dimension L2 is preferably equal to or less than 40 mm, and more preferably equal to or less than 20 mm.

<52> The foam discharger according to any one of <40> to <51>, in which a length dimension L1 of the upstream flow path is equal to or more than 1 mm.

<53> The foam discharger according to any one of <40> to <52>, in which a length dimension L1 of the upstream flow path is preferably equal to or more than 2 mm, and the length dimension L1 is preferably equal to or less than 10 mm.

<54> The foam discharger according to any one of <40> to <53>, in which a length dimension L2 of the narrow flow path is longer than a length dimension L1 of the upstream flow path.

<55> The foam discharger according to any one of <40> to <54>, in which a flow path area is discontinuously changing at a boundary between a downstream end of the upstream flow path and an upstream end of the narrow flow path.

<56> The foam discharger according to <55>, in which a flow path area at an upstream end of the narrow flow path is equal to or more than 1% and equal to or less than 40% of a flow path area at a downstream end of the upstream flow path.

<57> The foam discharger according to <55> or <56>, in which a flow path area at an upstream end of the narrow flow path is equal to or more than 15% and equal to or less than 35% of a flow path area at a downstream end of the upstream flow path.

<58> The foam discharger according to any one of <40> to <57>, further including: a storage container that stores the liquid; and a mounting part that is mounted to the storage container, in which the foam generation unit, the foam flow path, and the discharge port are held by the mounting part.

<59> The foam discharger according to any one of <1> to <39>, in which the foam flow path includes: an upstream flow path; a narrow flow path arranged adjacent on a downstream side of the upstream flow path and having a smaller flow path area than that of the upstream flow path; and a downstream flow path arranged adjacent on a downstream side of the narrow flow path and having a larger flow path area than that of the narrow flow path, the foamer mechanism has a plurality of foam outlets each being open toward the upstream flow path, and a length dimension of the narrow flow path is larger than a length dimension of the upstream flow path.

<60> The foam discharger according to <59>, in which the narrow flow path is arranged at a center part of the upstream flow path when viewed in an axial direction at an upstream end of the narrow flow path.

<61> The foam discharger according to <60>, in which the narrow flow path is arranged at a position closer to a center than an arrangement region of the plurality of foam outlets when viewed in the axial direction.

<62> The foam discharger according to any one of <59> to <61>, in which a length dimension of the narrow flow path is equal to or more than 3 mm.

<63> The foam discharger according to any one of <59> to <62>, in which a length dimension of the narrow flow path is preferably equal to or more than 5 mm, and the length dimension is preferably equal to or less than 40 mm, and more preferably equal to or less than 20 mm.

<64> The foam discharger according to any one of <59> to <63>, in which a length dimension of the upstream flow path is equal to or more than 1 mm.

<65> The foam discharger according to any one of <59> to <64>, in which a length dimension of the upstream flow path is preferably equal to or more than 2 mm, and the length dimension is preferably equal to or less than 10 mm.

<66> The foam discharger according to any one of <59> to <65>, in which a flow path area is discontinuously changing at a boundary between a downstream end of the upstream flow path and an upstream end of the narrow flow path.

<67> The foam discharger according to <66>, in which a flow path area at an upstream end of the narrow flow path is equal to or more than 1% and equal to or less than 40% of a flow path area at a downstream end of the upstream flow path.

<68> The foam discharger according to <66> or <67>, in which a flow path area at an upstream end of the narrow flow path is equal to or more than 15% and equal to or less than 35% of a flow path area at a downstream end of the upstream flow path.

<69> The foam discharger according to any one of <59> to <68>, in which an inner diameter or a circle-equivalent diameter of the narrow flow path is preferably equal to or more than 0.5 mm and equal to or less than 6.0 mm, more preferably equal to or more than 1.0 mm and equal to or less than 4.0 mm, and even more preferably equal to or more than 2.0 mm.

<70> The foam discharger according to any one of <59> to <69>, in which a flow path area of the narrow flow path repeatedly expands and contracts from an upstream side toward a downstream side.

<71> The foam discharger according to <70>, in which, in a cross section along a longitudinal direction of the narrow flow path, an outline of the narrow flow path at both end sides in a direction orthogonal to the longitudinal direction has a wavy curved shape.

<72> The foam discharger according to any one of <59> to <71>, further including:

a storage container that stores the liquid; and a mounting part that is mounted to the storage container, in which the foam generation unit, the foam flow path, and the discharge port are held by the mounting part.

<73> A liquid-filled product including:

the foam discharger according to any one of the above items; and the liquid filled in the storage container.

<74> A foam discharge cap including:

a mounting part that is mounted to a storage container that stores liquid;

a foamer mechanism that is held by the mounting part and generates foam from the liquid;

a liquid supply unit that is held by the mounting part and supplies liquid to the foamer mechanism;

a gas supply unit that is held by the mounting part and supplies a gas to the foamer mechanism;

a discharge port that is held by the mounting part and discharges the foam generated by the foamer mechanism; and a foam flow path that is held by the mounting part and through which the foam from the foamer mechanism toward the discharge port passes, in which the foamer mechanism includes:

a mixing part where the liquid supplied from the liquid supply unit and the gas supplied from the gas supply unit meet;

a liquid flow path through which the liquid supplied from the liquid supply unit to the mixing part passes; and a gas flow path through which the gas supplied from the gas supply unit to the mixing part passes, the foam flow path includes an adjacent foam flow path being adjacent on a downstream side of the mixing part, the liquid flow path includes an adjacent liquid flow path being adjacent on an upstream side of the mixing part and having a liquid inlet that is open to the mixing part, the gas flow path includes a plurality of adjacent gas flow paths being adjacent on an upstream side of the mixing part and each having a gas inlet that is open to the mixing part, and the liquid inlet is arranged at a position corresponding to a merging part of the gases supplied from the plurality of adjacent gas flow paths to the mixing part via the gas inlet.

<75> The foam discharge cap according to <74>, in which the foamer mechanism has one or more of the adjacent liquid flow paths, and the mixing part is arranged in correspondence to each of the adjacent liquid flow paths.

<76> The foam discharge cap according to <75>, in which the plurality of adjacent gas flow paths for exclusive use are arranged in correspondence to each piece of the mixing part.

<77> The foam discharge cap according to <76>, in which the foamer mechanism includes: a plurality of the mixing parts; and a partition that mutually partitions each of the adjacent gas flow paths corresponding to one of the mixing parts among the mixing parts adjacent to each other and each of the adjacent gas flow paths corresponding to another of the mixing parts.

<78> The foam discharge cap according to any one of <75> to <77>, in which the foamer mechanism includes a plurality of the mixing parts, the liquid flow path includes a large-diameter liquid flow path being adjacent on an upstream side of the adjacent liquid flow path and having a flow path area larger than that of the adjacent liquid flow path, the plurality of mixing parts are arranged around a downstream end part of the large-diameter liquid flow path, and a plurality of the adjacent liquid flow paths extend from a downstream end part of the large-diameter liquid flow path toward a periphery in an in-plane direction intersecting an axial direction of the large-diameter liquid flow path.

<79> The foam discharge cap according to any one of <75> to <78>, in which the foamer mechanism includes a plurality of the mixing parts, and the foam flow path includes each piece of the adjacent foam flow path in correspondence to each of the mixing parts.

<80> The foam discharge cap according to <79>, in which the foam flow path includes an enlarged foam flow path being adjacent on a downstream side of the adjacent foam flow path and having a flow path area larger than that of the adjacent foam flow path, and the adjacent foam flow path corresponding to each of the plurality of the mixing parts merges into one piece of the enlarged foam flow path.

<81> The foam discharge cap according to any one of <74> to <80>, in which a flow path area of the adjacent foam flow path is equal to a maximum value of an inner cavity cross-sectional area orthogonal to an axial direction of the adjacent foam flow path of the mixing part, or smaller than the inner cavity cross-sectional area.

<82> The foam discharge cap according to <81>, in which a length of the adjacent foam flow path is longer than a dimension of the gas inlet in the axial direction of the adjacent foam flow path.

<83> The foam discharge cap according to any one of <74> to <82>, in which the foamer mechanism has one or more of the mixing parts, and a pair of the adjacent gas flow paths are arranged in correspondence to each of the mixing parts, and supply directions of the gas from the pair of adjacent gas flow paths to the corresponding mixing part are opposed to each other.

<84> The foam discharge cap according to any one of <74> to <82>, in which the foamer mechanism includes one or more of the mixing parts, and three of the adjacent gas flow paths are arranged in correspondence to each of the mixing parts, supply directions of the gas from the three adjacent gas flow paths to the corresponding mixing part are located on a same plane, and a supply direction of the liquid from the adjacent liquid flow path to the mixing part is a direction intersecting the plane.

<85> The foam discharge cap according to any one of <74> to <84>, in which the adjacent foam flow path has a foam outlet being open to the mixing part.

<86> The foam discharge cap according to <85>, in which the foamer mechanism includes a plurality of the mixing parts, and each of the plurality of mixing parts is defined by a plurality of the gas inlets, the liquid inlet, the foam outlet, and a wall surface.

The embodiments described above include the following technical concept.

<101> A foam discharger including: a foam generation unit that generates foam from liquid; a foam flow path through which the foam generated by the foam generation unit passes; and a discharge port that discharges foam that has passed through the foam flow path, in which the foam flow path includes: an upstream flow path; and a narrow flow path arranged adjacent on a downstream side of the upstream flow path and having a smaller flow path area than that of the upstream flow path, the narrow flow path is arranged at a center part of the upstream flow path when viewed in an axial direction at an upstream end of the narrow flow path, and an orthogonal cross-sectional shape of the narrow flow path orthogonal to a longitudinal direction of the narrow flow path is a flat shape.

<102> The foam discharger according to <101>, in which a dimension D1 in a major axis direction in the orthogonal cross-sectional shape of the narrow flow path repeatedly expands and contracts from an upstream side toward a downstream side.

<103> The foam discharger according to <102>, in which, in an upstream end part of the narrow flow path, a dimension D1 in the major axis direction increases from an upstream end toward a downstream side.

<104> The foam discharger according to <102> or <103>, in which, in a cross section along the longitudinal direction and the major axis direction, an outline of the narrow flow path at both ends in the major axis direction has a wavy curved shape.

<105> The foam discharger according to any one of <102> to <104>, in which, in a cross section along the longitudinal direction and the major axis direction, regarding an outline of the narrow flow path at both ends in the major axis direction, a maximum inclination angle with the longitudinal direction as a reference is less than 45 degrees.

<106> The foam discharger according to any one of <101> to <105>, in which a ratio S1/S2 between a maximum value S1 and a minimum value S2 of a flow path area of the narrow flow path is equal to or less than 2.

<107> The foam discharger according to any one of <101> to <106>, in which a ratio D1MAX/D1MIN between a maximum value D1MAX and a minimum value D1MIN of a dimension D1 in a major axis direction in the orthogonal cross-sectional shape of the narrow flow path is preferably equal to or less than 2, and the ratio D1MAX/D1MIN is more preferably equal to or less than 1.7.

<108> The foam discharger according to any one of <101> to <107>, in which a dimension D2 in a minor axis direction in the orthogonal cross-sectional shape is equal to or more than 0.5 mm and equal to or less than 4 mm.

<109> The foam discharger according to any one of <101> to <108>, in which a ratio D1/D2 between a dimension D1 in a major axis direction and a dimension D2 in a minor axis direction in the orthogonal cross-sectional shape is equal to or more than 1.5.

<110> The foam discharger according to any one of <101> to <109>, in which, in the orthogonal cross-sectional shape, a ratio D1/D2 between a dimension D1 in a major axis direction and a dimension D2 in a minor axis direction is preferably equal to or more than 1.7, and the ratio D1/D2 is preferably equal to or less than 12, and more preferably equal to or less than 8.

<111> The foam discharger according to any one of <101> to <110>, in which a length dimension L2 of the narrow flow path is equal to or more than 3 mm.

<112> The foam discharger according to any one of <101> to <111>, in which a length dimension L2 of the narrow flow path is more preferably equal to or more than 5 mm, and the length dimension L2 is preferably equal to or less than 40 mm, and more preferably equal to or less than 20 mm.

<113> The foam discharger according to any one of <101> to <112>, in which a length dimension L1 of the upstream flow path is equal to or more than 1 mm.

<114> The foam discharger according to any one of <101> to <113>, in which a length dimension L1 of the upstream flow path is preferably equal to or more than 2 mm, and the length dimension L1 is preferably equal to or less than 10 mm.

<115> The foam discharger according to any one of <101> to <114>, in which a length dimension L2 of the narrow flow path is longer than a length dimension L1 of the upstream flow path.

<116> The foam discharger according to any one of <101> to <115>, in which a flow path area is discontinuously changing at a boundary between a downstream end of the upstream flow path and an upstream end of the narrow flow path.

<117> The foam discharger according to <116>, in which a flow path area at an upstream end of the narrow flow path is equal to or more than 1% and equal to or less than 40% of a flow path area at a downstream end of the upstream flow path.

<118> The foam discharger according to <116> or <117>, in which a flow path area at an upstream end of the narrow flow path is equal to or more than 15% and equal to or less than 35% of a flow path area at a downstream end of the upstream flow path.

<119> The foam discharger according to any one of <101> to <118>, further including: a storage container that stores the liquid; and a mounting part that is mounted to the storage container, in which the foam generation unit, the foam flow path, and the discharge port are held by the mounting part.

<120> A liquid-filled foam discharger including: the foam discharger according to <119>; and the liquid filled in the storage container.

The embodiments described above include the following technical concept.

<201> A foam discharger including: a foam generation unit that generates foam from liquid; a foam flow path through which the foam generated by the foam generation unit passes; and a discharge port that discharges foam that has passed through the foam flow path, in which the foam flow path includes: an upstream flow path; a narrow flow path arranged adjacent on a downstream side of the upstream flow path and having a smaller flow path area than that of the upstream flow path; and a downstream flow path arranged adjacent on a downstream side of the narrow flow path and having a larger flow path area than that of the narrow flow path, and the foam generation unit has a plurality of foam outlets each open toward the upstream flow path, and a length dimension of the narrow flow path is larger than a length dimension of the upstream flow path.

<202> The foam discharger according to <201>, in which the narrow flow path is arranged at a center part of the upstream flow path when viewed in an axial direction at an upstream end of the narrow flow path.

<203> The foam discharger according to <202>, in which the narrow flow path is arranged at a position closer to a center than an arrangement region of the plurality of foam outlets when viewed in the axial direction.

<204> The foam discharger according to any one of <201> to <203>, in which a length dimension L2 of the narrow flow path is equal to or more than 3 mm.

<205> The foam discharger according to any one of <201> to <204>, in which a length dimension L2 of the narrow flow path is preferably equal to or more than 5 mm, and the length dimension L2 is preferably equal to or less than 40 mm, and more preferably equal to or less than 20 mm.

<206> The foam discharger according to any one of <201> to <205>, in which a length dimension L1 of the upstream flow path is equal to or more than 1 mm.

<207> The foam discharger according to any one of <201> to <206>, in which a length dimension L1 of the upstream flow path is preferably equal to or more than 2 mm, and the length dimension L1 is preferably equal to or less than 10 mm.

<208> The foam discharger according to any one of <201> to <207>, in which a flow path area is discontinuously changing at a boundary between a downstream end of the upstream flow path and an upstream end of the narrow flow path.

<209> The foam discharger according to <208>, in which a flow path area at an upstream end of the narrow flow path is equal to or more than 1% and equal to or less than 40% of a flow path area at a downstream end of the upstream flow path.

<210> The foam discharger according to <208> or <209>, in which a flow path area at an upstream end of the narrow flow path is equal to or more than 15% and equal to or less than 35% of a flow path area at a downstream end of the upstream flow path.

<211> The foam discharger according to any one of <201> to <210>, in which an inner diameter or a circle-equivalent diameter of the narrow flow path is preferably equal to or more than 0.5 mm and equal to or less than 6.0 mm, more preferably equal to or more than 1.0 mm and equal to or less than 4.0 mm, and even more preferably equal to or more than 2.0 mm.

<212> The foam discharger according to any one of <201> to <211>, in which a flow path area of the narrow flow path repeatedly expands and contracts from an upstream side toward a downstream side.

<213> The foam discharger according to <212>, in which, in a cross section along a longitudinal direction of the narrow flow path, an outline of the narrow flow path at both end sides in a direction orthogonal to the longitudinal direction has a wavy curved shape.

<214> The foam discharger according to any one of <201> to <213>, further including: a storage container that stores the liquid; and a mounting part that is mounted to the storage container, in which the foam generation unit, the foam flow path, and the discharge port are held by the mounting part.

<215> A liquid-filled foam discharger including: the foam discharger according to <214>; and the liquid filled in the storage container.

Examples

Hereinafter, examples will be described with reference to FIGS. 33A to 35G.

Each of FIG. 33A to FIG. 35G is a photograph obtained by generating foam by using a foamer mechanism having a structure similar to that of the first embodiment (a structure including an enlarged foam flow path as in FIG. 2), discharging the foam onto a petri dish, and capturing an image of the foam and the petri dish. Note that an overall structure of the foam discharger similar to that of the third embodiment was used, and a foamer mechanism similar to that of the first embodiment was incorporated instead of the foamer mechanism of the third embodiment.

Each of FIG. 33A to FIG. 33G among these is an example (hereinafter, Example 1) in which the foam outlet of the adjacent foam flow path is circular with a diameter of 0.5 mm, the liquid inlet of the adjacent liquid flow path is a square with a side of 0.5 mm, and the gas inlet of each adjacent gas flow path is a square with a side of 0.35 mm.

Each of FIG. 34A to FIG. 34G is an example (hereinafter, Example 2) in which the foam outlet of the adjacent foam flow path is circular with a diameter of 0.79 mm, the liquid inlet of the adjacent liquid flow path is a square with a side of 0.3 mm, and the gas inlet of each adjacent gas flow path is a square with a side of 0.5 mm.

Each of FIG. 35A to FIG. 35G is an example (hereinafter, Example 3) in which the foam outlet of the adjacent foam flow path is circular with a diameter of 0.5 mm, the liquid inlet of the adjacent liquid flow path is a square with a side of 0.7 mm, and the gas inlet of each adjacent gas flow path is a square with a side of 0.3 mm.

In any of Examples 1, 2, and 3, a gas/liquid ratio, that is, a volume ratio of a gas to liquid supplied to the mixing part 21 (a volume of gas/a volume of liquid) was set to 13.

Therefore, in any of Examples 1, 2, and 3, amounts of the gas and the liquid supplied per unit time to the mixing part are the same, but a flow rate of the gas supplied to the mixing part is the fastest in Example 3, the second fastest in Example 1, and the slowest in Example 2. In addition, a flow rate of the liquid supplied to the mixing part is the fastest in Example 2, the second fastest in Example 1, and the slowest in Example 3.

Note that no mesh was used in any of Examples 1, 2, and 3.

Figure 33A:
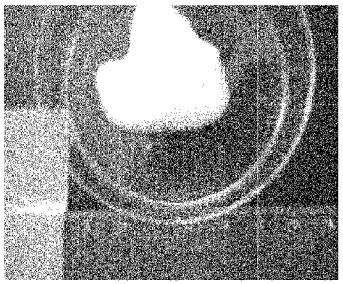
FIGS. 33A, 33B, 33C, 33D, 33E, 33F, and 33G are views showing photographs of foam generated by Example 1, Example 2, Example 3, Example 4, Example 5, Example 6, and Example 7, respectively.
Figure 33B:
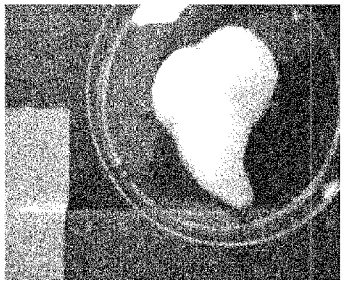
Figure 33C:
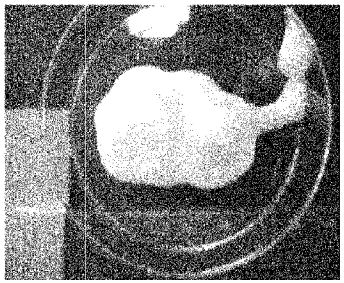
Figure 33D:
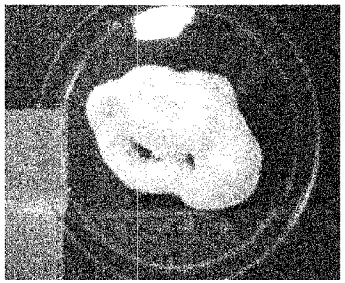
Figure 33E:
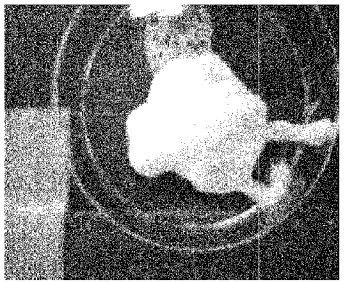
Figure 33F:
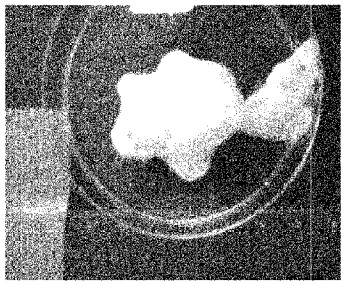
Figure 33G:
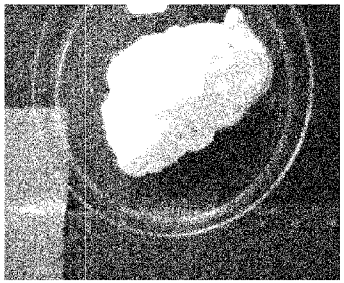
Figure 34A:
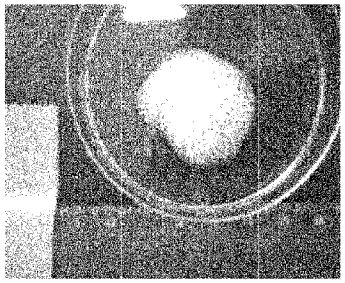
FIGS. 34A, 34B, 34C, 34D, 34E, 34F, and 34G are views showing photographs of foam generated by Example 8, Example 9, Example 10, Example 11, Example 12, Example 13, and Example 14, respectively.
Figure 34B:
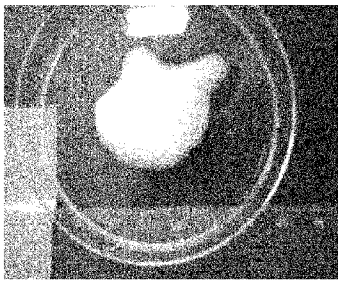
Figure 34C:
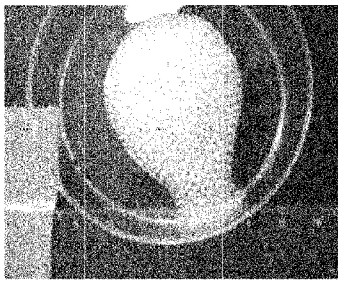
Figure 34D:
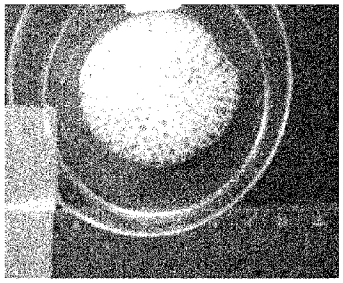
Figure 34E:
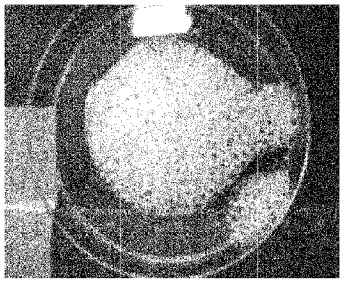
Figure 34F:
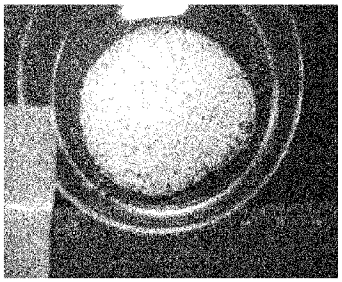
Figure 34G:
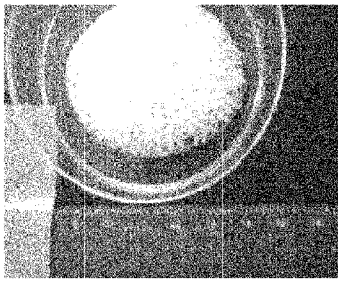
Figure 35A:
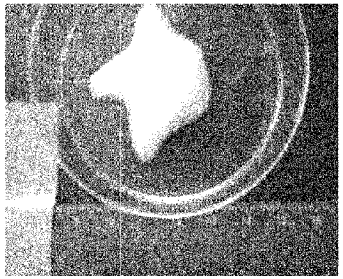
FIGS. 35A, 35B, 35C, 35D, 35E, 35F, and 35G are views showing photographs of foam generated by Example 15, Example 16, Example 17, Example 18, Example 19, Example 20, and Example 21, respectively.
Figure 35B:
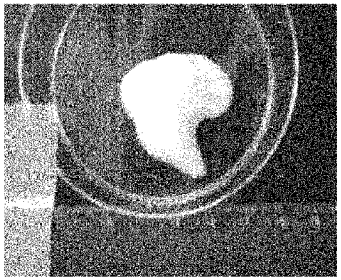
Figure 35C:
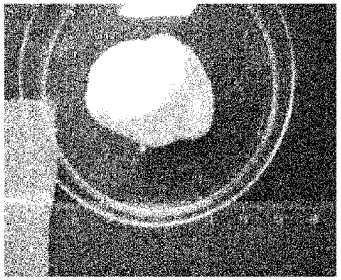
Figure 35D:
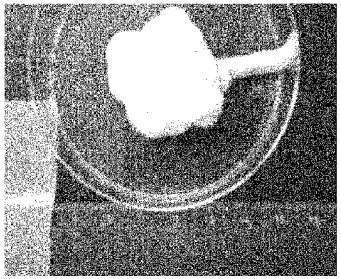
Figure 35E:
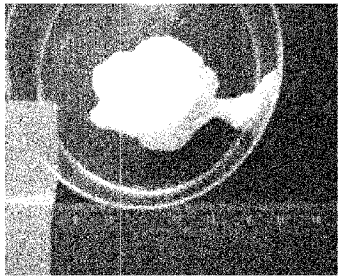
Figure 35F:
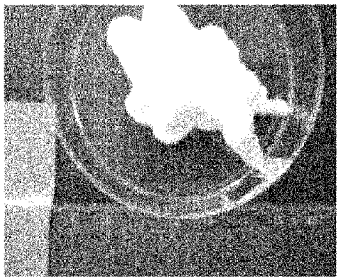
Figure 35G:
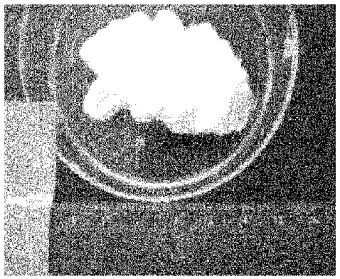

FIG. 33A, FIG. 34A, and FIG. 35A show foam when a pushing speed of the head part is 5 mm/sec, FIG. 33B, FIG. 34B, and FIG. 35B show foam when the pushing speed of the head part is 10 mm/sec, FIG. 33C, FIG. 34C, and FIG. 35C show foam when the pushing speed of the head part is 20 mm/sec, FIG. 33D, FIG. 34D, and FIG. 35D show foam when the pushing speed of the head part is 30 mm/sec, FIG. 33E, FIG. 34E, and FIG. 35E show foam when the pushing speed of the head part is 40 mm/sec, FIG. 33F, FIG. 34F, and FIG. 35F show foam when the pushing speed of the head part is 50 mm/sec, and FIG. 33G, FIG. 34G, and FIG. 35G show foam when the head pushing speed is 60 mm/sec.

In any of Examples 1, 2, and 3, fineness of the foam was almost uniform regardless of the pushing speed of the head part (that is, amounts of the gas and the liquid supplied to the mixing part per unit time).

The reason for this seems to be because, when the pushing speed of the head part is increased, a period of the swing of the liquid column as described above is shortened, but the amount of gas supplied per unit time to the mixing part is also increased.

Further, the foam in Example 1 was finer than that in Example 2, and the foam in Example 3 was finer than that in Example 1. This has shown that the effect of making the foam fine was enhanced when the total area of the two gas inlets was equal to or less than the area of the liquid inlet. In other words, it is considered that the foam can be made finer by increasing the flow rate of the gas supplied to the mixing part to equal to or more than a certain degree.

In the case of Example 2 as well, it was possible to generate sufficiently fine foam by using a mesh.

This application claims priority based on Japanese Patent Application No. 2017-240240 filed on Dec. 15, 2017, Japanese Patent Application No. 2018-229837 filed on Dec. 7, 2018, Japanese Patent Application No. 2018-213760 filed on Nov. 14, 2018, and Japanese Patent Application No. 2018-213761 filed on Nov. 14, 2018, the entire disclosure of which is incorporated herein.

REFERENCE SIGNS LIST

10 storage container
11 body part
13 mouth and neck part
14 bottom part
20 foamer mechanism (foam generation unit)
21 mixing part
22 merging part
23 gas-liquid contact region
28 gas supply unit
29 liquid supply unit
30 head member (head part)
31 operation receiving part
32 inner cylinder part

32*a* upward movement regulating part
32*b* groove
32*c* holding part
32*d* flow path
33 outer cylinder part
40 nozzle part
41 discharge port
50 liquid flow path
51 adjacent liquid flow path
52 liquid inlet
53 large-diameter liquid flow path
70 gas flow path
71, 71*a*, 71*b*, and 71*c* adjacent gas flow path
72, 72*a*, 72*b*, and 72*c* gas inlet
73 axial gas flow path
74 circular gas flow path
75 axial communication gas flow path
80 liquid column
90 foam flow path
91 adjacent foam flow path
92 foam outlet
93 enlarged foam flow path
100 foam discharger
101 liquid
110 cap member
111 mounting part
112 annular closing part
113 upright cylinder part
120 cylinder member
121 gas cylinder component
122 liquid cylinder component
122*a* straight part
122*b* reduced diameter part
123 annular connection part
125 tube holding part
126 rib
126*a* spring receiving part
127 valve seat
128 dip tube
129 through hole
130 piston guide
131 valve seat part
131*a* through hole
132 housing space
133 flange part
134 valve forming groove
135 flow path forming groove
136 rib
140 liquid piston
141 outer peripheral piston part
142 spring receiving part
143 constriction part
150 gas piston
151 cylindrical part
152 piston part
153 outer peripheral ring part
154 suction opening
155 suction valve member
160 poppet
161 upper end part
162 valve body
162*a* spring receiving part
170 coil spring
180 ball valve
190 packing
200 foam discharge cap
210 gas pump chamber
211 flow path
212 cylindrical gas flow path
213 axial flow path
214 circular flow path
220 liquid pump chamber
300 first member
301 center hole
311 first cylinder part
312 second cylinder part
313 third cylinder part
314 fourth cylinder part
321 projection
331 outer peripheral cutout part
341 radial gas groove
342 axial gas groove
343 groove upper end part
344 peripheral circumferential groove
345 radial groove
346 groove tip end
350 partition
390 alignment recess
400 second member
410 cylinder part
411 recess
412 recess
413 step part
420 plate part
421 hole
490 alignment projection
500 liquid-filled product (liquid-filled foam discharger)
600 pump part
700 foam flow path
710 foam outlet
720 upstream flow path
722 downstream end
730 narrow flow path
731 upstream end
732 downstream end
733 outline
734 upstream end part
735 downstream end part
740 downstream flow path
741 in-nozzle foam flow path
810 first member
810*a* recess
811 first portion
811*a* projection
812 second portion
813 third portion
814 fourth portion
815 hole
816 axial gas groove
817 first upper surface groove
818 second upper surface groove
819 third upper surface groove
820 second member (lower member)
820*a* protrusion
821 recess
822 cylinder part
823 plate part
824 hole
830 upper member
831 lower end surface
832 fitting part

The invention claimed is:

1. A foam discharger comprising:

a foamer mechanism that generates foam from liquid;

a liquid supply unit that supplies liquid to the foamer mechanism;

a gas supply unit that supplies a gas to the foamer mechanism;

a discharge port that discharges the foam generated by the foamer mechanism; and a foam flow path through which the foam from the foamer mechanism toward the discharge port passes, wherein the foamer mechanism includes:

a mixing part where the liquid supplied from the liquid supply unit and the gas supplied from the gas supply unit meet;

a liquid flow path through which the liquid supplied from the liquid supply unit to the mixing part passes; and a gas flow path through which the gas supplied from the gas supply unit to the mixing part passes, the foam flow path includes an adjacent foam flow path being adjacent on a downstream side of the mixing part, the liquid flow path includes an adjacent liquid flow path being adjacent on an upstream side of the mixing part and having a liquid inlet that is open to the mixing part, the gas flow path includes a plurality of adjacent gas flow paths being adjacent on an upstream side of the mixing part and each having a gas inlet that is open to the mixing part, the liquid inlet is arranged at a position corresponding to a merging part of the gases supplied from the plurality of adjacent gas flow paths to the mixing part via the gas inlet, the adjacent foam flow path has a foam outlet being open to the mixing part, the foamer mechanism includes a plurality of the mixing parts, and each of the plurality of the mixing parts is defined by a plurality of the gas inlets, the liquid inlet, the foam outlet, and a wall surface.

2. The foam discharger according to claim 1, wherein the foamer mechanism has one or more of the adjacent liquid flow paths, and the mixing part is arranged in correspondence to each of the adjacent liquid flow paths.

3. The foam discharger according to claim 2, wherein the plurality of adjacent gas flow paths for exclusive use are arranged in correspondence to each piece of the mixing part.

4. The foam discharger according to claim 3, wherein the foamer mechanism includes a partition that mutually partitions each of the adjacent gas flow paths corresponding to one of the mixing parts among the mixing parts adjacent to each other and each of the adjacent gas flow paths corresponding to another one of the mixing parts.

5. The foam discharger according to claim 2, wherein the liquid flow path includes a large-diameter liquid flow path being adjacent on an upstream side of the adjacent liquid flow path and having a flow path area larger than that of the adjacent liquid flow path, the plurality of the mixing parts are arranged around a downstream end part of the large-diameter liquid flow path, and a plurality of the adjacent liquid flow paths extend from a downstream end part of the large-diameter liquid flow path toward a periphery in an in-plane direction intersecting an axial direction of the large-diameter liquid flow path.

6. The foam discharger according to claim 2, wherein the foam flow path includes each piece of the adjacent foam flow path in correspondence to each of the mixing parts.

7. The foam discharger according to claim 6, wherein the foam flow path includes an enlarged foam flow path being adjacent on a downstream side of the adjacent foam flow path and having a flow path area larger than that of the adjacent foam flow path, and the adjacent foam flow path corresponding to each of the plurality of the mixing parts merges into one piece of the enlarged foam flow path.

8. The foam discharger according to claim 1, wherein a flow path area of the adjacent foam flow path is equal to a maximum value of an inner cavity cross-sectional area orthogonal to an axial direction of the adjacent foam flow path of the mixing part, or smaller than the inner cavity cross-sectional area.

9. The foam discharger according to claim 8, wherein a length of the adjacent foam flow path is longer than a dimension of the gas inlet in the axial direction of the adjacent foam flow path.

10. The foam discharger according to claim 1, wherein a pair of the adjacent gas flow paths are arranged in correspondence to each of the mixing parts, and supply directions of the gas from the pair of the adjacent gas flow paths to the corresponding mixing part are opposed to each other.

11. The foam discharger according to claim 1, wherein three of the adjacent gas flow paths are arranged in correspondence to each of the mixing parts, supply directions of the gas from the three adjacent gas flow paths to the corresponding mixing part are located on a same plane, and a supply direction of the liquid from the adjacent liquid flow path to the mixing part is a direction intersecting the plane.

12. The foam discharger according to claim 1, wherein the foam flow path includes:

an upstream flow path; and a narrow flow path arranged adjacent on a downstream side of the upstream flow path and having a smaller flow path area than that of the upstream flow path, the narrow flow path is arranged at a center part of the upstream flow path when viewed in an axial direction at an upstream end of the narrow flow path, and an orthogonal cross-sectional shape of the narrow flow path orthogonal to a longitudinal direction of the narrow flow path is a flat shape.

13. The foam discharger according to claim 1, wherein the foam flow path includes:

an upstream flow path;

a narrow flow path arranged adjacent on a downstream side of the upstream flow path and having a smaller flow path area than that of the upstream flow path; and a downstream flow path arranged adjacent on a downstream side of the narrow flow path and having a larger flow path area than that of the narrow flow path, the foamer mechanism has a plurality of foam outlets each being open toward the upstream flow path, and a length dimension of the narrow flow path is larger than a length dimension of the upstream flow path.

14. The foam discharger according to claim 13, wherein the narrow flow path is arranged at a center part of the upstream flow path when viewed in an axial direction at an upstream end of the narrow flow path.

15. The foam discharger according to claim 14, wherein the narrow flow path is arranged at a position closer to a center than an arrangement region of the plurality of foam outlets when viewed in the axial direction.

* * * * *